US006005339A

United States Patent [19]

Misono

[11] Patent Number: 6,005,339

[45] **Date of Patent: *Dec. 21, 1999**

[54] CRT WITH DEFLECTION DEFOCUSING CORRECTION

[75] Inventor: Masayoshi Misono, Chousei-gun, Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/643,754

[22] Filed: May 6, 1996

[30] Foreign Application Priority Data

May 12, 1995 [JP] Japan ..... 7-114755

[51] Int. Cl.[6] ..... H01J 29/76

[52] U.S. Cl. ..... 313/413; 313/414

[58] Field of Search ..... 313/412, 413, 313/414, 431

[56] References Cited

U.S. PATENT DOCUMENTS

| | | | |
|---|---|---|---|
| 4,057,747 | 11/1977 | Hamano | 313/413 |
| 4,209,702 | 6/1980 | Shirai et al. | 250/396 MI |
| 4,329,618 | 5/1982 | Chang | 313/431 |
| 4,346,327 | 8/1982 | Barten | 313/413 |
| 4,490,644 | 12/1984 | Shimoma | 313/412 |
| 4,556,819 | 12/1985 | Chen et al. | 313/413 |
| 4,641,058 | 2/1987 | Koshigoe et al. | 313/449 |
| 4,877,993 | 10/1989 | Ogasa | 313/414 |
| 5,036,258 | 7/1991 | Chen et al. | 313/414 |
| 5,107,238 | 4/1992 | Leupold | 335/306 |
| 5,113,112 | 5/1992 | Shimoma et al. | 313/412 |
| 5,170,101 | 12/1992 | Gorski et al. | 313/412 |
| 5,350,967 | 9/1994 | Chen | 313/413 |
| 5,412,277 | 5/1995 | Chen | 313/414 |
| 5,414,323 | 5/1995 | Uchida et al. | 313/414 |
| 5,488,265 | 1/1996 | Chen | 313/414 |
| 5,528,211 | 6/1996 | Perreault et al. | 335/296 |

FOREIGN PATENT DOCUMENTS

| | | | |
|---|---|---|---|
| 0170319 | 2/1986 | European Pat. Off. | H01J 29/72 |
| 0210900 | 2/1987 | European Pat. Off. | H01J 29/76 |
| 51-61766 | 5/1976 | Japan | H01J 29/50 |
| 53-18866 | 6/1978 | Japan | H01J 29/50 |
| 54-139372 | 10/1979 | Japan | H01J 29/51 |
| 58-220339 | 12/1983 | Japan | H01J 29/51 |
| 59-127346 | 7/1984 | Japan | H01J 29/50 |
| 60-81736 | 5/1985 | Japan | H01J 29/48 |
| 63-294653 | 1/1988 | Japan | H01J 29/56 |
| 4-52586 | 8/1992 | Japan | H01J 29/50 |
| 4-324229 | 11/1992 | Japan | H01J 29/50 |
| 5-74367 | 3/1993 | Japan | H01J 29/50 |
| 6-36704 | 2/1994 | Japan | H01J 29/50 |
| 7-21938 | 1/1995 | Japan | H01J 29/54 |
| 7-78573 | 3/1995 | Japan | H01J 29/50 |
| 7-211258 | 8/1995 | Japan | H01J 29/76 |

OTHER PUBLICATIONS

"Method of Fabricating a Unitized Shunt Assembly", A. Wright, RCA Technical Notes, Nov. 1985, No. 1373, Princeton, NJ, USA, pp. 1–2.

*Primary Examiner*—Michael Day
*Attorney, Agent, or Firm*—Antonelli, Terry, Stout & Kraus, LLP.

[57] ABSTRACT

A cathode ray tube includes an electron gun having a plurality of electrodes, an electron beam deflection device and a phosphor screen. A method of correcting deflection defocusing in the cathode ray tube includes placement of pole pieces of magnetic material in a deflection magnetic field produced by the electron beam deflection device and thereby establishing a non-uniform magnetic field varying in synchronism with the deflection magnetic field in a path of an electron beam and correcting deflection defocusing of the electron beam corresponding to deflection of the electron beam in amount. The pole pieces are disposed within 50 mm from a magnetic core of the electron beam deflection device toward a cathode of the electron gun.

39 Claims, 54 Drawing Sheets

Magnetic flux density distribution in a plane Y-Y

Magnetic flux density distribution in a plane Y-Y

Magnetic flux density distribution in a plane Y–Y

Magnetic flux density distribution in a plane Y–Y

Magnetic flux density distribution in a plane Y-Y

Magnetic flux density distribution

CRT WITH DEFLECTION DEFOCUSING CORRECTION

BACKGROUND OF THE INVENTION

The present invention relates to a cathode ray tube (CRT), and particularly to a method of correcting deflection defocusing in a cathode ray tube which is capable of improving focus characteristics and thereby obtaining a sufficient resolution over the entire phosphor screen and over the entire electron beam current region; a cathode ray tube employing the method; and an image display system including the cathode ray tube.

A cathode ray tube such as a picture tube or a display tube includes at least an electron gun having a plurality of electrodes and a phosphor screen (screen having a phosphor film, which is also referred to as "phosphor film" or simply as "screen" hereinafter), and it also includes a deflection device for allowing an electron beam emitted from the electron gun to scan on the phosphor screen.

As for such a cathode ray tube, there have been known the following techniques for obtaining a desirable reproduced image on the entire phosphor screen from the center to the peripheral portion.

Japanese Patent Publication No. Hei 4-52586 discloses an electron gun emitting three in-line electron beams in which a pair of parallel flat electrodes are disposed on the bottom face of a shield cup in such a manner as to be positioned above and below paths of the three electron beams in parallel to the in-line direction and to extend toward a main lens.

U.S. Pat. No. 4,086,513 and its corresponding Japanese Patent Publication No. Sho 60-7345 disclose an electron gun emitting three in-line electron beams in which a pair of parallel flat electrodes are disposed above and below paths of the three electron beams in parallel to the in-line direction in such a manner as to extend from a facing end of one of a pair of main-lens-forming electrodes toward a phosphor screen, thereby shaping the electron beams before the electron beams enter a deflection magnetic field.

Japanese Patent Laid-open No. Sho 51-61766 discloses an electron gun in which an electrostatic quardrupole lens is formed between two electrodes and the strength of the electrostatic quardrupole lens is made to vary dynamically in synchronization with the deflection of an electron beam, thereby achieving uniformity of an image over the entire screen.

Japanese Patent Publication No. Sho 53-18866 discloses an electron gun in which an astigmatic lens is provided in a region between a second grid electrode and a third grid electrode forming a prefocus lens.

U.S. Pat. No. 3,952,224 and its corresponding Japanese Patent Laid-open No. Sho 51-64368 discloses an electron gun emitting three in-line electron beams in which an electron beam aperture of each of first and second grid electrodes is formed in an elliptic shape, and the degree of ellipticity of the aperture is made to differ for each beam path or the degree of ellipticity of the electron beam aperture of the center electron gun is made smaller than that of the side electron gun.

Japanese Patent Laid-open No. Sho 60-81736 discloses an electron gun emitting three in-line electron beams in which a slit recess provided in a third grid electrode on the cathode side forms a non-axially-symmetrical lens, and an electron beam is made to impinge on the phosphor screen through at least one non-axially-symmetrical lens in which the axial depth of the slit recess is larger for the center beam than for the side beam.

Japanese Patent Laid-open No. Sho 54-139372 discloses a color cathode ray tube having an electron gun emitting three in-line electron beams in which a soft magnetic material is disposed in fringe portions of the deflection magnetic field to form a pincushion-shaped magnetic field for deflecting the electron beams in the direction perpendicular to the in-line direction of each electron beam, thereby suppressing a halo caused by the deflection magnetic field in the direction perpendicular to the in-line direction.

The desirable focus characteristics of a cathode ray tube include a desirable resolution over the entire screen and over the entire electron beam current region; a characteristic without generation of moire in a small-current region; and uniformity in resolution over the entire screen and over the entire electron beam current region. The design of an electron gun for simultaneously satisfying a plurality of these focus characteristics requires a high technique.

The studies by the present inventors showed that an electron gun having a combination of an astigmatic lens and a large-diameter main lens is essential to give the above focus characteristics to a cathode ray tube.

In the above-described related arts, however, a dynamic focus voltage has been required to be applied to a focus electrode of an electron gun for obtaining a desirable resolution over the entire screen using electrodes forming an astigmatic lens, that is, non-axially-symmetrical lens in the electron gun.

FIG. 80 is a side view of the entire configuration of one example of an electron gun used for a cathode ray tube; and FIG. 81 is a partial sectional view seen in the direction of an arrow of FIG. 80 showing an essential portion of the electron gun.

The electron gun of this type has a plurality of electrodes including a cathode K, a first grid electrode (G1) 1, a second grid electrode (G2) 2, a third grid electrode (G3) 3, a fourth grid electrode (G4) 4, a fifth grid electrode (G5) 5, a sixth grid electrode (G6) 6, and a shield cup 100 integrally attached to the sixth grid electrode (G6) 6. In addition, the fifth grid electrode (G5) 5 is composed of two electrodes 51, 52.

A focus voltage is applied between the third grid electrode 3 and the fifth electrode 5, and an anode voltage is applied only to the sixth electrode 6, so that an electron beam produced by a so-called triode portion composed of the cathode K, the first grid electrode 1 and the second grid electrode 2 is accelerated and focused by an electron lens formed by the third grid electrode 3 to the sixth grid electrode 6, to project toward a phosphor screen.

Effects on an electron beam of electric fields determined by lengths of the electrodes, and diameters of electron beam apertures in the electrodes of this electron gun differ from electrode to electrode. For example, the shape of the electron beam aperture of the first grid electrode near the cathode K exerts an effect on the spot shape of an electron beam in a small-current region; however, the shape of the electron beam aperture of the second grid electrode exerts an effect on the spot shape of an electron beam in a wide current region from the small-current region to the large-current region.

In the electron gun in which a main lens is formed between the fifth grid electrode 5 and the sixth grid electrode 6 by applying an anode voltage to the sixth grid electrode 6, the shape of the electron beam aperture of each of the fifth grid electrode 5 and the sixth grid electrode 6 forming the main lens exerts a large effect on the shape of the electron beam in a large-current region but exerts a smaller effect on the shape of the electron beam in a small-current region than in the large-current region.

The axial length of the fourth grid electrode 4 of the electron gun exerts an effect on the magnitude of the optimum focus voltage and also exerts a large effect on a difference in the optimum focus voltage between a small-current region and a large-current region. The effect of the axial length of the fifth grid electrode 5, however, is significantly smaller than that of the fourth grid electrode 4.

Accordingly, it is required for optimizing the characteristics of each electron beam to optimize the structure of each electrode to be most effective to each characteristic of the electron beam.

In the case where a shadow mask pitch in the direction perpendicular to the electron beam scanning direction is made smaller or the density of electron beam scanning lines is increased for enhancing resolution in the direction perpendicular to the electron beam scanning direction of a cathode ray tube, an interference is generated between the electron beam scanning line and the shadow mask particularly in the electron beam small-current region, and accordingly moire contrast must be suppressed. The technical developments in this art area, however, have yet to solve the above-described problems.

For example, FIG. 82A and 82B are schematic views, each showing an essential portion of an electron gun, for comparing the two structures of the electron guns depending on the manner of supplying the focus voltage with each other; wherein FIG. 82A shows a fixed-focus-voltage type electron gun; and FIG. 82B shows a dynamic-focus-voltage type electron gun.

The configuration of the electron gun of the fixed-focus-voltage type shown in FIG. 82A is the same as that shown in FIGS. 80 and 81, and therefore, parts corresponding to those in FIGS. 80 and 81 are indicated by the same characters.

In the electron gun of the fixed-focus-voltage type shown in FIG. 82A, a focus voltage Vf1 having the same potential is applied to the electrodes 51 and 52 forming the fifth grid electrode 5. In this figure, an equation of the opening radius $R_5$>0.1×opening radius Rs is satisfied.

On the other hand, in the electron gun of the dynamic-focus-voltage type shown in FIG. 82B, different focus voltages are respectively supplied to the electrodes 51 and 52 forming the fifth grid electrode 5. In particular, a dynamic focus voltage dVf is supplied to the electrode 52.

In the electron gun of the dynamic-focus-voltage type shown in FIG. 82B, moreover, the electrode 52 has a portion extending in the electrode 51. This complicates the structure as compared with the electron gun shown in FIG. 82A, to increase the cost of parts and make poor the efficiency in the assembling process.

FIGS. 83A and 83B are graphs showing focus voltages respectively supplied to the electron guns shown in FIGS. 82A and 82B, wherein FIG. 83A shows a focus voltage supplied to the electron gun of the fixed-focus-voltage type; and FIG. 83B shows the focus voltage supplied to the electron gun of the dynamic-focus-voltage type.

Specifically, FIG. 83A shows the state that the fixed focus voltage $Vf_1$ is applied to the third grid electrode 3 and the fifth grid electrode 5 (51, 52). On the other hand, FIG. 83B shows the state that the fixed focus voltage $Vf_1$ is applied to the third electrode 3 and the electrode 51 of the fifth grid electrode 5 and a voltage having a waveform in which another fixed focus voltage $Vf_2$, superposed with the dynamic focus voltage dVf, is applied to the electrode 52 of the fifth grid electrode 5.

As a result, the electron gun of the dynamic-focus-voltage type shown in FIG. 83B requires two stem pins for supplying focus voltages, and thereby it requires high-voltage insulation from the other stem pin as compared with the electron gun of the fixed-focus-voltage type shown in FIG. 83A.

Accordingly, the dynamic-focus-voltage type electron gun requires a specified structure in a current supply socket to a cathode ray tube in a TV receiver set and a terminal display system, and further it requires a dynamic-focus-voltage generating circuit in addition to the two fixed-focus-voltage power supplies. This causes a disadvantage in that it takes a lot of time for adjusting two focus voltages the lens actions of which interact with each other and phasing a dynamic focus voltage to electron beam deflection.

Especially, for use in multimedia expected to be widely spread soon, a display system needs to be capable of being driven at a plurality of deflection frequencies. This requires dynamic focus voltage generators for respective deflection frequencies and phasing a dynamic focus voltage to electron beam deflection at respective frequencies, increasing the cost of electrical circuits and set-up procedures, which which cost increases with the screen size and maximum deflection angle of a cathode ray tube exponentially

SUMMARY OF THE INVENTION

An object of the present invention is to solve the above-described problems of the related arts, and to provide a method of correcting deflection defocusing in a cathode ray tube which is capable of improving focus characteristics and obtaining a desirable resolution over the entire screen and over the entire electron beam current region, particularly, without dynamic focusing, and which is also capable of reducing moire in a small-current region and operation by a single fixed voltage regardless of deflection frequencies; a cathode ray tube employing the method; and an image display system including the cathode ray tube.

Another object of the present invention is to solve the above-described problems of the related arts, and to provide a method of correcting deflection defocusing of a cathode ray tube which is capable of improving focus characteristics and obtaining a desirable resolution over the entire screen and over the entire electron beam current region, particularly, at a low dynamic focusing voltage; a cathode ray tube employing the method; and an image display system including the cathode ray tube.

In a cathode ray tube, the maximum deflection angle (hereinafter, referred to simply to "deflection angle" or "deflection amount") is substantially in a specified range, and accordingly, as the size of a phosphor screen is enlarged, a distance between the phosphor screen and a main focus lens of an electron gun is extended, as a result of which a mutual space-charge repulsion of an electron beam in such a space promotes the lowering of focus characteristics.

Accordingly, resolution of a cathode ray tube can be improved by provision of a means for reducing the lowering of focus characteristics due to the above space-charge repulsion thereby obtaining a small electron beam spot as in a small size phosphor screen.

A further object of the present invention is to provide a method of correcting deflection defocusing of a cathode ray tube which is capable of reducing the lowering of focus characteristics due to a space-charge repulsion of an electron beam in a space between a phosphor screen and a main focus lens of an electron gun; a cathode ray tube employing the method; and an image display system including the cathode ray tube.

Still a further object of the present invention is to provide a method of correcting deflection defocusing of a cathode ray tube which is capable of improving focus characteristics and of reducing the total length of the cathode ray tube; a cathode ray tube employing the method; and an image display system including the cathode ray tube.

An additional object of the present invention is to provide a method of correcting deflection defocusing of a cathode ray tube which is capable of preventing the lowering of uniformity of an image over the entire screen even in a cathode ray tube of a wider deflection angle; a cathode ray tube employing the method; and an image display system including the cathode ray tube.

The total length of a cathode ray tube can be shortened by extending a deflection angle. The depth of the existing TV receiver set (hereinafter, referred to as "TV set") is dependent on the total length of the cathode ray tube, and it is desirable to be shortened as much as possible because the TV set is generally regarded as furniture. The shortening of the depth of a TV set is also advantageous in transportation efficiency at the time when a TV set maker transports a large number of TV sets.

To achieve the above object, according to a preferred embodiment of the present invention, there is provided a cathode ray tube including at least an electron gun having a plurality of electrodes, a deflection device, and a phosphor screen, wherein the cathode ray tube includes pole pieces in a deflection magnetic field for locally modifying the deflection magnetic field, thereby correcting deflection defocusing of an electron beam.

The above correction of deflection defocusing is preferably performed in accordance with a deflection amount by forming, in a deflection magnetic field, at least one locally modified non-uniform magnetic field synchronized with the deflection magnetic field on each of opposite sides of a path of an undeflected electron beam.

The above correction of deflection defocusing is also preferably performed in accordance with a deflection amount by forming, in a deflection magnetic field, a locally modified non-uniform magnetic field synchronized with the deflection magnetic field at a position substantially centered about a path of an undeflected electron beam.

Preferably, the above locally modified non-uniform magnetic field has a diverging or focusing action on an electron beam, and it corrects deflection defocusing in accordance with a deflection amount in the electron beam scanning direction or in the direction perpendicular to the scanning direction.

According to another embodiment of the present invention, there is provided a color cathode ray tube of the type having three in-line electron beams, wherein deflection defocusing is corrected in accordance with a deflection amount by locally modified non-uniform magnetic fields formed in a deflection magnetic field in such a manner as to be different in intensity between that for the center electron beam and that for each side electron beam.

According to a further embodiment of the present invention, there is provided a color cathode ray tube of the type having three in-line electron beams, wherein deflection defocusing is corrected in accordance with a deflection amount in a state that a locally modified non-uniform magnetic field for each side electron beam formed in a deflection magnetic field has distributions that are different between that on the side near the center electron beam and that on the side remote from the center electron beam.

According to still a further embodiment, there is provided a color cathode ray tube of the type having three in-line electron beams, wherein locally modified non-uniform magnetic fields are formed in a deflection magnetic field in such a manner that a locally modified non-uniform magnetic field having a diverging action synchronized with the deflection magnetic field is disposed at each side of a path of an undeflected electron beam in the direction perpendicular to the in-line direction, thereby correcting deflection defocusing in the direction perpendicular to the in-line direction; and a locally modified non-uniform magnetic field having a focusing action synchronized with the deflection magnetic field is disposed at each of sides of the path of the undeflected electron beam in the in-line direction, thereby correcting deflection defocusing in the in-line direction.

The above correction of deflection defocusing in the present invention is preferably performed in accordance with a deflection amount by forming, in a deflection magnetic field, at least one locally modified non-uniform magnetic field varying in synchronization with a variation in the deflection magnetic field at each side of a path of an undeflected electron beam.

The material of the magnetic path formed in a deflection magnetic field for correcting the above deflection defocusing in the present invention is preferably a soft magnetic material.

The material of the magnetic path formed in a deflection magnetic field for correcting the above deflection defocusing in the present invention is also preferably a soft magnetic material having a relative permeability of 50 or more.

BRIEF DESCRIPTION OF THE DRAWINGS

The accompanying drawings, which form an integral part of the specification and are to be read in conjunction therewith, in which like reference numerals designate similar components throughout the figures, and in which:

FIGS. 3A to 3D are schematic views illustrating a fourth embodiment of a method of correcting deflection defocusing of a cathode ray tube according to the present invention, wherein FIGS. 3A and 3C are sectional views, and FIGS. 3B and 3D are magnetic distribution diagrams;

FIGS. 4A to 4D are schematic views illustrating a fifth embodiment of a method of correcting deflection defocusing of a cathode ray tube according to the present invention, wherein FIGS. 4A and 4C are sectional views, and FIGS. 4B and 4D are magnetic distribution diagrams;

FIGS. 10A and 10B are views illustrating an axial deflection magnetic field distribution of a deflection magnetic field in a cathode ray tube having a deflection angle of 100° or more, wherein FIG. 10A is the deflection magnetic field distribution, and FIG. 10B shows a positional relationship;

FIGS. 11A and 11B are views illustrating an axial deflection magnetic field distribution of a deflection magnetic field in a cathode ray tube having a deflection angle of 100° or less, wherein FIG. 11A is the deflection magnetic field distribution, and FIG. 11B shows a positional relationship;

FIGS. 82A and 82B are schematic sectional views of essential portions of electron guns for comparing the configurations of the electron guns depending on the supply of a focus voltage with each other, wherein FIG. 82A shows a fixed-focus-voltage type, and FIG. 82B shows a dynamic-focus-voltage type;

FIGS. 84A, 84B to 89A, 89B, each of which are a front view and a sectional view illustrating a combination embodiment of deflection defocusing correction pole pieces and a pole piece support used for a color cathode ray tube of the type having three inline electron beams of the present invention.

DETAILED DESCRIPTION OF THE PREFERRED EMBODIMENTS

A method of correcting deflection defocusing of the present invention, a cathode ray tube employing the method, and an image display system including the cathode ray tube, have the following advantages:

(1) A deflection defocusing amount in a cathode ray tube is, in general, rapidly increased with an increase in deflection amount. According to the present invention, deflection defocusing can be corrected by provision of a magnetic member in a deflection magnetic field for forming a locally modified non-uniform magnetic field having a variable focusing or diverging action on an electron beam when the electron beam is deflected and varied in its trajectory by a deflection magnetic field.

Figure 64:
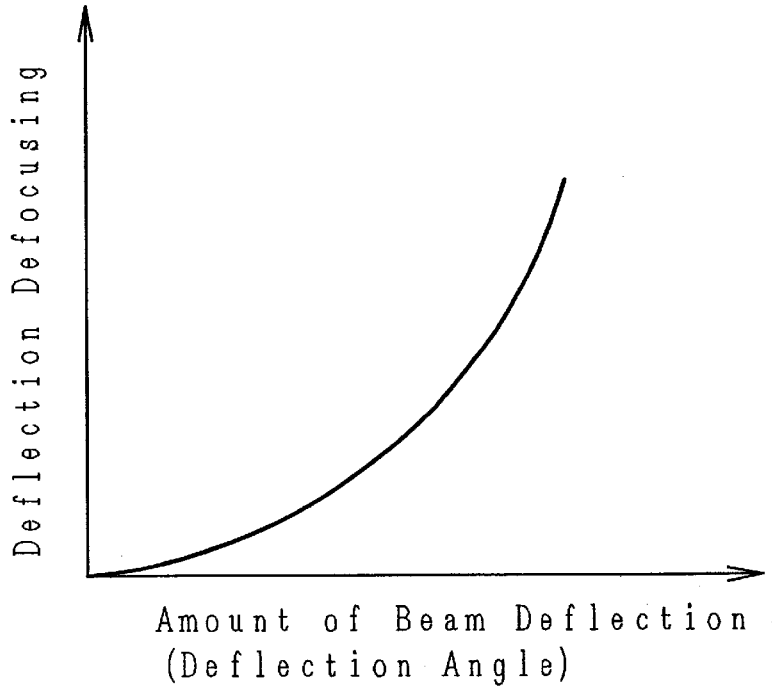
FIG. 64 is a graph illustrating a relationship between a deflection amount (deflection angle) and a deflection defocusing amount.
Figure 65:
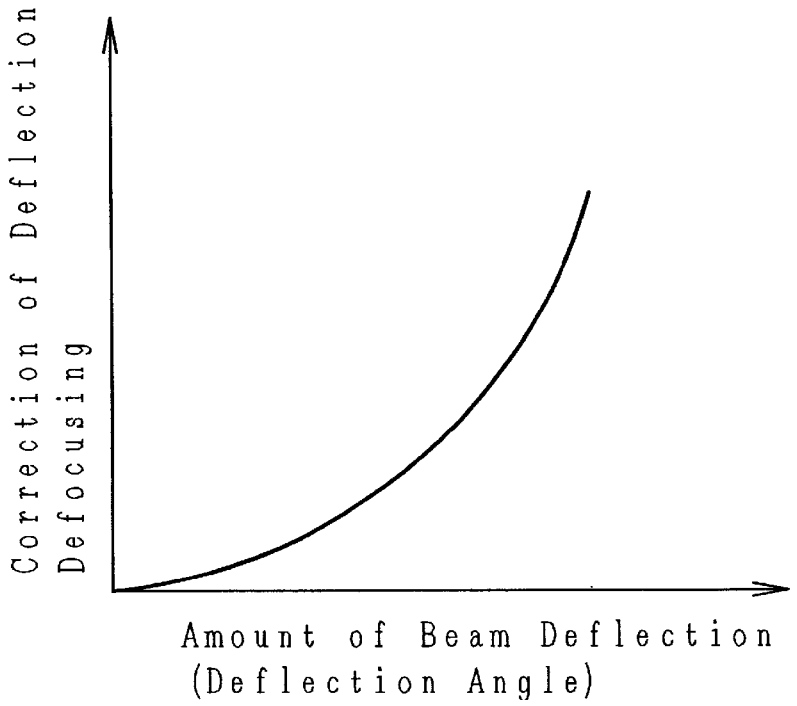
FIG. 65 is a graph illustrating a relationship between a deflection amount and the amount of deflection defocusing correction.

(2) FIG. 64 is a graph illustrating a relationship between a deflection amount (deflection angle) and a deflection defocusing amount; and FIG. 65 is a graph illustrating a relationship between a deflection amount and the amount of deflection defocusing correction.

As shown in FIG. 64, a deflection defocusing amount of an electron beam is increased as a deflection angle of the electron beam is increased. According to the present invention, a deflection defocusing rapidly increased in accordance with a deflection amount can be corrected by forming, in a deflection magnetic field, a locally modified non-uniform magnetic field capable of increasing a deflection defocusing correction amount in accordance with a deflection amount as shown in FIG. 65 when an electron beam is deflected and varied in its trajectory by the deflection magnetic field.

(3) As one effective example of the locally modified non-uniform magnetic field capable of properly increasing a focusing or diverging action on an electron beam in accordance with a deflection amount when the electron beam is deflected and varied in its trajectory by a deflection magnetic field, locally modified non-uniform magnetic fields symmetrically distributed or asymmetrically distributed in a deflection direction may be disposed on opposite sides of a path of an undeflected electron beam.

The amount of the focusing or diverging action on an electron beam is increased as the electron beam is separated remotely from the path of the undeflected electron beam.

It is to be noted that the wording "locally modified non-uniform magnetic field" in the present invention means that magnetic flux densities are not uniform.

The state of a deflected electron beam passing through each of the magnetic fields which are disposed on opposite sides of the path of the undeflected electron beam and which have a diverging action on the electron beam in synchronization with a deflection magnetic field, is compared with the state of the undeflected electron beam as follows: Namely, the electron beam passing through a portion remote from the path of the undeflected electron beam diverges as it travels in the locally modified non-uniform magnetic field, and the beam bundle is also separated remotely from the path of the undeflected electron beam.

The rate of change in trajectory is also larger on the side remote from the path of the undeflected electron beam. This is because the amount of correcting magnetic fluxes interlinked with the electron beam is increased at a position separated remotely from the path of the undeflected electron beam. The reason why the amount of the interlinked magnetic fluxes is increased is that an interval between lines of magnetic force becomes narrower (magnetic density is increased) and/or an area containing the interlinked magnetic field becomes wider.

In general, a distance from a main lens of an electron gun of a cathode ray tube to a phosphor screen is longer at a screen peripheral portion than at the screen center, so that when a deflection magnetic field has no focusing or diverging action on an electron beam, the optimum focus of an electron beam at the screen center causes overfocus of an electron beam at the peripheral portion of the screen.

According to the present invention, the overfocus of an electron beam at the peripheral portion of the screen can be reduced by forming, in a deflection magnetic field, a locally modified non-uniform magnetic field capable of increasing a diverging action in synchronization with an increase in deflection amount, thereby correcting the deflection defocusing in accordance with the deflection amount as shown in FIG. 65.

According to the present invention, when a deflection magnetic field has a focusing action on an electron beam, a locally modified non-uniform magnetic field capable of further increasing the strength of the diverging action is formed in the deflection magnetic field, so that the diverging action of the locally modified non-uniform magnetic field increased in synchronization with an increase in the deflection amount can overcome the increased focusing action of the deflection magnetic field, thereby correcting the deflection defocusing including overfocus of an electron beam at a peripheral portion of the screen due to the geometrical structure of a cathode ray tube.

Figure 66:
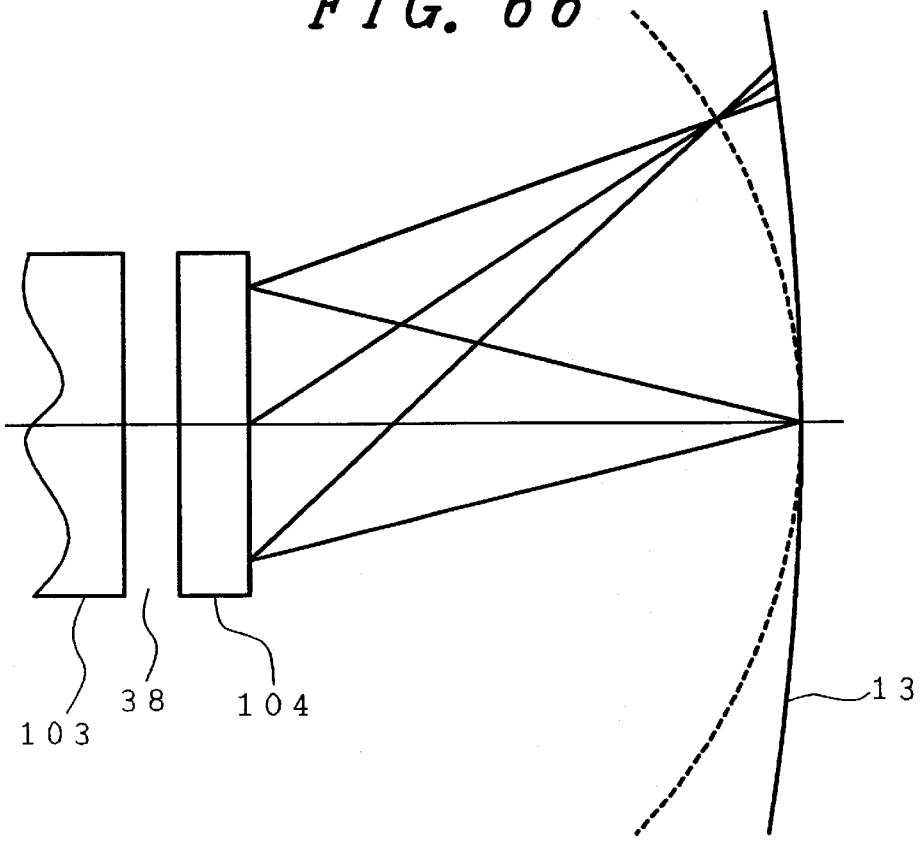
FIG. 66 is a view illustrating focusing electron beams onto a phosphor screen

(4) FIG. 66 is a view illustrating focusing of an electron beam on a phosphor screen. In this figure, reference numeral 103 indicates a focusing electrode; 104 is an anode; 13 is a phosphor film; and 38 is a main lens.

Figure 67:
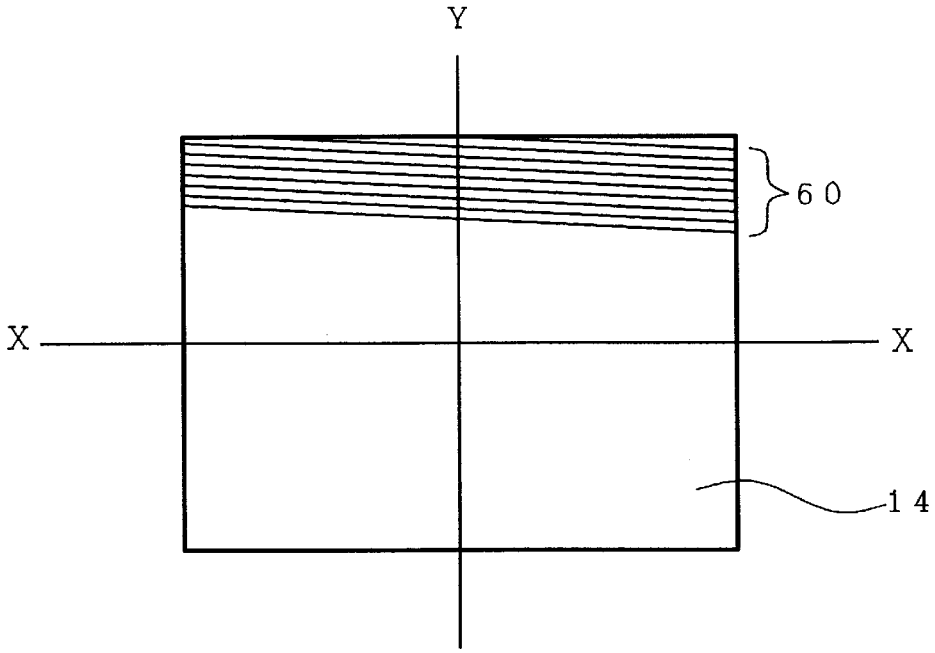
FIG. 67 is a view illustrating scanning lines formed on a panel portion forming a phosphor screen of a cathode ray tube.

FIG. 67 is a view illustrating scanning lines formed on a panel portion of a phosphor screen of a cathode ray tube. In this figure, reference numeral 14 indicates a panel portion; and 60 is a scanning locus.

In most cases, the deflection of a cathode ray tube is performed for allowing an electron beam to linearly scan as shown in FIG. 67. The linear scanning locus 60 is called the scanning line.

A deflection magnetic field often differs between in the scanning direction (X—X) and in the direction (Y—Y) perpendicular to the scanning direction. An electron beam also tends to receive a focusing action which differs between in the scanning direction and the direction perpendicular to the scanning direction by at least one of a plurality of electrodes forming an electron gun before largely receiving the action of a locally modified non-uniform magnetic field formed in the deflection magnetic field.

It is also dependent on the application use of a cathode ray tube whether deflection defocusing correction in the scanning direction is emphasized or deflection defocusing correction in the direction perpendicular to the scanning direction is emphasized. In addition, technical means concerning deflection defocusing correction depending on the scanning direction, content of the correction, and amount of the correction, are generally independent from each other and are different in necessary cost; however, the present invention can simultaneously cope with them only by one technical means.

(5) In the case of forming a locally modified non-uniform magnetic field having a focusing action synchronized with a deflection magnetic field at a position substantially centered about a path of an undeflected electron beam, an electron beam deflected and passing through a portion remote from the path of the undeflected electron beam is compared with the undeflected electron beam as follows: Namely, the electron beam passing through a portion remote from the path of the undeflected electron beam focuses in an amount larger than that of the undeflected electron beam as it travels in the locally modified non-uniform magnetic field, and the beam bundle is also separated remotely from the path of the undeflected electron beam.

The rate of change in trajectory of the electron beam is smaller on the side remote from the path of the undeflected electron beam. This is because the amount of magnetic fluxes interlinked with the electron beam is decreased at a position separated remotely from the path of the undeflected electron beam. The reason why the amount of the interlinked magnetic fluxes is decreased is that an interval between lines of magnetic force becomes wider (magnetic flux density is decreased) and/or an area containing the magnetic field becomes narrower.

When a deflection magnetic field has a diverging action on an electron beam, deflection defocusing can be corrected in accordance with a deflection amount as shown in FIG. 65 by forming, in the deflection magnetic field, a locally modified non-uniform magnetic field capable of increasing a focusing action in synchronization with an increase in the deflection amount thereby reducing overfocus of the electron beam at a peripheral portion of a phosphor screen.

In addition, technical means concerning deflection defocusing correction depending on the scanning direction, content of the correction, and amount of the correction, are generally independent from each other and are different in necessary cost; however, the present invention can simultaneously cope with them only by one technical means.

(6) In a color cathode ray tube of the type having three inline guns disposed in a horizontal plane, a vertical deflection magnetic field having a barrel-shaped magnetic force line distribution and a horizontal deflection magnetic field having a pincushion-shaped magnetic force line distribution are used (see FIG. 71, described later) for eliminating or simplifying a circuit for controlling convergence of three electron beams on a phosphor screen.

The deflection defocusing amount of each side beam of three inline electron beams given by a deflection magnetic field is dependent on the intensity of the deflection magnetic field and on the direction of the horizontal deflection. For example, the magnetic flux distribution of the deflection magnetic field, through which the right hand electron beam of the inline arrangement (in the direction of the cathode ray tube seen from the phosphor screen side) traverses, differs between the case where the right hand electron beam is deflected to the left half of the phosphor screen and the case where it is deflected to the right half. In other words, the deflection defocusing amount of the rightward electron beam differs between the above two cases, and thereby the image quality given by the right hand electron beam differs between the right and left ends of the phosphor screen.

To suppress the variation in the image quality at the right and left ends of the phosphor screen, the amount of a focusing or diverging action on each side electron beam is required to vary depending on whether the side electron beam is deflected rightward or leftward with respect to the center of the side electron gun.

The present invention can effectively solve the above inconvenience of each side electron beam of the inline arrangement by forming, in the deflection magnetic field, locally modified non-uniform magnetic fields having distributions different on the right and left sides with respect to the center of the electron gun.

In the case of forming locally modified non-uniform magnetic fields having diverging actions being different in strength and synchronized with a deflection magnetic field on opposite sides of a path of an undeflected electron beam, a deflected electron beam diverges in an amount larger than that of the undeflected electron beam as it travels in the locally modified non-uniform magnetic field, and the beam bundle is also separated remotely from the path of the undeflected electron beam.

The rate of change in trajectory of the electron beam is larger on the side remote from the path of the undeflected electron beam. This is because the amount of magnetic fluxes interlinked with the electron beam other is increased at a position separated remotely from the path of the undeflected electron beam. The reason why the amount of the interlinked magnetic fluxes is increased is that an interval between lines of magnetic force becomes narrower and/or an area having the magnetic field becomes wider. The rate of change in trajectory becomes larger as the degree of narrowing the interval in lines of magnetic force is increased and/or the degree of widening the area containing the magnetic field is increased.

On the magnetic field side where the degree of narrowing the interval in lines of magnetic force is decreased and/or the degree of widening the area containing the magnetic field is decreased at a position separated remotely from the path of the undeflected electron beam, a deflected electron beam diverges in an amount larger than that of the undeflected electron beam as it travels in the locally modified non-uniform magnetic field, and the beam bundle is also separated remotely from the path of the undeflected electron beam.

The rate of change in trajectory of the electron beam is larger on the side remote from the path of the undeflected electron beam; however, the rate of the change in trajectory is smaller than that in the area of where the rate of narrowing the interval in lines of magnetic force is increased and/or the rate of widening the area having the magnetic field is increased at a position separated remotely from the path of the undeflected electron beam. This is because the rate of increasing the amount of the interlinked magnetic fluxes is made smaller with increasing distance from the path of the undeflected electron beam. The reason why the rate of increasing the amount of the interlinked magnetic fluxes is small is that the rate of narrowing the interval between lines of magnetic force is small and/or the widening of the area having the magnetic field is small.

Accordingly, the deflection defocusing correction shown in FIG. 65 can be achieved by forming, in a deflection magnetic field, a magnetic field having a diverging action which increases in synchronization with an increase in a deflection amount in such a manner that the rate of increase thereof is dependent on the deflection direction.

When a deflection magnetic field has a diverging action on an electron beam gives a different deflection defocusing depending on the deflection direction of the electron beam, the deflection defocusing correction shown in FIG. 65 can be achieved by forming, in the magnetic field, a magnetic field with a distribution shown in FIGS. 4A to 4D, so that the focusing action of the magnetic field can increase in synchronization with an increase in a deflection amount in such a manner that the rate of increase thereof is dependent on the deflection direction.

(7) In order to improve uniformity of resolution over the entire phosphor screen by forming a locally modified non-uniform magnetic field in a deflection magnetic field, an electron beam is required to be deflected in such a manner as to traverse a magnetic field area having a necessary distribution in amount along the deflection direction. In other words, there is a suitable positional relationship between the locally modified non-uniform magnetic field and the deflection magnetic field.

At the same time, the effect of correcting deflection defocusing is dependent on the amount of the magnetic flux of the locally modified non-uniform magnetic field formed in the deflection magnetic field. The amount of the magnetic flux is dependent on a magnetic flux density and on an area having the magnetic field. The magnetic field is generated between at least two pole pieces. The magnetic flux density and the magnetic field area are determined by the combination of the structure and arrangement of the above pole pieces, and the magnetic flux density between the pole pieces, and further they are related to the practical diameter of an electron beam passing through the magnetic field and the practical magnitude of the magnetic flux density.

The above-described at least two pole pieces for forming a locally modified non-uniform magnetic field and correcting deflection defocusing in accordance with a deflection amount are referred to as "deflection defocusing correction pole pieces". The number of the pole pieces is not particularly limited, for example, may be three pieces or more, and part of other electrodes may be serves as the pole piece.

The amount of the magnetic flux necessary for deflection is dependent on a voltage on a phosphor screen, and these values can be consolidated into a single design parameter by dividing the magnetic flux amount by the square root of the voltage of the phosphor screen. The single design parameter makes clear the analysis of the trajectory of an electron beam in the non-uniform magnetic field, and is effective to improve the setting accuracy of the magnetic field and to achieve a suitable deflection defocusing correction.

The necessary magnetic flux is dependent on the area of the non-uniform magnetic field and the magnetic flux density thereof. The necessary magnetic density may be made smaller as the area providing the magnetic field area is made wider. The magnetic flux density of the locally modified non-uniform magnetic field is also dependent on the positional relationship between a pair of the pole pieces for forming the locally modified non-uniform magnetic field, on the magnetic flux density between the pole pieces, and on the structure of the pole pieces. The intensity of the magnetic field near an electron beam is increased as the adjacent pole pieces come to be closer to each other.

The intensity of the magnetic field can be increased by increasing the magnetic flux density between the adjacent pole pieces. The excessively increased intensity of the magnetic field, however, causes an inconvenience that an electron beam impinging a portion near the screen center of the cathode ray tube is also largely distorted by the locally modified non-uniform magnetic field, with a result that resolution near the screen center is reduced to the degree being not negligible. Accordingly, the magnetic density between the adjacent pole pieces has a limitation.

The narrowing of an interval between the above pole pieces is expected to generate a focusing or diverging action on an electron beam in synchronization with a slight change in trajectory of the electron beam; however, such an interval between the pole pieces is practically limited to 0.5 mm in consideration of the diameter of the electron beam. According to the present invention, in the case where the maximum deflection angle of the cathode ray tube is 100° or more, a desirable effect can be obtained when the above design parameter consolidating the magnetic flux density B and the voltage Eb on the phosphor screen satisfies the following equation:

$$B/\sqrt{Eb} \geqq 0.02\,\mathrm{mT}\cdot(\mathrm{kV})^{-1/2}$$

where B is in mT, and Eb is in kilovolts.

(8) The distribution of a deflection magnetic field of a cathode ray tube is related to the structure of a deflection device. When the maximum deflection angle is specified, the maximum of the magnetic flux density divided by the square root of the voltage of the phosphor screen is substantially determined. The position of the locally modified non-uniform magnetic field formed in the deflection magnetic field may be set in the axial deflection magnetic field at an area having a specified level or more of the maximum magnetic density.

The above method of setting the position of the locally modified non-uniform magnetic field significantly simplifies the measurement of the magnetic flux density as compared with the case of setting the position of the locally modified non-uniform magnetic field on the basis of the absolute value of the magnetic flux density. Namely, the measurement of the magnetic flux density in this method may be relatively compared with the maximum magnetic flux density, and thereby this method is advantageous from the practical viewpoint. In this case, the maximum magnetic flux density varies depending on the shape of a magnetic material; however, an error due to such a variation is negligible.

According to the present invention, when the maximum deflection angle of a cathode ray tube is 100° or more, the effect can be practically achieved by specifying the level of the above magnetic flux density to be 5% or more of the maximum magnetic flux density of a deflection magnetic field distribution at the end portions, on the phosphor screen side, of the pole pieces for forming a locally modified non-uniform magnetic field, in consideration of the pole pieces and the positional relationship between the pole pieces described in (7).

(9) Since the magnetic flux density is dependent on a relative permeability of the magnetic member (pole pieces), it is closely dependent on the position of a magnetic core of a coil for generating a deflection magnetic field. The area having a necessary magnetic flux density may be determined on the basis of a distance between pole pieces for forming a locally modified non-uniform magnetic field and the above core of the coil. This method, which is only based on the position of the core of the coil for generating a deflection magnetic field, can eliminate the measurement of a magnetic flux density, and thereby it is advantageous from the practical viewpoint.

In such a method, the magnetic flux density distribution varies depending on the shape of the core; however, an error due to such a variation is negligible.

According to the present invention, when the maximum deflection angle of a cathode ray tube is 100° or more, the effect can be practically achieved by specifying a distance between the end portion, on the side remote from a phosphor screen, of a core and end portions, on the phosphor screen side, of pole pieces for forming a locally modified non-uniform magnetic field to be 50 mm or less, in consideration of the pole pieces and the positional relationship between the pole pieces described in (7).

In the case where the end portions, on the phosphor screen side, of the pole pieces have axial indention (irregularities) of the cathode ray tube, the above distance is determined as a value between the end portion, on the side remote from the phosphor screen, of the core and the longest end portions, on the phosphor screen side, of the pole pieces.

(10) Similarly, according to the present invention, in the case where the maximum deflection angle of the cathode ray tube is 100° or less, a desirable effect can be obtained when the above design parameter consolidating the magnetic flux density B and the voltage Eb of the phosphor screen satisfies the following equation:

$$B/\sqrt{Eb} \geqq 0.004\text{mT}\cdot(\text{kV})^{-1/2}$$

where B is in mT, and Eb is in kilovolts.

In this case, the effect can be practically achieved by specifying the level of the above magnetic flux density corresponding to that described in (8) to be 10% or more. Moreover, the effect can be practically achieved by specifying the distance corresponding to that described in (9) to be 35 mm or less.

(11) The intensity of the above non-uniformity magnetic field in a cathode ray tube cannot be freely increased from the practical viewpoint, for example, in consideration of the entire configuration of the cathode ray tube, and the structure, easy of fabrication and easy of use of an electron gun used for the cathode ray tube.

In the present invention, to achieve the effect even for a magnetic field having a relatively low intensity in terms of easy of use, an electron beam is required to have a suitable diameter in such a region. In general, an electron beam has a large diameter at a portion near a main lens in a cathode ray tube. Accordingly, the position of the deflection defocusing correction pole pieces for forming a locally modified non-uniform magnetic field is related to a distance from a main lens.

On the other had, when the pole pieces are disposed at a position extremely shifted from the main lens portion toward the cathode side, the astigmatism is easy to be canceled by a focusing action of the main lens, and further there often occurs an inconvenience in that part of electron beams impinge on part of electrodes of an electron gun.

According to the present invention, the effect can be achieved by specifying a distance between end portions, on the phosphor screen side, of pole pieces for forming a locally modified non-uniform magnetic field and an end portion, facing a main lens, of an anode of an electron gun to be five times or less of an aperture diameter (in the direction perpendicular to the scanning direction) of the end portion of the anode or 180 mm or less; and a distance between the end portions, on the cathode side, of the pole pieces and the end portion of the anode to be three times or less the above aperture diameter of the anode or 108 mm or less, in consideration of conditions that the maximum deflection angle of the cathode ray tube is less than 85°, the single electron beam is used, and a magnetic field is used for focusing an electron beam.

(12) The present invention requires a magnetic flux density of a deflection magnetic field in an amount suitable to achieve the effect of the locally modified non-uniform magnetic field. The deflection defocusing correction pole pieces may be made of a soft magnetic material, and preferably, part of the pole pieces may be made of a magnetic material having a high magnetic permeability for enhancing the magnetic flux density and improving the effect of the deflection defocusing correction.

(13) The deflection defocusing correction pole pieces of the present invention are required to be positioned near a path of an electron beam. For example, the pole pieces are disposed at opposite sides of a path of an electron beam. As described in (3), locally modified non-uniform magnetic fields synchronized with a deflection magnetic field and symmetrically distributed or asymmetrically distributed in the deflection direction, are disposed on opposite sides of a path of an undeflected electron beam.

The above two kinds of locally modified non-uniform magnetic fields can be formed by provision of the above pole pieces having a specified structure. In general, an electrode part of an electron gun of a cathode ray tube is manufactured by press-form of a metal plate.

In recent years, the requirement for the accuracy of the above electrode port in a cathode ray tube has been increased with the significantly improved focus characteristics of a cathode ray tube. The deflection defocusing correction pole pieces are also required to be improved in accuracy. The machining accuracy of the pole pieces can be improved at a low cost in mass-production by manufacturing them by press-form of a metal plate.

The deflection in a cathode ray tube is often performed in such a manner as to form scanning lines as described above. In most cases, a phosphor screen of the cathode ray tube of the line scanning type deflection is formed in an approximately rectangular shape, and the scanning is generally performed substantially in parallel to the sides of the rectangular screen. An evacuated envelope of the cathode ray tube for supporting the phosphor screen is also formed in an approximately rectangular shape corresponding to the phosphor screen in terms of easy of assembly to an image display system.

The above two kinds of the locally modified non-uniform magnetic field of the present invention are thus desirable to be formed in association with the scanning line and the shape of the phosphor screen. The locally modified non-uniform magnetic fields can be formed in the scanning direction and in the direction perpendicular to the scanning direction in accordance with the application use of the cathode ray tube.

(14) The interval between the pole pieces of the present invention is closely related to the intensity of the magnetic field produced by the pole pieces and the trajectory of an electron beam passing through the interval. An extremely large interval between the pole pieces fails to obtain a desirable effect.

The depth of an image display system including a cathode ray tube cannot be freely shortened because it is restrictive to the axial length of the cathode ray tube.

One means for shortening the axial length of a cathode ray tube is to increase the maximum deflection angle of the cathode ray tube. The practical maximum deflection angle at present is 114° for a single-beam cathode ray tube, and a value near 114° for a cathode ray tube of the three inline electron beam type.

The maximum deflection angle tends to be further increased in the future. The increased maximum deflection angle significantly increases the maximum magnetic flux density of a deflection magnetic field. The maximum deflection angle is practically related to a diameter of a neck portion.

The desirable outside diameter of a neck portion is about 40 mm at maximum in order to save an electric power for generating a deflection magnetic field and to save a material of a mechanism portion for producing the deflection magnetic field.

In general, the maximum diameter of electrodes of an electron gun is smaller than the inside diameter of a neck portion of a cathode ray tube, and the neck portion requires a wall thickness of several mm for ensuring both a mechanical strength and an insulating performance and for preventing leakage of X-rays.

According to the present invention, the narrowest distance of the interval between the above deflection defocusing correction pole pieces in the scanning direction or in the direction perpendicular to the scanning direction is desirable to be 1.5 times or less of an aperture diameter of a portion, facing a focus electrode, of an anode of an electron gun in the direction perpendicular to the scanning direction or to be usually in a range of from 0.5 to 30 mm, in consideration of the limitations concerning the electrodes and magnetic field described in (7). Such a distance has an advantage in cost and it can sufficiently ensure the operating characteristic.

(15) The locally modified non-uniform magnetic fields of the present invention can be formed by provision of pole pieces on opposite sides of a path of an electron beam.

Figure 68A:
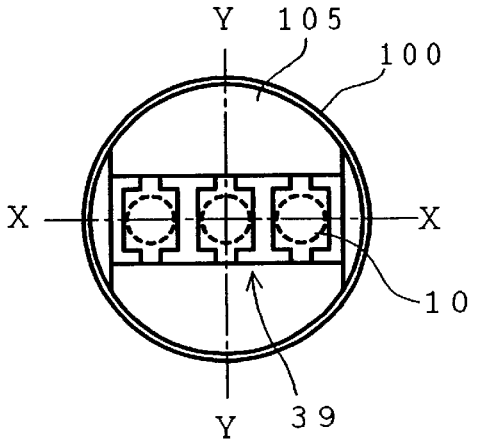
FIGS. 68A to 68C are a front view, a sectional view and an exploded perspective view of a configuration example of deflection defocusing correction pole pieces, respectively.
Figure 68B:
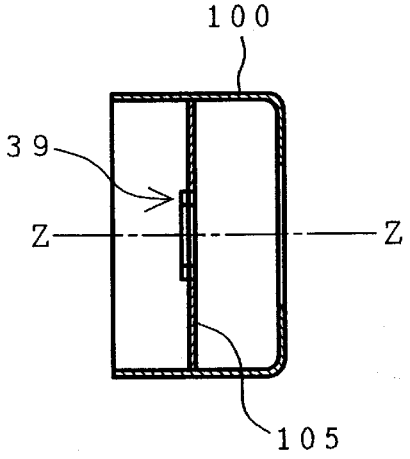
Figure 68C:
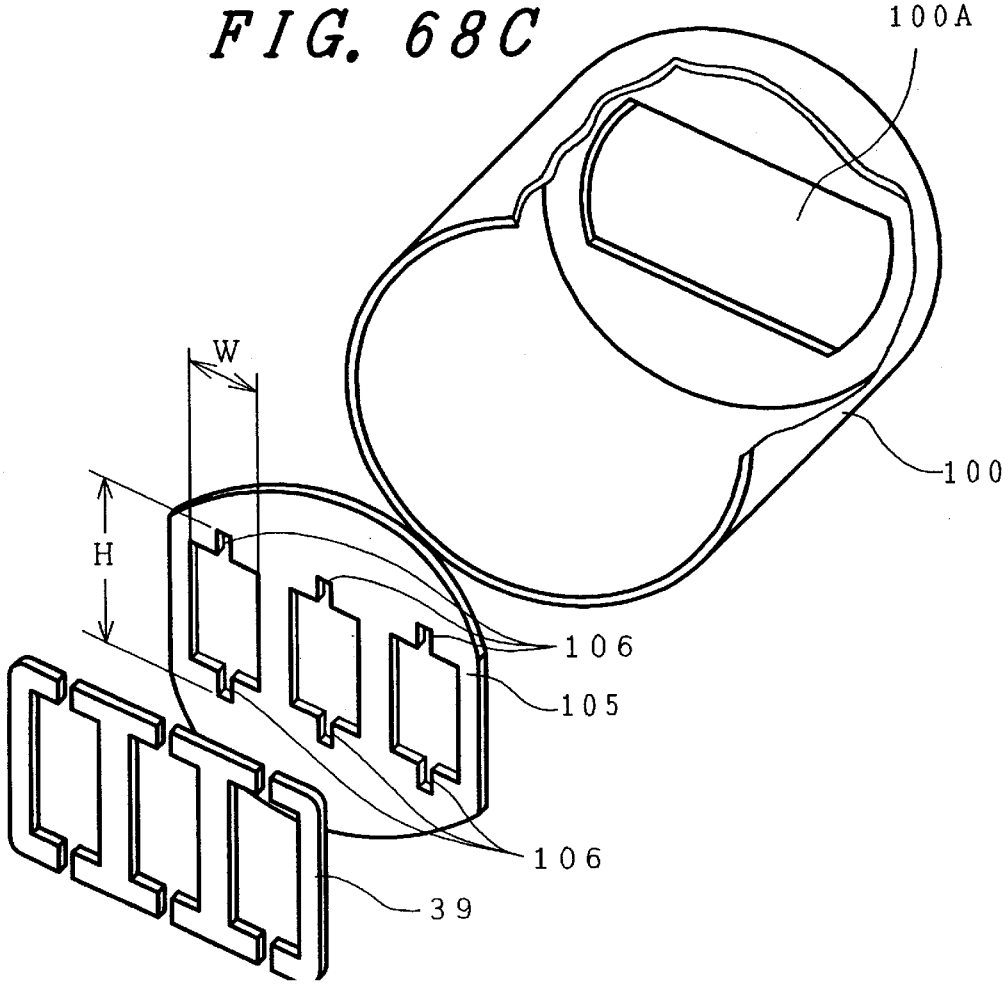

FIGS. 68A to 68C are views illustrating one configuration example of deflection defocusing correction pole pieces, wherein FIG. 68A is a front view of the pole pieces; FIG. 68B is a side view of a shield cup and the pole pieces; and 68C is an exploded view in perspective of the shield cup and the pole pieces attached thereto. In these figures, reference numeral 100 indicates a shield cup; 39 is pole pieces; 105 is a pole piece support; and 10 is an electron beam.

Figure 12:
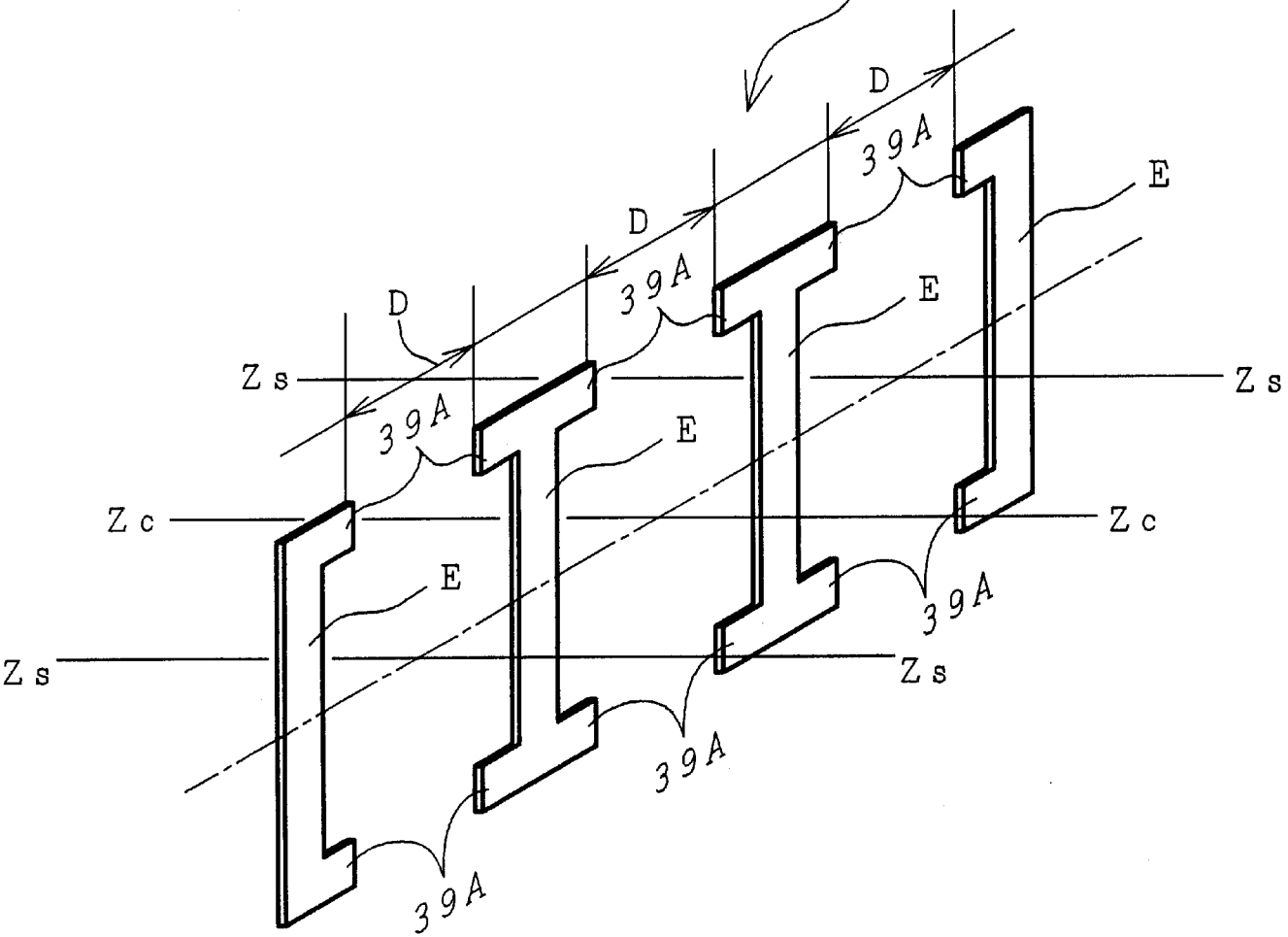
FIG. 12 is a perspective view showing the configuration example of deflection defocusing pole pieces of the present invention for forming in a deflection magnetic field a locally modified non-uniform magnetic field synchronized with the deflection magnetic field.

FIG. 12 (described later) shows the relationship between pole pieces for forming a locally modified non-uniform magnetic field and a path of an undeflected electron beam.

When magnetic poles 39 for forming locally modified non-uniform magnetic fields, for example, shown in FIGS. 68A to 68C are disposed on opposite sides of each of paths Zc—Zc and Zs—Zs of undeflected electron beams as shown in FIG. 12, the pole pieces 39 having a high magnetic permeability function as magnetic paths for lines of magnetic force near the pole pieces 39 and generate, between opposed portions thereof, locally modified non-uniform magnetic fields varying in synchronization with a variation in the deflection magnetic field.

These pole pieces 39 form deflection defocusing correction magnetic pole pieces. The opposed portion of the pole piece is formed in such a shape as to obtain the optimum deflection defocusing correction in accordance with the application use of the cathode ray tube or the combination of the characteristics of the other electrodes of the electron gun. For example, a non-parallel portion or a cutout is partially formed in the opposed portion of the pole piece.

In particular, when a large kinds of cathode ray tubes are produced on a small scale, it is disadvantageous in terms of cost that an expensive press dies is manufactured for each design specification of the cathode ray tube. While being slightly poor in accuracy, the pole piece can be easily manufactured by cutting or etching a thin plate material without shaping by a press-die. This makes it possible to eliminates an expensive press-die, and hence to manufacture pole pieces at low costs even in the case where a large kinds of pole pieces are produced on a small scale.

According to the present invention, the optimum range of a distance between opposed portions of the pole pieces is substantially similar to the interval between pole pieces described in (14). It is to be noted that the above distance between opposed portions does not include zero. In addition, the opposed direction of the pole pieces may be set in the scanning direction or in the direction perpendicular to the scanning direction for a cathode ray tube of the line scanning type.

(16) In the case where the deflection defocusing correction pole pieces for forming a locally modified non-uniform magnetic field synchronized with a deflection magnetic field are provided in such a manner as to increase a beam-diverging action in accordance with an increase in a deflection amount, the magnetic field between the opposed portions of the pole pieces must have a magnetic flux density higher than that of the neighborhood deflection magnetic field having a focusing action.

According to the present invention, the intensity of the magnetic field between the opposed portions of the pole pieces can be made higher than that of the neighborhood deflection magnetic field by specifying the shapes of the pole pieces. It is possible to omit electrodes disposed between opposing portions of two pole pieces facing each other.

The locally modified non-uniform magnetic field having a high intensity varying in synchronization with a variation in the deflection magnetic field can be formed between the opposed portions of the pole pieces by provision, in the deflection magnetic field having a sufficient magnetic flux density, of the pole pieces having both a suitably selected structure and a distance between the opposed portions, thereby forming a suitable magnetic path between the opposed portions.

As one means for forming a locally modified non-uniform magnetic field synchronized with a deflection magnetic field, magnetic members formed of a ferromagnetic material having a soft magnetization characteristic are disposed inside and/or outside the cathode ray tube.

The locally modified non-uniform magnetic field synchronized with a deflection magnetic field can be preferably adjusted from the outside of the cathode ray tube for improving the accuracy of the deflection defocusing correction.

(17) When deflection defocusing is corrected by forming in a deflection magnetic field a locally modified non-uniform magnetic field synchronized with a deflection magnetic field, it is desirable that the locally modified non-uniform magnetic field can exhibit the effect even in a relatively low magnetic field from the practical viewpoint as described in (11), and thereby an electron beam is required to have a suitable diameter in such a region.

In general, the diameter of an electron beam is large near a main lens in a cathode ray tube. The position of the deflection defocusing correction pole pieces is related to a distance from the main lens; however, the distance from the main lens is not made constant because the structure of the pole pieces varies depending on a deflection magnetic field, the structure of an electron gun, the suitability to a wide electron beam current region, and the suitability to a specified electron beam current region.

In a cathode ray tube, particularly, in a color cathode ray tube of the in-line plural beam type or a color display tube, a deflection magnetic field for an electron beam is made inhomogeneous for simplifying convergence adjustment. In such a case, a main lens is desirable to be separated from a deflection magnetic field generating portion as much as possible for suppressing distortion of an electron beam due to the deflection magnetic field, and consequently, the deflection magnetic field generating portion is usually disposed at a position on the phosphor screen side from the main lens of an electron gun.

(18) According to the present invention, when deflection defocusing is corrected by forming in a deflection magnetic field a locally modified non-uniform magnetic field synchronized with the deflection magnetic field, the deflection magnetic field generating portion and the main lens can be positioned to be close to each other by forming the locally modified non-uniform magnetic field while previously estimating a distortion of an electron beam due to the above inhomogeneous deflection magnetic field.

According to the present invention, when the maximum deflection angle of a cathode ray tube is 100° or more, the optimum distance between an end portion, on the side remote from a phosphor screen, of a magnetic material forming a core of a coil for forming the above deflection magnetic field and an end portion, facing a focus electrode, of an anode of an electron gun is 60 mm or less.

(19) On the other hand, the length between a cathode and a main lens of an electron gun is desirable to be made longer for reducing an image magnification of the electron gun thereby making smaller a beam spot diameter on a phosphor screen.

A cathode ray tube having an excellent resolution in consideration of the above two functions thus tends to be increased in its axial length.

According to the present invention, however, the image magnification of the electron gun can be further reduced to further decrease the electron beam spot diameter on the phosphor screen and at the same time the axial length can be shortened by moving the position of the main focus electrode toward the phosphor screen without a change in the length between the cathode and the main lens of the electron gun.

(20) The length of time the electron beam experiences mutual space-charge repulsion of electrons can be shortened by moving the main lens toward the phosphor screen, so that a beam spot diameter on the phosphor screen can be further reduced.

(21) According to the present invention, the specifications similar to those described in (18) to (20) can be carried out with a higher accuracy. Namely, the optimum distance between the deflection magnetic field and the main lens in the case where the maximum deflection magnetic field is 100° or more has a portion in which the end portion, facing the main lens, of the anode of the electron gun is within the magnetic field having a magnetic flux being 10% or more of the maximum magnetic flux density of the magnetic field for deflection of the electron beam in the scanning line direction and/or in the direction perpendicular to the scanning direction.

(22) According to the present invention, the specifications similar to those described in (18) to (21) can be carried out with a higher accuracy. Namely, the optimum distance between the deflection magnetic field and the main lens in the case where the maximum deflection magnetic field is 100° or more includes a region in which a voltage Eb on the phosphor screen of the cathode ray tube, a magnetic flux density B of a magnetic field for deflecting an electron beam in the scanning direction or in the direction perpendicular to the scanning direction in the deflection magnetic field at an end portion, facing the main lens, of an anode of an electron gun, and an anode voltage Eb satisfy the following equation:

$$B/\sqrt{Eb} \geqq 0.004\,\mathrm{mT}\cdot(\mathrm{kV})^{-1/2}$$

where B is in mT and Eb is in kilovolts.

(23) According to the present invention, the specifications similar to those described in (18) to (22) can be further carried out. Namely, the optimum distance between the deflection magnetic field and the main lens of the electron gun in the case where the maximum deflection angle is in a range of 85 to 100° is set in such a manner that the distance equivalent to that described in (18) to (20) is 40 mm or less; the percent of the maximum magnetic flux density equivalent to that described in (21) is 15% or more; and a value of $$B/\sqrt{Eb}$$

equivalent to that described in (22) is 0.003 $\mathrm{mT}\cdot(\mathrm{kV})^{-1/2}$ or more.

(24) According to the present invention, the specifications similar to those described in (18) to (22) can be further carried out. Namely, the optimum distance between the deflection magnetic field and the main lens of the electron gun in the case where the maximum deflection angle is in a range of less than 85° is set in such a manner that the distance equivalent to that described in (18) to (20) is 170 mm or less; the percent of the maximum magnetic flux density equivalent to that described in (21) is 5% or more; and a value of $$B/\sqrt{Eb}$$

equivalent to that described in (22) is 0.005 mT·(kV)$^{-1/2}$ or more.

(25) As seen from (18) to (24), the optimum distance between the deflection magnetic field and the main lens of the electron gun can be shortened, unlike the prior art.

According to the present invention, the optimum positions of the neck portion of the cathode ray and the main lens of the electron gun are set in such a manner that the position of an end portion, facing the main lens, of the anode of the electron gun is within 15 mm or less on the side remote from the phosphor screen with respect to the end portion, on the phosphor screen side, of the neck portion.

The main lens of the electron gun in the related art is located at a position separated remotely from the deflection magnetic field, and accordingly a voltage is supplied to the anode of the electron gun from the inner wall of the neck portion of the cathode ray tube.

On the contrary, according to the present invention, the main lens of the electron gun is not required to be separated from the deflection magnetic field and can be moved toward the phosphor screen, and thereby a voltage can be supplied to the anode of the electron gun from a portion other than the inner wall of the neck portion of the cathode ray tube.

Since a high electric field is formed in a narrow space in a cathode ray tube, it becomes important to stabilize a breakdown voltage characteristic for improving reliability. The maximum intensity of the electric field is generated near a main lens of an electron gun. The electric field near the main lens is dependent on a graphite film coated on the inner wall of a neck portion of the cathode ray tube for supplying a voltage to an anode of an electron gun, and on foreign matters remaining in the cathode ray tube and sticking to the inner wall of the neck portion.

According to the present invention, the main lens of the electron gun can be disposed to be closer to the phosphor screen side, so that it is possible to significantly stabilize the breakdown voltage characteristic.

(26) An electron beam is not affected by a deflection magnetic field when it forms a beam spot at the center of a phosphor screen. Accordingly, in this case, a measure for preventing distortion of the electron beam due to the deflection magnetic field is not required and thereby the lens of the electron gun comes to be of an axially symmetrical focusing system, with a result that the diameter of an electron beam spot on the phosphor screen can be made smaller.

(27) According to the present invention, in addition to a locally modified non-uniform magnetic field synchronized with a deflection magnetic field which is formed in the deflection magnetic field for correcting deflection defocusing, a dynamic voltage synchronized with the deflection can be applied to part of electrodes of an electron gun for further increasing a suitable focusing action on an electron beam over the entire screen, thereby obtaining a desirable resolution over the entire screen. The necessary dynamic voltage can be reduced.

(28) According to the present invention, in addition to a locally modified non-uniform magnetic field synchronized with a deflection magnetic field which is formed in the deflection magnetic field for correcting deflection defocusing, at least one of electric fields of a plurality of electrostatic lenses formed of a plurality of electrodes of an electron gun can be made a non-axially symmetrical electric field. This allows an electron beam spot at the screen center in a large-current region to be formed in an approximately circular or rectangular shape. The non-axially symmetrical electric field also forms an electrostatic lens having a focus characteristic having a suitable focus voltage focusing in the beam scanning direction higher than a suitable focus voltage focusing in the direction perpendicular to the scanning direction, and an electrostatic lens having a focus characteristic capable of optimizing the diameter of an electron beam at the screen center in a small-current region in the direction perpendicular to the scanning direction to the pitch of a shadow mask and the density of scanning lines in the direction perpendicular to the scanning direction as compared with the diameter of an electron beam spot in the scanning direction and having a suitable focus voltage focusing in the scanning direction higher than a suitable focus voltage focusing in the direction perpendicular to the scanning direction. These lenses due to the non-axially symmetrical electric field give to an electron beam a desirable focus characteristic without any moire over the entire screen and over the entire current region.

(29) It is to be noted that the wording "non-axially symmetry" in the present invention means a plane other than a plane curve equidistance from a given fixed point. For example, a "non-axially symmetric" beam spot means a non-circular beam spot.

(30) As described in (25), since a locally modified non-uniform magnetic field synchronized with a deflection magnetic field is formed in the deflection magnetic field in the present invention, a main lens of an electron gun can be disposed to be closer to the deflection magnetic field as compared with the related art.

Since the deflection magnetic field also penetrates the main lens of the electron gun, electrodes on the side near the phosphor screen from the main lens are essential to have a structure capable of preventing the strike of an electron beam. According to one embodiment shown in FIG. 68C, in the in-line three-beam electron gun having a plurality of electrodes, a single hole 100A having no partition member and allowing three electron beams to pass therethrough is provided in a shield cup 100.

In the case where deflection defocusing correction pole pieces are disposed on the phosphor screen side from an electron beam aperture formed in the bottom surface of the shield cup, it is desirable that a space is provided at a portion corresponding to the interval between the opposed portions of the pole pieces for reducing a probability in strike of an electron beam to an electrode mounting the pole pieces even when the trajectory of the deflected electron beam enters the locally modified non-uniform magnetic field, thereby promoting the effect of the locally modified non-uniform magnetic field synchronized with the deflection magnetic field and improving uniformity of resolution on the phosphor screen. For example, as shown in FIG. 13B and FIG. 68C, slots are provided in a pole piece support 105 which mounts the pole pieces thereon and has apertures having a larger diameter in a direction perpendicular to a scanning line of the electron beam than a diameter thereof in a direction of the scanning line for satisfying a relationship of H>W.

Reference numeral 100A designates electron beam holes provided in a shield cup 100.

(31) According to the present invention, deflection defocusing of each of three electron beams in a three in-line beam electron gun is corrected by forming in a deflection magnetic field a locally modified non-uniform magnetic field synchronized with the deflection magnetic field. In this case, pole pieces for forming the locally modified non-uniform magnetic fields can be so constructed that the structure of the pole piece for the center electron beam is different from that of the pole piece for each side electron beam. This makes it possible to adjust the balance of resolutions of the three electron beams on the phosphor screen.

The above pole piece for each side electron beam can be also so constructed that the structure on the center electron beam side in the inline direction is different from that on the opposite side. This makes it possible to reduce coma error due to the deflection magnetic field.

Although the effects of the individual techniques of the present invention have been described, the present invention can further improve, by the combination of two or more of the techniques, uniformity of resolution over the entire phosphor screen of a cathode ray tube and resolution at the screen center over the entire current region, and can shorten the axial length of the cathode ray tube.

The present invention can also provide an image display system capable of improving uniformity of resolution over the entire phosphor screen and resolution at the screen center over the entire current region, and of shortening the depth, by the use of the above cathode ray tube.

Next, the mechanism by means of which the focus characteristics and the resolution of a cathode ray tube using an electron gun of the present invention are improved will be described.

Figure 69:
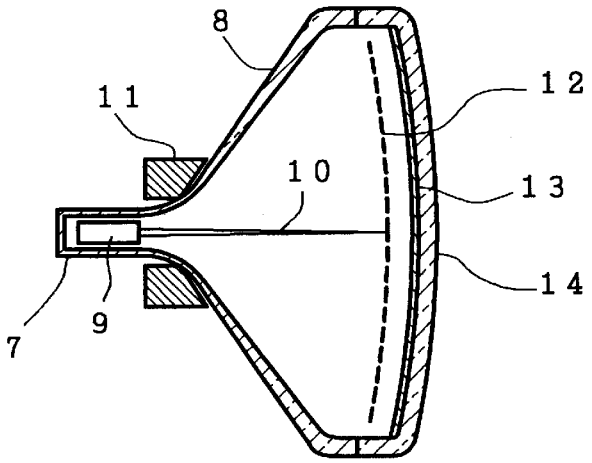
FIG. 69 is a schematic sectional view of a color cathode ray tube of the inline electron gun and shadow mask type.

FIG. 69 is a schematic sectional view of a color cathode ray tube of the in-line electron gun and shadow mask type. In this figure, reference numeral 7 indicates a neck; 8 is a funnel; 9 is an electron gun contained in the neck 7; 10 is an electron beam; 11 is a deflection yoke; 12 is a shadow mask; 13 is a phosphor film forming a phosphor screen; and 14 is a panel (screen).

Referring to FIG. 69, the electron beam 10 emitted from the electron gun 9 is deflected in the horizontal and vertical directions by the deflection yoke 11, passing through the shadow mask 12, and excites the phosphor film 13 to emit light. A pattern formed by the light-emitting phosphor film is observed as an image from the panel 14 side.

Figure 70:
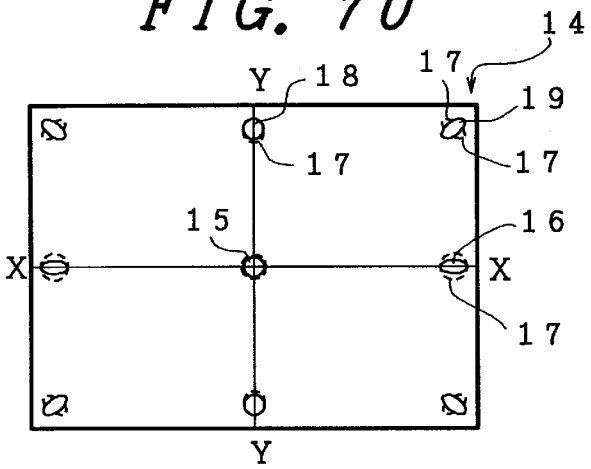
FIG. 70 is a view illustrating an electron beam spot in the case where peripheral phosphors are excited by an electron beam focused to a circular spot at the screen center.

FIG. 70 is a diagram illustrating an electron beam spot in the case where peripheral phosphors are excited by an electron beam adjusted for a circular spot at the screen center. Reference numeral 14 indicates a screen; 15 is a beam spot at the screen center; 16 is a beam spot at each edge of the screen on the horizontal center line (X—X); 17 is a halo; 18 is a beam spot at each of the top and bottom of the screen on the vertical center line (Y—Y); and 19 is a beam spot at each end of diagonal lines of the screen (corner).

Figure 71:
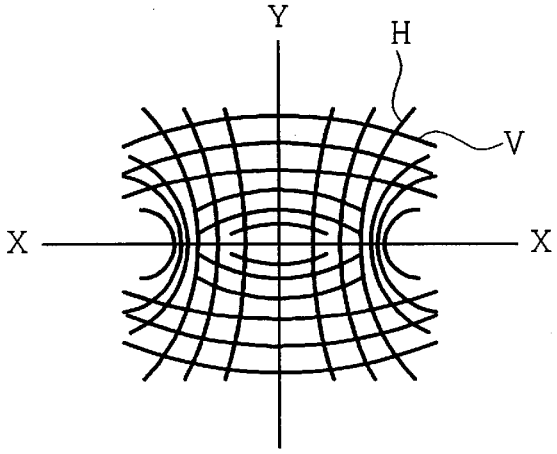
FIG. 71 is a view illustrating a deflection magnetic field distribution of a cathode ray tube.

FIG. 71 is a diagram illustrating a deflection magnetic field distribution of a cathode ray tube. In this figure, reference character H indicates a horizontal deflection magnetic field distribution, and V is a vertical deflection magnetic field distribution.

A recent color cathode ray tube uses a horizontal magnetic field H of a pincushion type inhomogeneous magnetic field distribution and a vertical magnetic field V of a barrel type non-homogeneous magnetic field distribution for simplifying convergence adjustment (see FIG. 71).

A light-emitting spot by the electron beam 10 is formed in a non-circular shape on a peripheral portion of the screen because of the above inhomogeneous magnetic field distribution, a difference in the path length of the electron beam 10 from a main lens to the phosphor screen between the center and the peripheral portion of the phosphor screen, and oblique impinging of the electron beam 10 to the phosphor film 13 at the peripheral portion of the screen.

As shown in FIG. 70, while the beam spot 15 at the screen center is circular, the beam spot 16 at each edge of the screen on the horizontal center line is horizontally elongated and a halo 17 is also generated thereat. As a result, the size of the beam spot 16 at the edge of the screen on the horizontal center line becomes larger, and further the contour of the spot 16 becomes unclear due to the generation of the halo 17. This degrades the resolution, to result in the significantly reduced image quality.

In the case where the current of the electron beam 10 is small, the diameter of the electron beam 10 in the vertical direction is excessively reduced, and thereby the electron beam 10 interferes with the vertical aperture pitch of the shadow mask 12. This generates moire phenomenon and reduces the image quality.

The beam spot 18 at each of the top and bottom of the screen on the vertical center line is vertically compressed by vertical focusing of the electron beam 10 by the vertical deflection magnetic field and a halo 17 is also generated thereat, thus degrading the image quality.

The beam spot 19 at each of the corners of the screen is formed in a combined shape of the elongation just as in the spot 16 and the vertically compression just as in the spot 18, and further the rotation of the electron beam 10 is rotated thereat. Thus, at the corner of the screen, a halo 17 is generated and the diameter of the light-emitting spot is increased, thus significantly degrading the image quality.

Figure 72:
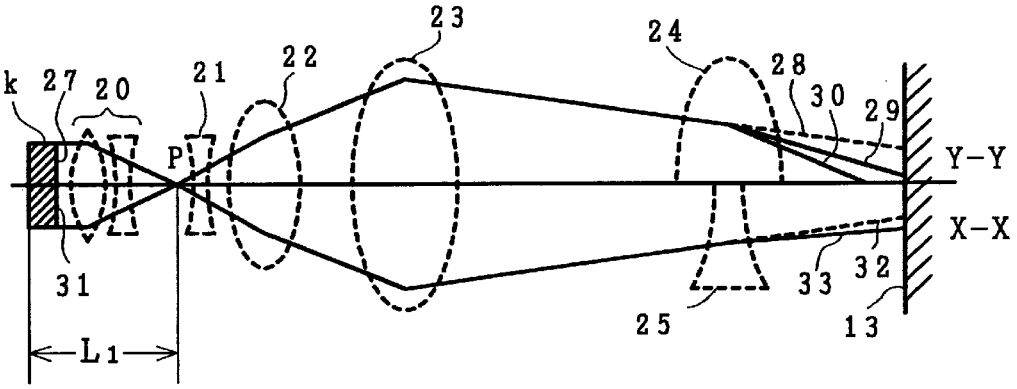
FIG. 72 is a schematic view of electron optics of an electron gun illustrating distortion of the shape of an electron beam spot.

FIG. 72 is a schematic view of electron optics of an electron gun, illustrating the distortion of the shape of the beam spot shown in FIG. 70. The above system is replaced with a light optics for a clear understanding.

In FIG. 72, the upper half shows the cross-section of the screen in the vertical direction (Y—Y), and the lower half shows the cross-section of the screen in the horizontal direction (X—X).

Figure 80:
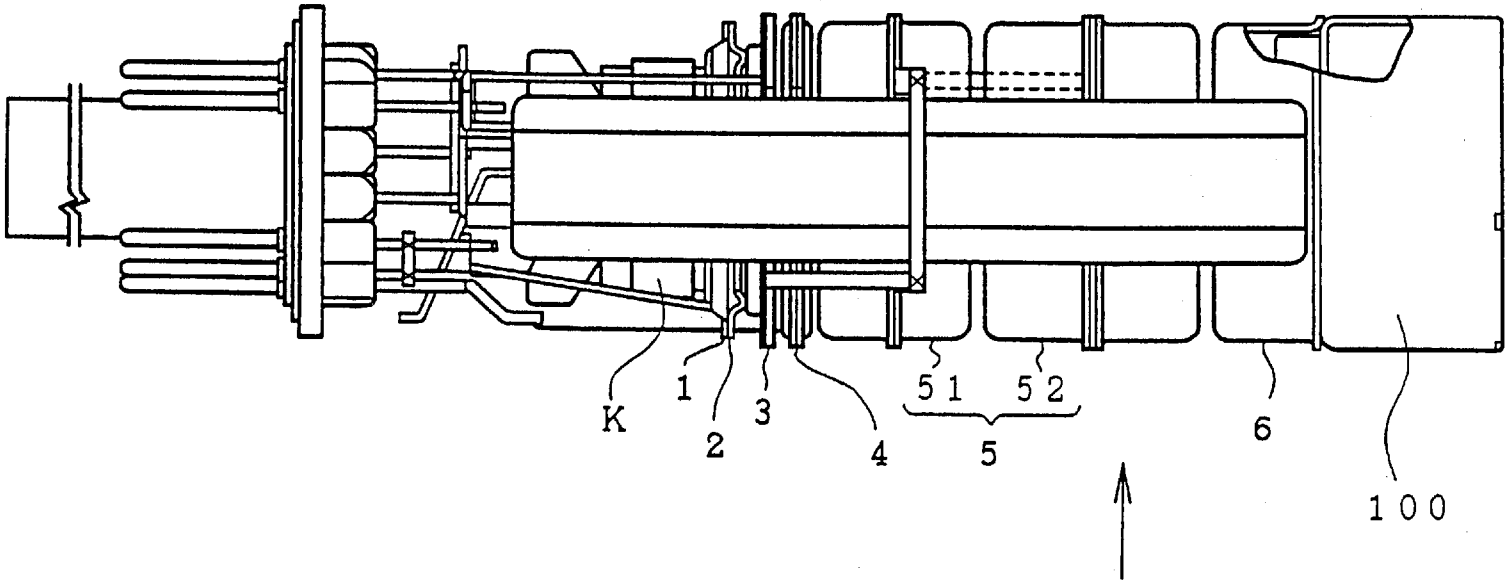
FIG. 80 (PRIOR ART)
FIG. 80 is a side view of the entire configuration of one example of an electron gun used for a cathode ray tube.
Figure 81:
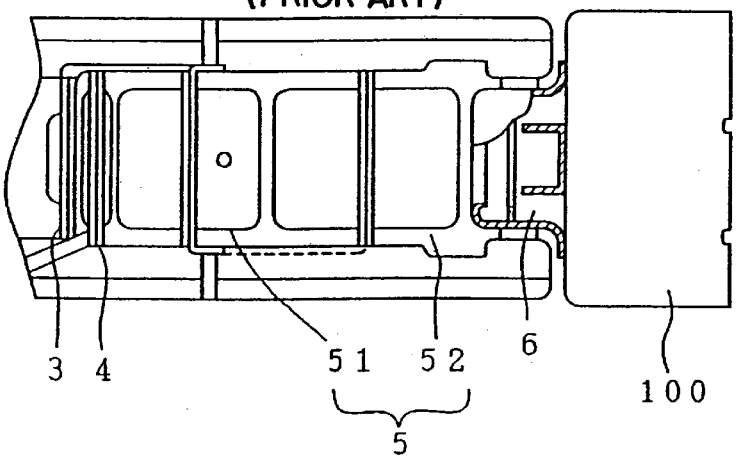
FIG. 81 (PRIOR ART)
FIG. 81 is a partial sectional view of an essential portion of the electron gun shown in FIG. 80, seen in the direction of the arrow.
Figure 82A:
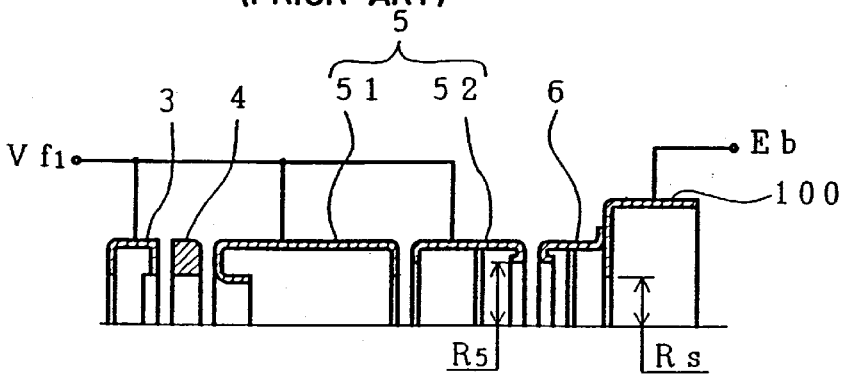
FIG. 82A (PRIOR ART)
Figure 82B:
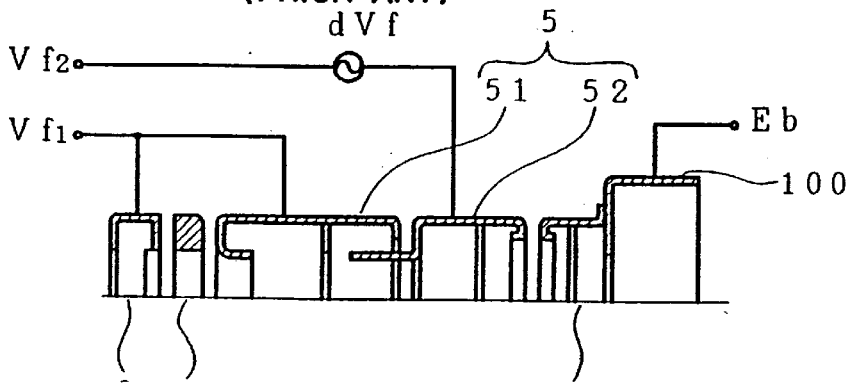
FIG. 82B (PRIOR ART)
Figure 83A:
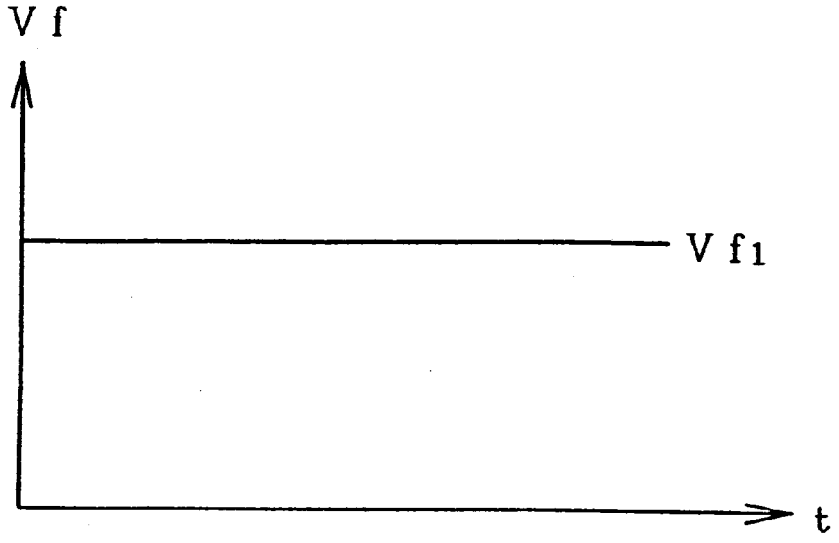
FIG. 83A (PRIOR ART)
FIG. 83A and 83B are graphs illustrating focus-voltages supplied to the electron guns shown in FIGS. 82A and 82B, respectively.
Figure 83B:
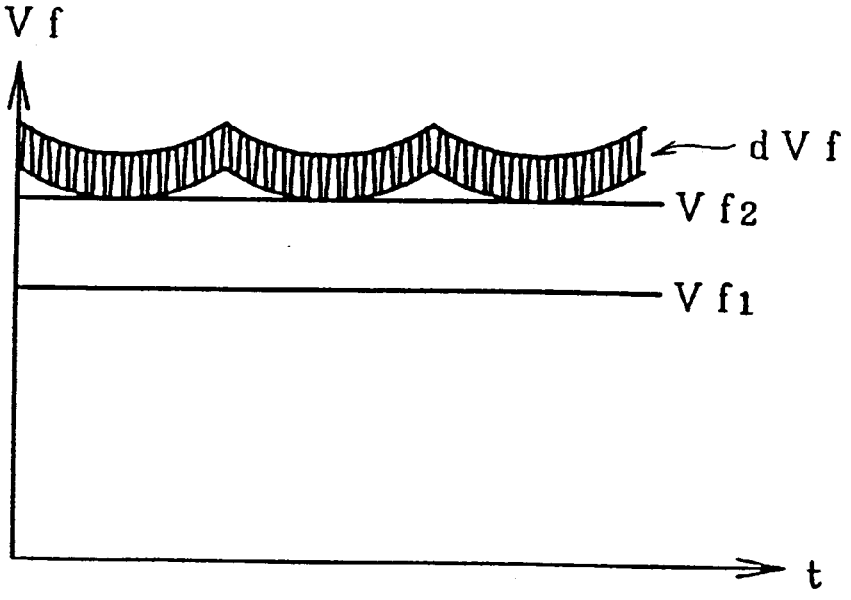
FIG. 83B (PRIOR ART)
Figure 84A:
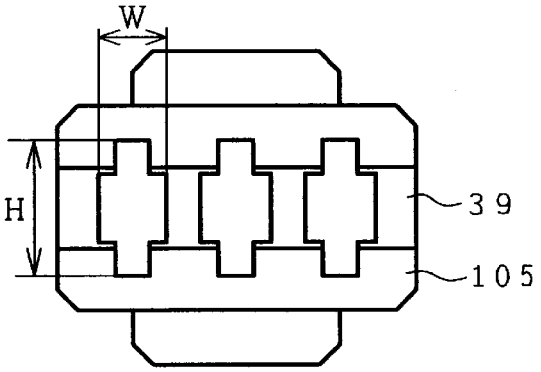
Figure 84B:
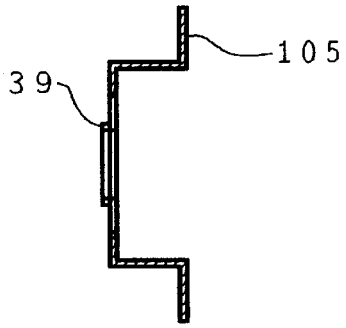
Figure 85A:
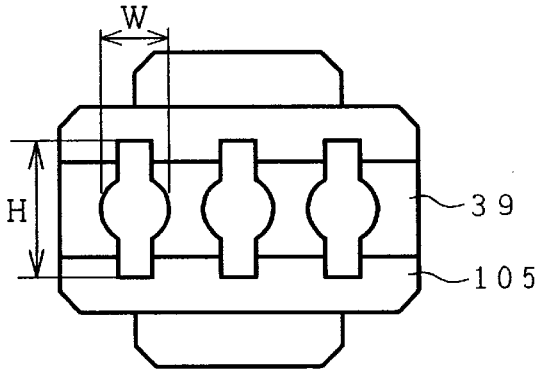
Figure 85B:
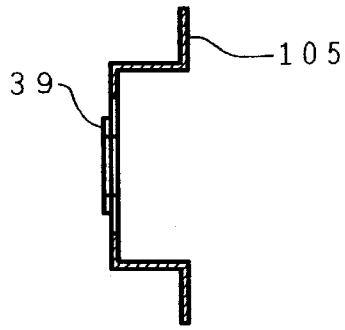
Figure 86A:
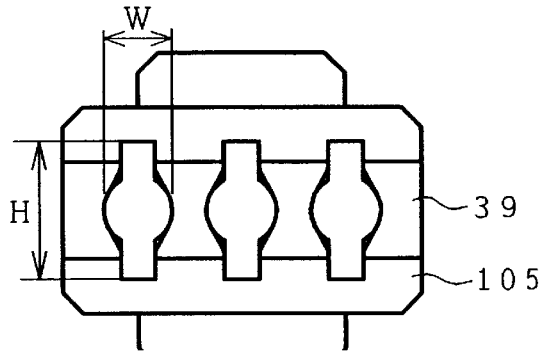
Figure 86B:
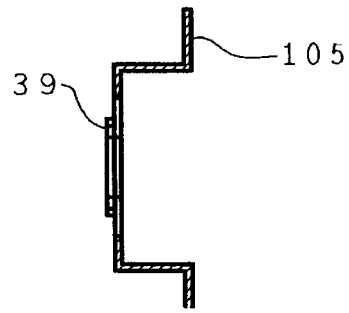
Figure 87A:
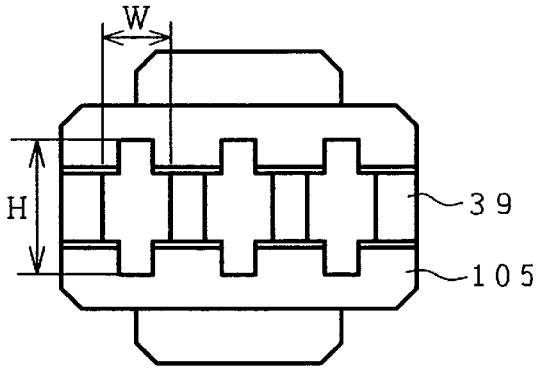
Figure 87B:
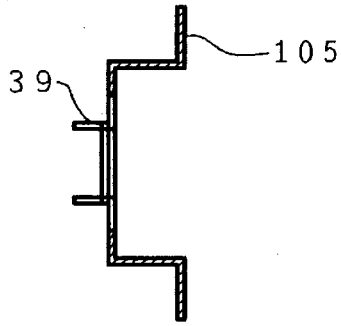
Figure 88A:
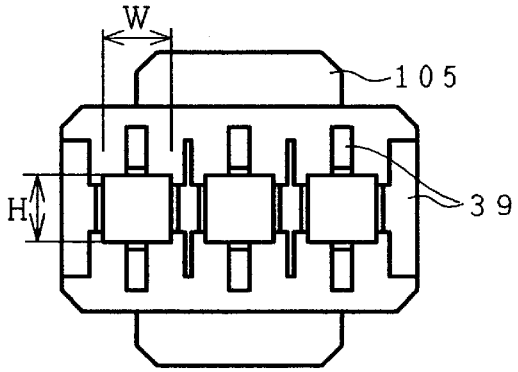
Figure 88B:
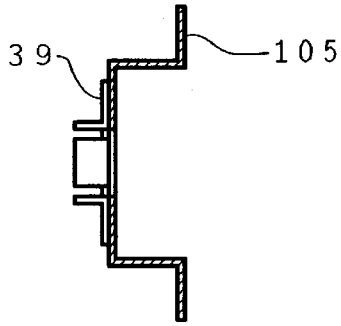
Figure 89A:
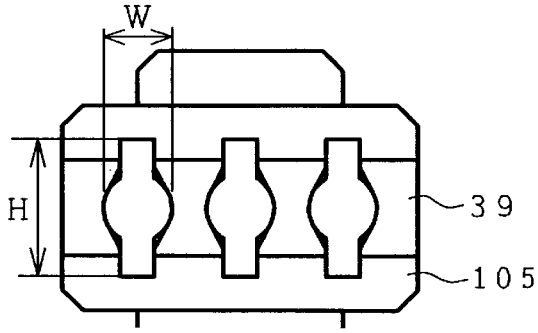
Figure 89B:
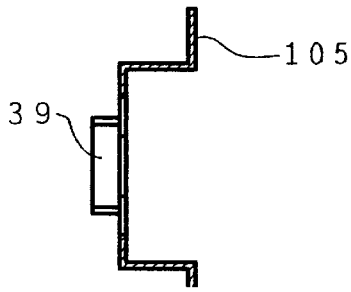

Reference numeral 20, 21 indicates a prefocus lens; 22 is a pre-main lens; and 23 is a main lens. These lenses constitute electron-optics of the electron gun shown in FIG. 80. Reference numeral 24 indicates a lens produced by the vertical deflection magnetic field; 25 is a lens produced by the horizontal deflection magnetic field, which is expressed as an equivalent lens to the apparent elongation of the spot of the electron beam 10 in the horizontal direction by oblique impinging to the phosphor film 13 by deflection.

First, an electron beam 27 emitted from a cathode K in the vertical plane forms a cross-over P at a position separated from the cathode K by a distance L1 between the prefocus lenses 20 and 21, and is focused onto the phosphor film 13 by the pre-main lens 22 and the main lens 23.

When the deflection is zero, that is, at the center of the screen, the electron beam 27 impinges on the phosphor film 13 through the trajectory 28; however, it forms a vertically compressed beam spot on the peripheral portion of the screen by way of the trajectory 29 by the effect of the lens 24 generated by the vertical deflection magnetic field. Moreover, another electron beam 27 focuses before reaching the phosphor film 13 as shown by the trajectory 30 because of spherical aberration of the main lens 23. This is a reason why the halo 17 is generated at the beam spot 18 at each edge of the screen on the vertical center line or at the beam spot 19 at the corner of the screen shown in FIG. 70.

On the other hand, an electron beam 31 emitted from the cathode K in the horizontal plane focuses by the prefocus lenses 20, 21, the pre-main lens 22 and the main lens 23, like the electron beam 27 in the vertical plane, and when the deflection magnetic field is zero, that is, at the center of the screen, the electron beam 31 impinges on the phosphor film 13 by way of a trajectory 32.

When the electron beam 10 is deflected, the electron beam 31 forms a horizontally elongated spot by way of a trajectory 33 by a diverging action of the lens 25 due to the horizontal deflection magnetic field; however, the halo 17 is not generated in the horizontal direction.

However, since a distance between the main lens 23 and the phosphor film 13 becomes larger than the case of the screen center, another electron beam focuses before reaching the phosphor film 13 in the vertical plane even at the edge 16 of the screen on the horizontal center line not deflected in the vertical direction shown in FIG. 70, and thereby the halo 17 is generated.

In this way, when the electron beam spot is formed in a circular shape at the screen center using an axially-symmetric lens system of the electron gun, the spot shape at the peripheral portion of the screen is distorted. This significantly degrades the image quality.

Figure 73:
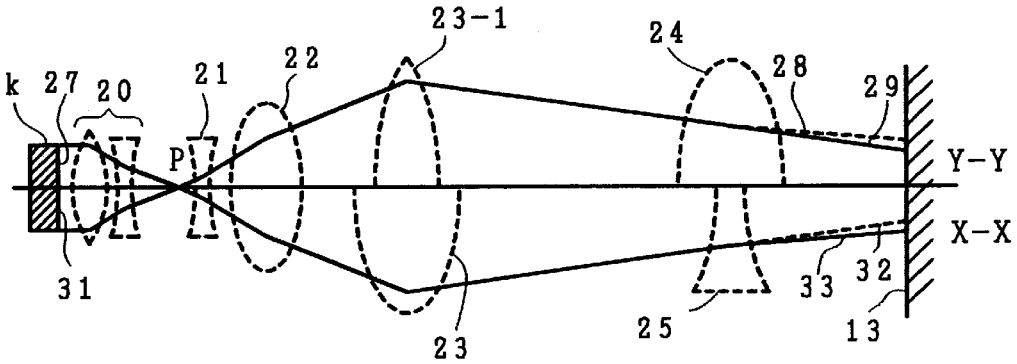
FIG. 73 is a view illustrating a means for suppressing the lowering of an image at a peripheral portion of the screen shown in FIG. 72.

FIG. 73 is a view illustrating a means for suppressing the degradation of an image quality at the peripheral portion of the screen as described with reference to FIG. 72. In this figure, parts corresponding to those shown in FIG. 72 are indicated by the same characters.

As shown in FIG. 73, a focusing action of a main lens 23-1 within the cross-section of the screen in the vertical direction (Y—Y) is made weaker than that of a main lens 23 in the cross-section of the screen in the horizontal direction (X—X). With this arrangement, the electron beam travels a path 29 after passing through a lens 24 produced by the vertical deflection magnetic field and does not form an extremely vertically compressed shape shown in FIG. 70. A halo 17 is also difficult to be produced. The path 28 at the screen center, however, is shifted in the direction where the beam spot diameter is increased.

Figure 74:
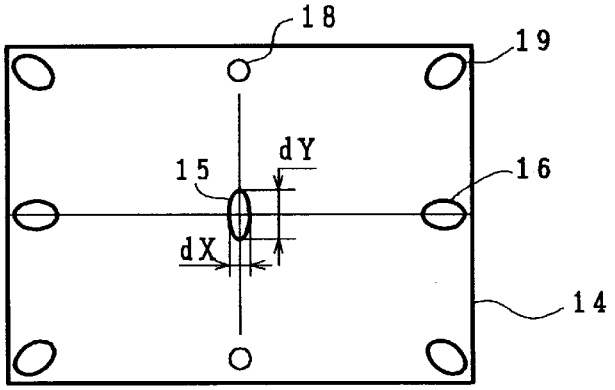
FIG. 74 is a schematic view illustrating the shape of an electron beam spot on a phosphor screen in the case of using a lens system shown in FIG. 73.

FIG. 74 is a schematic view illustrating the shape of an electron beam spot on a phosphor screen 14 in the case of using a lens system shown in FIG. 73. Beam spots on the peripheral portions of the screen, that is, a beam spot 16 at the edge on the horizontal center line, a beam spot 18 at the edge on the vertical center line, and a beam spot 19 at the corner, are suppressed in generation of a halo 17, so that the resolution at each peripheral portion is improved.

However, in the beam spot 15 at the screen center, a vertical spot diameter dY is larger than the horizontal spot diameter dX, to degrade the vertical resolution.

Accordingly, the formation of a non-axially-symmetrical electric field system in which a vertical focusing action and a horizontal focusing action of the main lens 23 are different from each other fails to simultaneously improve the resolutions over the entire screen.

Figure 75:
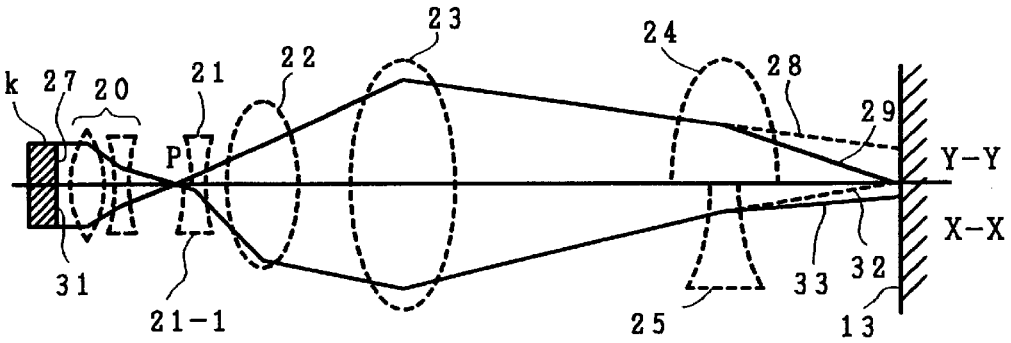
FIG. 75 is a schematic view of electron optics of an electron gun in which the lens strength of a prefocus lens is increased in the horizontal (X—X) direction in place of using the non-axially-symmetrical main lens.

FIG. 75 is a schematic view of electron optics of an electron gun in which the lens strength of a prefocus lens 21 in the horizontal direction is increased in place of using the non-axially-symmetrical main lens 23. The strength of a horizontally focusing prefocus lens 21-1 for diverging the image at a cross-over P is made larger than that of a vertically focusing prefocus lens 21, to increase an angle of incidence of an electron beam 31 to a pre-main lens 22. This makes it possible to increase the diameter of the electron beam passing through the main lens 23, and hence to reduce the diameter of the electron beam spot on the phosphor film 13 in the horizontal direction.

Figure 52:
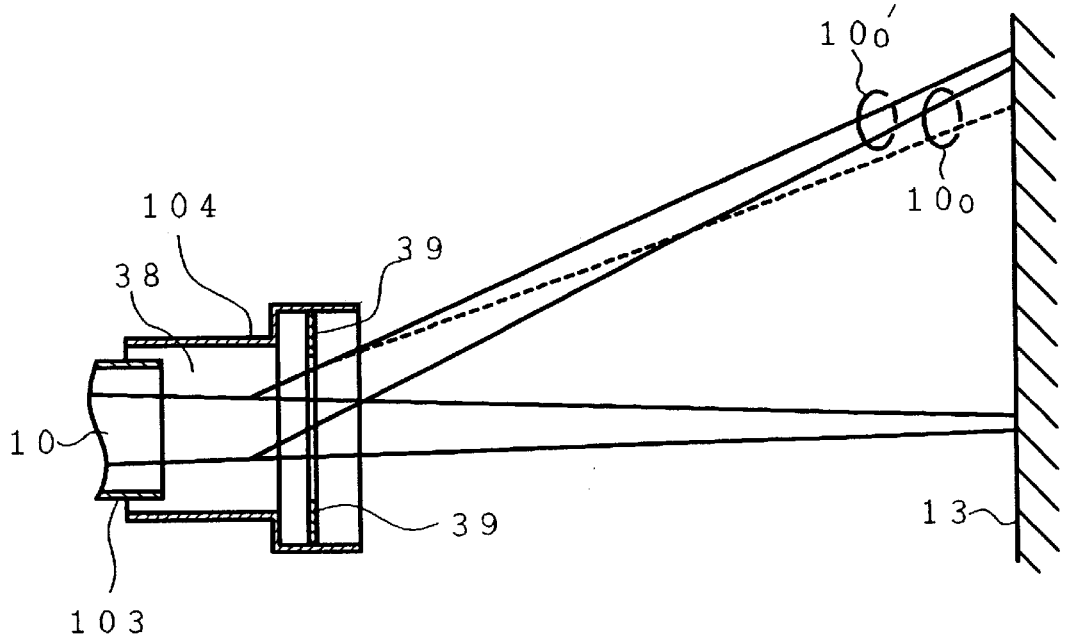
FIG. 52 is a view illustrating an electron gun essential portion and trajectories of electron beams in the case where the diameter of an anode electrode is larger than that of a focus electrode among the electrodes forming the main lens shown in FIGS. 49A to 49C and FIGS. 50A to 50C.

However, the path of the electron beam in the vertical direction of the screen is the same as shown in FIG. 52, and accordingly the generation of a halo 28 cannot be suppressed.

Figure 76:
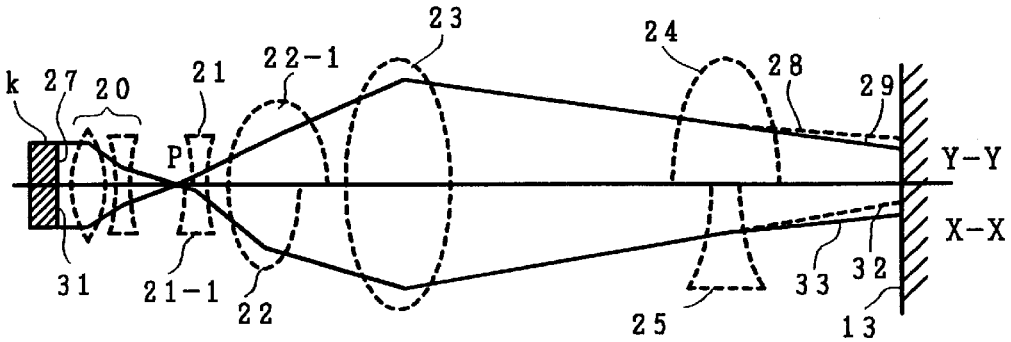
FIG. 76 is a schematic view of electron optics of an electron gun in which the configuration shown in FIG. 75 is added with a halo suppressing effect.

FIG. 76 is a schematic view of electron-optics of an electron gun in which the configuration of FIG. 75 is added with a halo suppressing effect. The lens strength of the pre-main lens 22-1 in the vertical direction is increased, so that the vertical electron beam path of the main lens 23 comes near the optical axis, to form a focusing system having a greater depth of focus. With this configuration, the halo 28 is made small, to improve the resolution.

Figure 77:
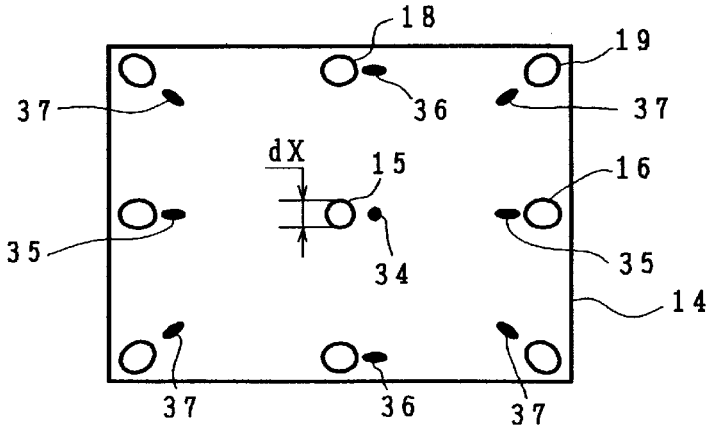
FIG. 77 is a schematic view illustrating the shape of an electron beam spot on a phosphor screen in the case of using the lens system shown in FIG. 76.

FIG. 77 is a schematic view illustrating the shape of an electron beam spot on a screen 14 in the case of using a lens shown in FIG. 76. As seen from this figure, a desirable resolution without any halo over the entire screen is obtained as shown by the beam spots 15, 16, 18 and 19.

The above description concerns the shape of an electron beam spot in the case where the current amount of the electron beam is relatively large (in a large-current region). However, in the case where the current amount of the electron beam is small (in the small-current region), the electron beam passes through only a paraxial portion of an imaging system, so that only a small difference lies in lens strength between the horizontal and vertical direction of the lenses 21, 22, and 23 having large diameters. Thus, as shown in FIG. 77, the beam spot becomes circular (34) at the screen center; horizontally elongated (35, 36) or obliquely elongated (37) at the peripheral portions of the screen, to cause moire. This increases the lateral diameter (horizontal diameter) of the beam spot, thus reducing the resolution.

To cope with such an inconvenience, the diameter of the lens is made small, and the lens is positioned such that the degree of asymmetry in the lens strength exerts an effect to a paraxial portion of the imaging system.

Figure 78:
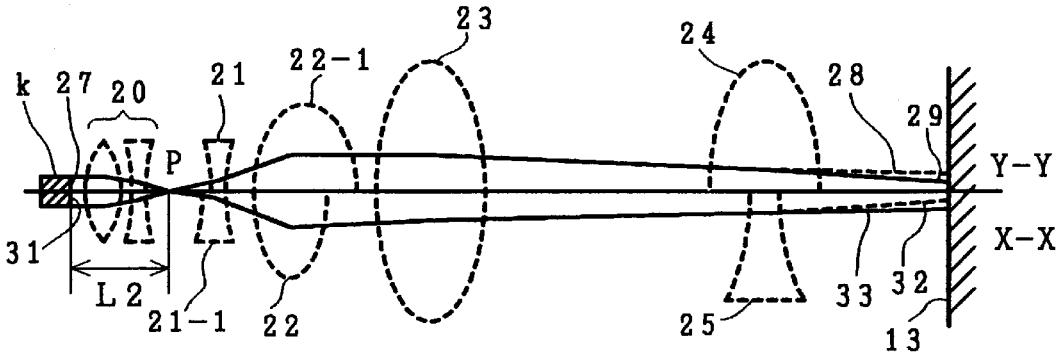
FIG. 78 is a schematic view of electron optics of an electron gun illustrating the trajectory of an electron beam in a small-current region.

FIG. 78 is a schematic view of an optical system of an electron gun illustrating the path of a small-current electron beam. In this case, a distance L2 between a cathode K and a cross-over P is smaller than the distance L1 shown in FIG. 72.

Figure 79:
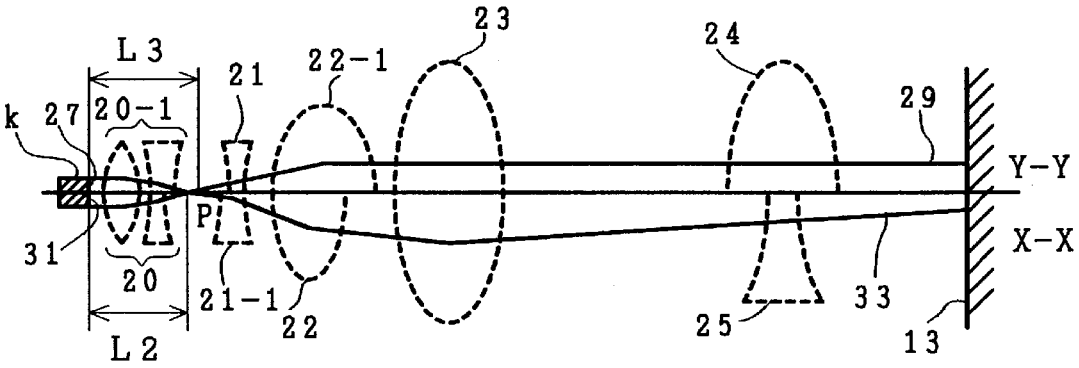
FIG. 79 is a schematic view of electron optics of an electron gun in the case where the lens strength of a divergent lens side in a prefocus lens is increased in the vertical (X-Y) direction of the screen.

FIG. 79 is a schematic view of an optical system of an electron gun in which the vertical (Y—Y) lens strength of a divergent lens portion in a prefocus lens is increased. A distance L3 between the cathode K and the cross-over P is made longer than the distance L2 by increasing the vertical lens strength of the divergent lens of a prefocus lens 20.

Accordingly, the position where an electron beam 27 enters the prefocus lens 21 in the vertical cross-section is closer to the axis than the case shown in FIG. 78, so that the lens actions of the lenses 21, 22-1 and 23 are made smaller, to form an imaging system having a greater depth of focus in the vertical direction of the screen.

However, the effect of each lens in a large current is not perfectly independent from that in a small current, and the lens effect of the prefocus lens 20-1 in the vertical direction exerts an effect on the spot shape of a large current electron beam. Consequently, the optical system is required to take a balance by making use of the characteristic of each lens. In particular, since the structure of the main lens is not constant and the emphasized point of the image differs depending on the application use of the cathode ray tube, the position of the non-axially symmetrical lens and the lens strength of each lens are not freely determined.

As described above, in the usual application use of the cathode ray tube, each lens for forming a non-axially symmetrical electric field at a position which differs between the large-current region and the small-current region must be disposed for improving the resolution over the entire screen. The obtainable non-axial symmetry of each lens is also limited because of limited changes in the intensity of the electric field. In some lens portions, when the intensity of the non-axially symmetrical electric field, the beam shape is extremely distorted, resulting in the reduced resolution.

Although the general means for suppressing the lowering of focus characteristics due to distortion of the electron beam spot diameter has been described, the actual electron gun has the above-described two types for suppressing the lowering of focus characteristics. One is a type in which a focus voltage is used in the fixed state; and the other is a type in which the optimum focus voltage at each position on the screen of the cathode ray tube is dynamically varied in accordance with a deflection angle of the electron beam.

The above two types have advantages and disadvantages. The type in which the focus voltage is used in the fixed state has an inexpensive structure of the electron gun and also has a simple and inexpensive power supply circuit for supplying a focus voltage; however, it is disadvantageous in that the optimum focus state for astigmatism correction cannot be obtained at each position on the screen of the cathode ray tube, with a result that the diameter of the beam spot is made larger than that in the optimum focus state.

On the other hand, the type in which the optimum focus voltage is dynamically supplied for an electron beam deflected to each position on the screen of the cathode ray tube in accordance with the deflection angle of the electron beam is advantageous in that a desirable focus characteristic can be obtained at each point on the screen; however, it is disadvantageous in that the structures of the electron gun and the power supply circuit for supplying a focus voltage are complicated and thereby it takes a lot of time to set a focus voltage in an assembling process of a TV receiver set and a terminal display system, resulting in the increased cost.

A dynamic focus voltage needs to be adjusted to be phased to electron beam deflection.

Especially, for use in multimedia expected to be widely spread soon, a display system needs to be capable of being driven at a plurality of deflection frequencies. This requires dynamic focus voltage generators for respective deflection frequencies and phasing a dynamic focus voltage to electron beam deflection at respective frequencies, and increases the cost of electrical circuits and set-up procedures.

The present invention provides a cathode ray tube using an electron gun which has respective advantages of the above two types while eliminating the disadvantages thereof, and further has a new third advantage capable of shortening the axial length.

Hereinafter, the embodiments of the present invention will be described in detail with reference to the accompanying drawings.

As a deflection amount is increased in a cathode ray tube, a deflection defocusing amount is rapidly increased as described with reference to FIG. 64.

The present invention is intended to suitably focus an electron beam deflected to change its trajectory and hence to improve uniformity of resolution over the entire phosphor screen, by forming in the deflection magnetic field a locally modified non-uniform magnetic field having a focusing or diverging action on the electron beam varying in synchronization with the deflection magnetic field.

The present invention is also intended to correct the deflection defocusing rapidly increased in synchronization with the deflection amount of an electron beam deflected to change it trajectory (see FIG. 64) and hence to suitably focus the electron beam over the entire phosphor screen, by forming in the deflection magnetic field a locally modified non-uniform magnetic field capable of increasing rapidly the amount of deflection defocusing correction in synchronization with the deflection amount of the electron beam indicated in FIG. 65. This is effective for improving uniformity of resolution over the entire phosphor screen.

As one example of the locally modified non-uniform magnetic field capable of properly increasing a diverging action on an electron beam deflected to change its trajectory in synchronization with the deflection amount, locally modified non-uniform magnetic fields are effectively disposed at substantially symmetric positions on opposite sides of a path of an undeflected electron beam.

The formation of the locally modified non-uniform magnetic fields synchronized with a deflection magnetic field at substantially symmetric positions on opposite sides of the path of the undeflected electron beam, allows the amount of a diverging action on an electron beam to be increased in synchronization with the deflection amount.

Figure 1B:
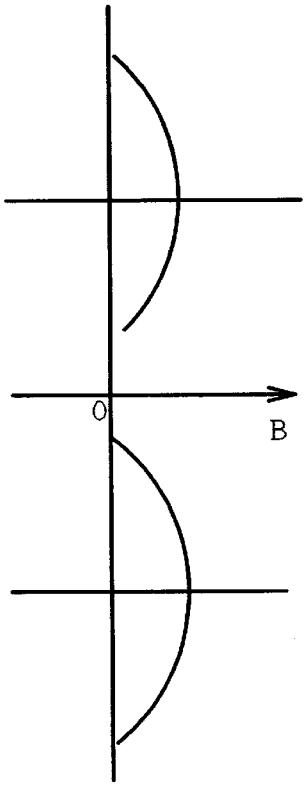
FIGS. 1A and 1B are respectively a schematic sectional view and a magnetic distribution diagram, illustrating a first embodiment of a method of correcting deflection defocusing of a cathode ray tube according to the present invention.
Figure 1A:
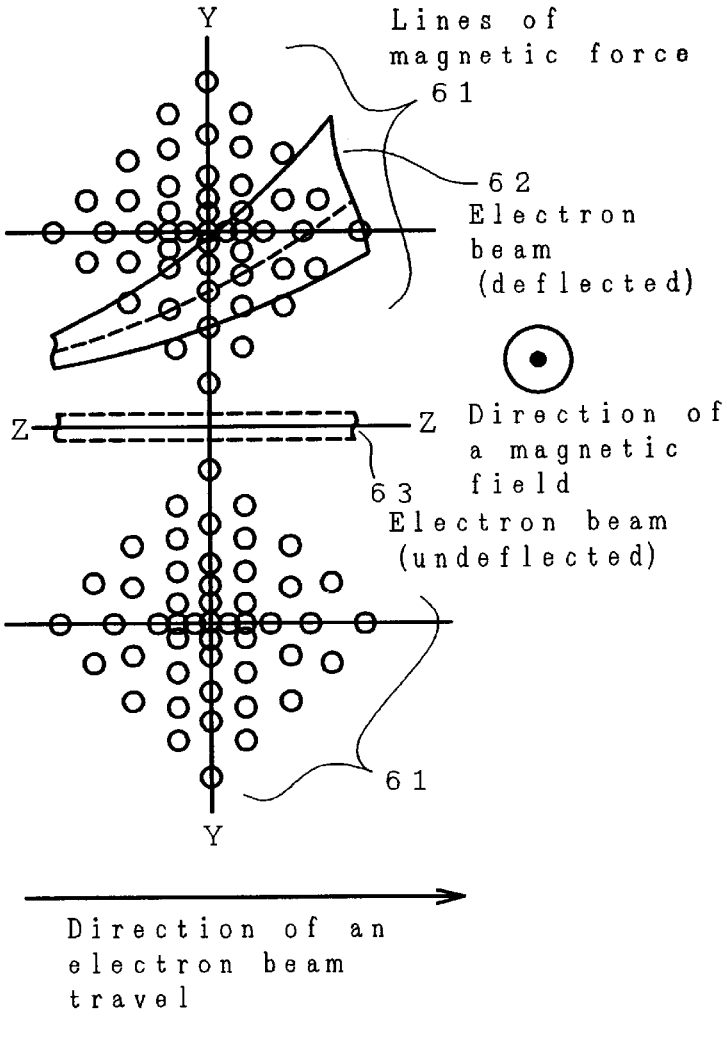

FIGS. 1A and 1B are schematic views illustrating a first embodiment of a method of correcting deflection defocusing of a cathode ray tube according to the present invention. FIG. 1A shows an electron beam in cross-section, which diverges by the effect of locally modified non-uniform magnetic fields each having a diverging action synchronized with a deflection magnetic field as shown in FIG. 1B. In addition, the locally modified non-uniform magnetic fields are disposed at symmetric positions with respect to a center path Z—Z of an undeflected electron beam.

In FIG. 1A, reference numeral 61 indicates lines of magnetic force; 62 is an electron beam passing through a portion remote from the center path of the undeflected electron beam; and 63 is the path of the deflected electron beam. In addition, the locally modified non-uniform magnetic fields having a diverging action in synchronization with the deflection magnetic field are not present at the center path of the undeflected electron beam 63, and the undeflected electron beam 63 is shown by a broken line for differentiation from the electron beam 62.

The electron beam 62 deflected and passing through a portion remote from the center path of the undeflected electron beam 63 diverges in an amount larger than that of the undeflected electron beam 63 while it travels in the magnetic field. The beam bundle also becomes remote from the center path of the undeflected electron beam 63. The rate of change in the trajectory of the electron beam 62 is larger on the side remote from the center path of the undeflected electron beam 63. This is because an interval between lines of magnetic force is narrower as the lines of magnetic force are remote from the center path of the undeflected electron beam 63.

The formation of the above locally modified non-uniform magnetic fields synchronized with the deflection amount of an electron beam in the deflection magnetic field, allows a diverging action on the electron beam deflected and varied in the trajectory to be increased in synchronization with the deflection amount. This makes it possible to correct deflection defocusing in the case where deflection defocusing increases the focusing of the electron beam.

For example, in a cathode ray tube, a distance from a main lens of an electron gun to a phosphor screen is generally longer at a peripheral portion than the center as shown in FIG. 66. As a result, even in the case where a deflection magnetic field has no focusing action, the optimum focusing of an electron beam at the screen center causes overfocusing of an electron beam at the screen peripheral portion.

In this embodiment, the formation of the locally modified non-uniform magnetic fields synchronized with the deflection amount of an electron beam in a deflection magnetic field as shown in FIGS. 1A and 1B, allows a diverging action to the electron beam to be increased in synchronization with the deflection amount. This enables the correction of deflection defocusing shown in FIG. 65.

As one example of the locally modified non-uniform magnetic field capable of properly increasing a focusing action on an electron beam deflected and varied in the trajectory in synchronization with the deflection amount, a locally modified non-uniform magnetic field synchronized with the deflection amount is effectively formed in such a manner as to be centered on the path of the undeflected electron beam.

The formation of the above locally modified non-uniform magnetic field synchronized with the deflection magnetic field in such a manner as to be centered on the path of the undeflected electron beam, allows a focusing action on an electron beam to be increased in synchronization with the deflection amount.

Figure 2B:
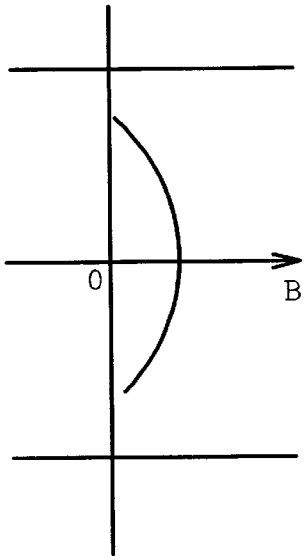
FIGS. 2A and 2B are respectively a schematic sectional view and a magnetic distribution diagram, illustrating a second embodiment of the method of correcting deflection defocusing of a cathode ray tube according to the present invention.
Figure 2A:
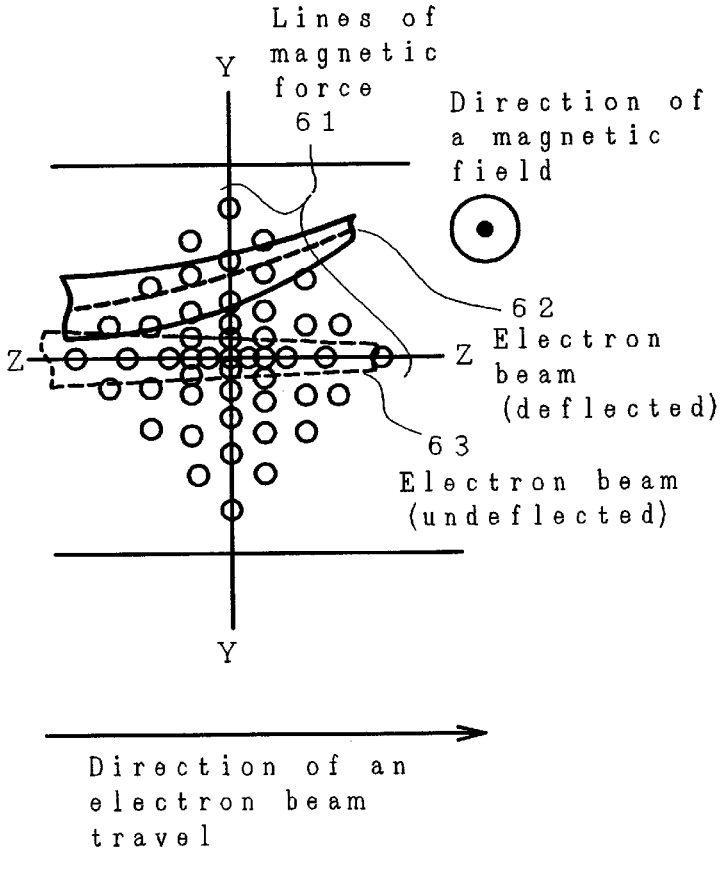

FIGS. 2A and 2B are schematic views illustrating a second embodiment of the method of correcting deflection defocusing of a cathode ray tube according to the present invention. FIG. 2A shows an electron beam in cross-section, which focuses by the effect of a locally modified non-uniform magnetic field having a focusing action. In addition, the locally modified non-uniform magnetic field is disposed in such a manner as to be centered on a center path Z—Z of an undeflected electron beam.

In FIG. 2A, reference numeral 61 indicates lines of magnetic force forming the locally modified non-uniform magnetic field synchronized with a deflection magnetic field shown in FIG. 2B; 62 is an electron beam passing through a portion remote from the center path Z—Z of the undeflected electron beam; and 63 is an undeflected electron beam, which is shown by a broken line just as the undeflected electron beam shown in FIG. 1A.

The electron beam 62 passing through a portion remote from the center path of the undeflected electron beam 63 focuses in an amount larger than that of the undeflected electron beam 63 as it travels in the magnetic field. The beam bundle also becomes emote from the center path of the undeflected electron beam. The rate of change in trajectory is smaller on the side remote from the center path of the undeflected electron beam. This is because the interval in lines 61 of magnetic force is wider as lines 61 of magnetic force are remote from the center path Z—Z of the undeflected electron beam.

The formation of the above locally modified non-uniform magnetic field in the deflection magnetic field, allows a focusing action on the electron beam deflected and varied in trajectory to be increased in synchronization with the deflection amount. This makes it possible to correct deflection defocusing in the case where the deflection defocusing increases divergence of the electron beam.

In most cases, the deflection of a cathode ray tube is performed for allowing an electron beam to linearly scan as shown in FIG. 67. A linear scanning locus 60 is called scanning line. A deflection magnetic field tends to differ between in the scanning direction and in the direction perpendicular to the scanning direction.

The electron beam often receives a focusing action which differs between in the scanning direction and the direction perpendicular to the scanning direction, by the effect of at least one of a plurality of electrodes of an electron gun before it largely receives the action of the locally modified non-uniform magnetic field synchronized with the deflection magnetic field which is formed in the deflection magnetic field.

Moreover, it is dependent on the application of a cathode ray tube whether deflection defocusing correction in the scanning direction is emphasized or deflection defocusing correction direction perpendicular to the scanning direction is emphasized.

Accordingly, the content of the locally modified non-uniform magnetic field, which is synchronized with a deflection magnetic field and is formed in the deflection magnetic field for correcting deflection defocusing and improving uniformity of resolution over the entire phosphor screen, cannot be simply determined.

The technical content and the required cost are dependent on the direction of deflection defocusing correction with respect to the scanning line, content of the correction, and the correction amount, and accordingly, it is important for improving characteristics of an image display system and reducing the cost to make clear the content of the deflection defocusing correction in accordance with respective factors.

According to a third embodiment of a method of correcting deflection defocusing of a cathode ray tube of the present invention, deflection defocusings in the scanning direction and/or in the direction perpendicular to the scanning direction are corrected by forming, in a deflection magnetic field, the locally modified non-uniform magnetic fields shown in FIGS. 1A, 1B and FIGS. 2A, 2B.

In a color cathode ray tube of the type having three inline guns disposed in a horizontal plane, a vertical deflection magnetic field having a barrel-shaped magnetic field distribution and a horizontal deflection magnetic field having a pincushion-shaped magnetic field distribution are used as shown in FIG. 71 (described later) for eliminating or simplifying a circuit for controlling convergence of three electron beams on a phosphor screen.

The amount of deflection defocusing of each side one of three inline electron beams by a deflection magnetic field is dependent on the intensity of the deflection magnetic field and on the direction of the horizontal deflection. For example, the magnetic flux distribution of the deflection magnetic field, through which the right hand electron beam of the inline arrangement (in the direction of the cathode ray tube seen from the phosphor screen side) traverses, differs between the case where the right hand electron beam is deflected to the left half side of the phosphor screen and the case where it is deflected to the right half side thereof. As a result, the amount of the deflection defocusing of the right hand electron beam differs between the above two cases, and thereby the image quality given by the rightward electron beam differs between the right and left ends of the phosphor screen.

To correct deflection defocusing of such a side electron beam, it is effective that a locally modified non-uniform magnetic field synchronized with the deflection magnetic field asymmetric in the direction of the horizontal deflection is disposed in the deflection magnetic field on opposite sides of the center electron gun axis.

FIGS. 3A to 3D are schematic views illustrating a fourth embodiment of the method of correcting deflection defocusing of a cathode ray tube according to the present invention. In this embodiment, locally modified non-uniform magnetic fields, each having a different magnetic field distribution and a diverging action on an electron beam, are provided on opposite sides of an electron gun axis.

Figure 3B:
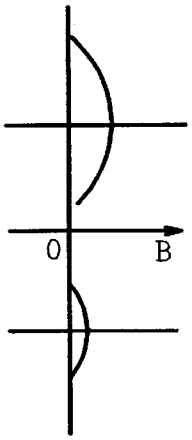
Figure 3A:
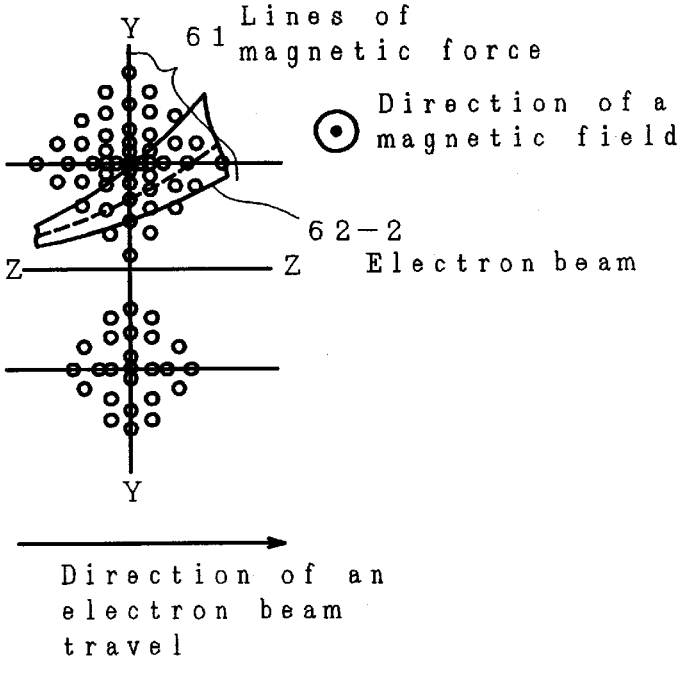

FIGS. 3A and 3B are schematic views illustrating divergence of an electron beam on the side in which the density of lines of magnetic force is high. An electron beam 62-2 passing through a portion remote from the center axis Z—Z of the center electron gun on the side in which the density of lines 61 of magnetic force is high diverges as it travels in the correction magnetic field. The beam bundle is also becomes remote from the center axis Z—Z of the electron gun. The rate of change in trajectory is larger on the side where remote from the center axis Z—Z of the electron gun. This is because an interval between the lines 61 of magnetic force is narrower as the lines 61 of magnetic force are remote from the center axis Z—Z of the electron gun.

Figure 3D:
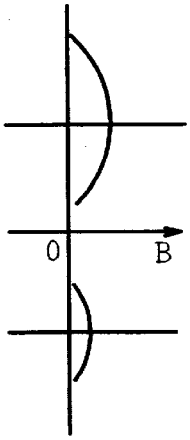
Figure 3C:
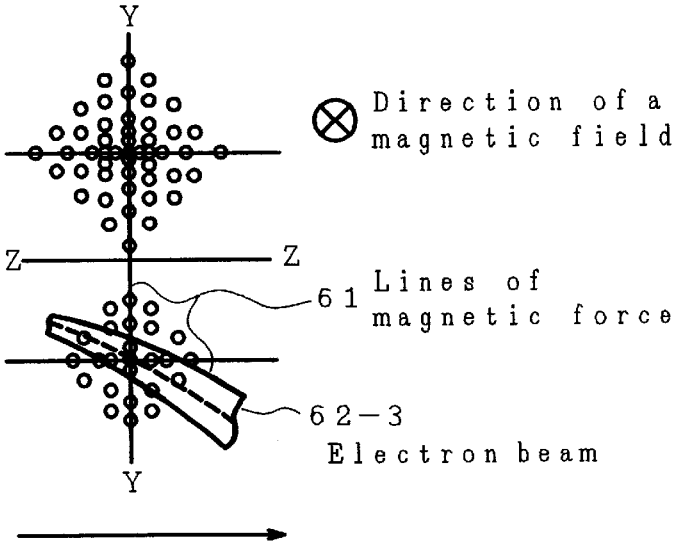

FIGS. 3C and 3D are schematic views illustrating the divergence of an electron beam on the side where the density of lines of magnetic force is low. An electron beam 62-3 passing through a portion remote from the center axis Z—Z of the electron gun diverges like the electron beam 62-2 as it travels in the correction magnetic field, and the beam bundle also becomes remote from the center axis Z—Z. The rate of change in trajectory of the electron beam 62-3 is larger on the side remote from the center axis Z—Z; however, the rate of the change of the trajectory of the electron beam 62-3 is lower than that of the electron beam 62-2. This is because the interval in the lines 61 of magnetic force is not narrower so much even as the lines 61 of magnetic force are remote from the center axis Z—Z.

The above locally modified non-uniform magnetic fields synchronized with the deflection amount, which is formed in the deflection magnetic field, allows the degree of increasing a diverging action exerted on an electron beam deflected and varied in the trajectory in synchronization with the deflection amount to vary depending on the deflection direction. This is effective to correct deflection defocusing in the case of such a focusing action that the amount of deflection defocusing is dependent on the deflection direction.

In practice, the deflection defocusing correction is dependent on, for example, the structure of a cathode ray tube having a specified maximum deflection angle; the structure of a deflection magnetic field generating portion assembled in the cathode ray tube; pole pieces for forming the locally modified non-uniform magnetic fields; the structure of the electron gun other than the pole pieces; the drive condition of the cathode ray tube; and the application of the cathode ray tube.

Figure 4B:
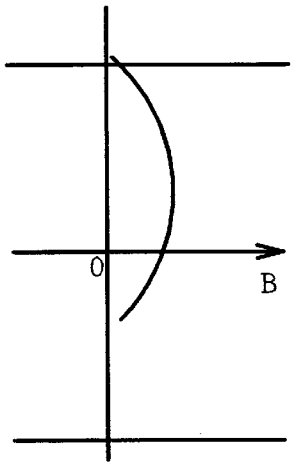
Figure 4A:
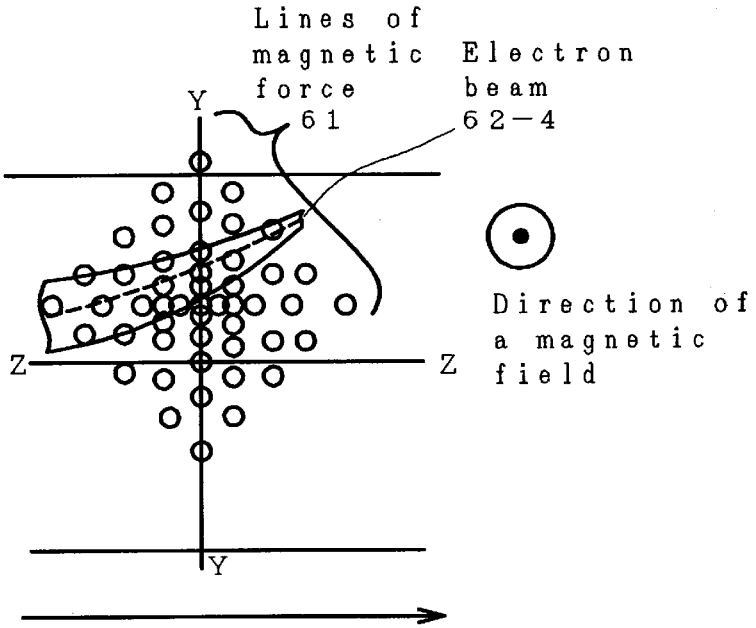
Figure 4D:
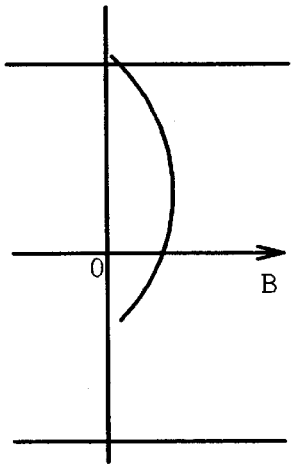
Figure 4C:
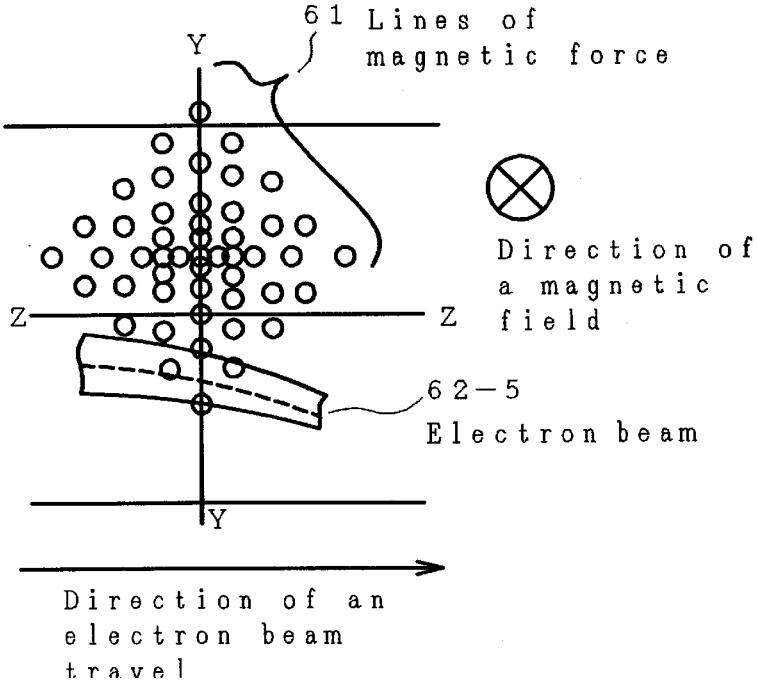

FIGS. 4A to 4D are schematic views illustrating a fifth embodiment of a method of correcting deflection defocusing of a cathode ray tube according to the present invention. In this embodiment, a locally modified non-uniform magnetic field having an asymmetric focusing action on an electron beam is provided near the center axis of an electron gun. An electron beam 62-4 deflected and passing through a portion remote from the center axis Z—Z of the electron gun on the side where the magnetic flux density is high in the magnetic field formed by lines 61 of magnetic force (FIG. 4A). On the contrary, an electron beam 62-5 deflected and passing through a portion remote from the center axis of the electron gun on the side where the magnetic flux density is low in the magnetic field formed by the lines 61 of magnetic force (FIG. 4C).

The electron beam 62-4 passing through the portion remote from the center axis Z—Z on the side where the magnetic flux density is high focuses as it travels in the magnetic field (see FIG. 4A). The beam bundle also becomes remote from the center axis Z—Z. The rate of the change in the trajectory of the electron beam 62-4 is larger on the side near the center axis Z—Z. This is because an interval in the lines 61 of the magnetic force is wider as the lines 61 of magnetic force are remote from the center axis Z—Z.

The electron beam 62-5 passing through the portion remote from the center axis Z—Z on the side where the magnetic flux density is low focuses like the electron beam 62-4 as it travels in the magnetic field (see FIG. 4B). The beam bundle also becomes remote from the center axis Z—Z. The rate of the change in the trajectory of the electron beam 62-5 is larger on the side near the center axis Z—Z; however, the degree of the change in trajectory of the electron beam 62-5 is smaller than that of the electron beam 62-4. This is because the interval between the lines 61 of magnetic force is not changed so much as the lines 61 of magnetic force are remote from the center axis Z—Z.

The above locally modified non-uniform magnetic fields synchronized with the deflection amount, which is formed in the deflection magnetic field, allows the degree of increasing a focusing action exerted on an electron beam deflected to change its trajectory in synchronization with the deflection amount to vary depending on the deflection direction. This is effective to correct deflection defocusing in the case of such a diverging action that the amount of deflection defocusing is dependent on the deflection direction.

In practice, the deflection defocusing correction is dependent on, for example, the structure of a cathode ray tube having a specified maximum deflection angle; the structure of a deflection magnetic field generating portion assembled in the cathode ray tube; pole pieces for forming the locally modified non-uniform magnetic fields; the structure of the electron gun other than the pole pieces; the drive condition of the cathode ray tube; and the application of the cathode ray tube.

In a color cathode ray tube of the type having three inline guns disposed in a horizontal plane, a vertical deflection magnetic field having a barrel-shaped magnetic field distribution and a horizontal deflection magnetic field having a pincushion-shaped magnetic field distribution are used as shown in FIG. 71 (described later) for eliminating or simplifying a circuit for controlling convergence of three electron beams on a phosphor screen.

In such a color cathode ray tube, the inline direction, that is, the horizontal direction becomes the scanning direction. The amount of deflection defocusing given to each side one of three inline electron beams by a deflection magnetic field is dependent on the intensity of the deflection magnetic field and on the direction of the horizontal deflection.

For example, the magnetic flux distribution of the deflection magnetic field, through which the right hand electron beam of the inline arrangement (in the direction of the cathode ray tube seen from the phosphor screen side) traverses, differs between the case where the right hand electron beam is deflected to the left half side of the phosphor screen and the case where it is deflected on the right half side thereof. As a result, the amount of the deflection defocusing of the right hand electron beam differs between the above two cases.

According to a further embodiment of a method of correcting deflection defocusing of a cathode ray tube of the present invention, deflection defocusing of each of side electron beams is corrected by forming, in the deflection magnetic field for the side electron beam, the locally modified non-uniform magnetic field synchronized with the deflection magnetic field in such a manner as to be asymmetric with respect to the center axis of the electron gun as shown in FIGS. 3A to 3D or FIGS. 4A and 4D.

In practice, the deflection defocusing correction is dependent on, for example, the structure of a cathode ray tube having a specified maximum deflection angle; the structure of a deflection magnetic field generating portion assembled in the cathode ray tube; pole pieces for forming the locally modified non-uniform magnetic fields; the structure of the electron gun other than the pole pieces; the drive condition of the cathode ray tube; and the application of the cathode ray tube.

Figure 5:
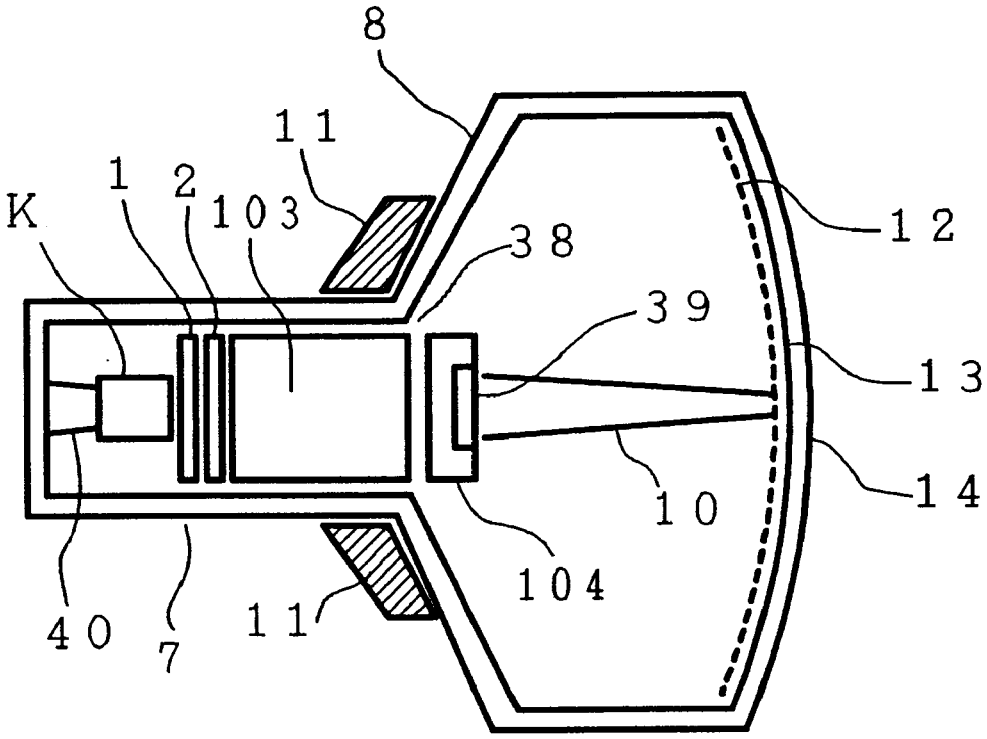
FIG. 5 is a schematic sectional view illustrating a first embodiment of a cathode ray tube of the present invention.

FIG. 5 is a schematic sectional view illustrating a first embodiment of a cathode ray tube of the present invention. Reference numeral 1 indicates a first grid electrode (G1) of an electron gun; 2 is a second grid electrode (G2); 103 is a third grid electrode (G3) which is a focus electrode in this embodiment.

Reference numeral 104 indicated a fourth grid electrode (G4) which is an anode in this embodiment; 7 is a neck portion of the cathode ray tube for containing the electron gun; 8 is a funnel portion; and 14 is a panel portion. These portions 7, 8 and 14 constitute an evacuated envelop of the cathode ray tube.

Reference numeral 10 indicates an electron beam emitted from the electron gun, which passes through an aperture of a shadow mask 12 and impinges on a phosphor film 13 formed on the inner surface of the panel 14 to emit light for displaying an image on the screen of the cathode ray tube. Reference numeral 11 indicates a deflection yoke for deflecting the electron beam 10, which generates a magnetic field in synchronization with a video signal for controlling a point of impingement of the electron beam 10 on the phosphor film 13.

Reference numeral 38 indicates a main lens of the electron gun. The electron beam 10 emitted from a cathode K passes through the first grid electrode (G1) 1, the second grid electrode (G2) 2, the third grid electrode (G3) 103, and then it focuses on the phosphor screen 13 by the electric field of the main lens 38 formed between the third grid electrode (G3) 103 and the anode 104.

Reference numeral 39 indicates pole pieces, positioned in the magnetic field of the deflection yoke 11, for forming at least one locally modified non-uniform magnetic field synchronized with the deflection field, thereby correcting deflection defocusing of the electron beam 10 deflected by the magnetic field of the deflection yoke 11 in synchronization with the deflection angle.

In this embodiment, two of the deflection defocusing correction pole pieces 39 are mechanically fixed on the anode 104 at positions above and below the electron beam 10, that is, in the direction perpendicular to the plane of the drawing. These pole pieces 39 form a locally modified non-uniform magnetic field having a diverging action on the electron beam 10 passing through the interval between the pole pieces 39. In addition, reference numeral 40 indicates leads for connecting the electrode of the electron gun to stem pins (not shown).

The vertical interval between the two pole pieces 39 spaced from each other is actually determined by the combination of the mounting position of each pole piece; the length thereof extending toward the phosphor film 13; the distribution of the deflection magnetic field; the diameter of the electron beam passing through the interval; and the maximum deflection angle of the cathode ray tube.

In this embodiment, as shown in FIG. 5, the main lens 38 of the electron gun is located at the position shifted to the phosphor film 13 from the deflection yoke mounting position in the deflection magnetic field of the deflection yoke 11; however, it is not particularly limited in the mounting position shown in the figure so long as being positioned in the magnetic field of the deflection yoke.

Figure 6:
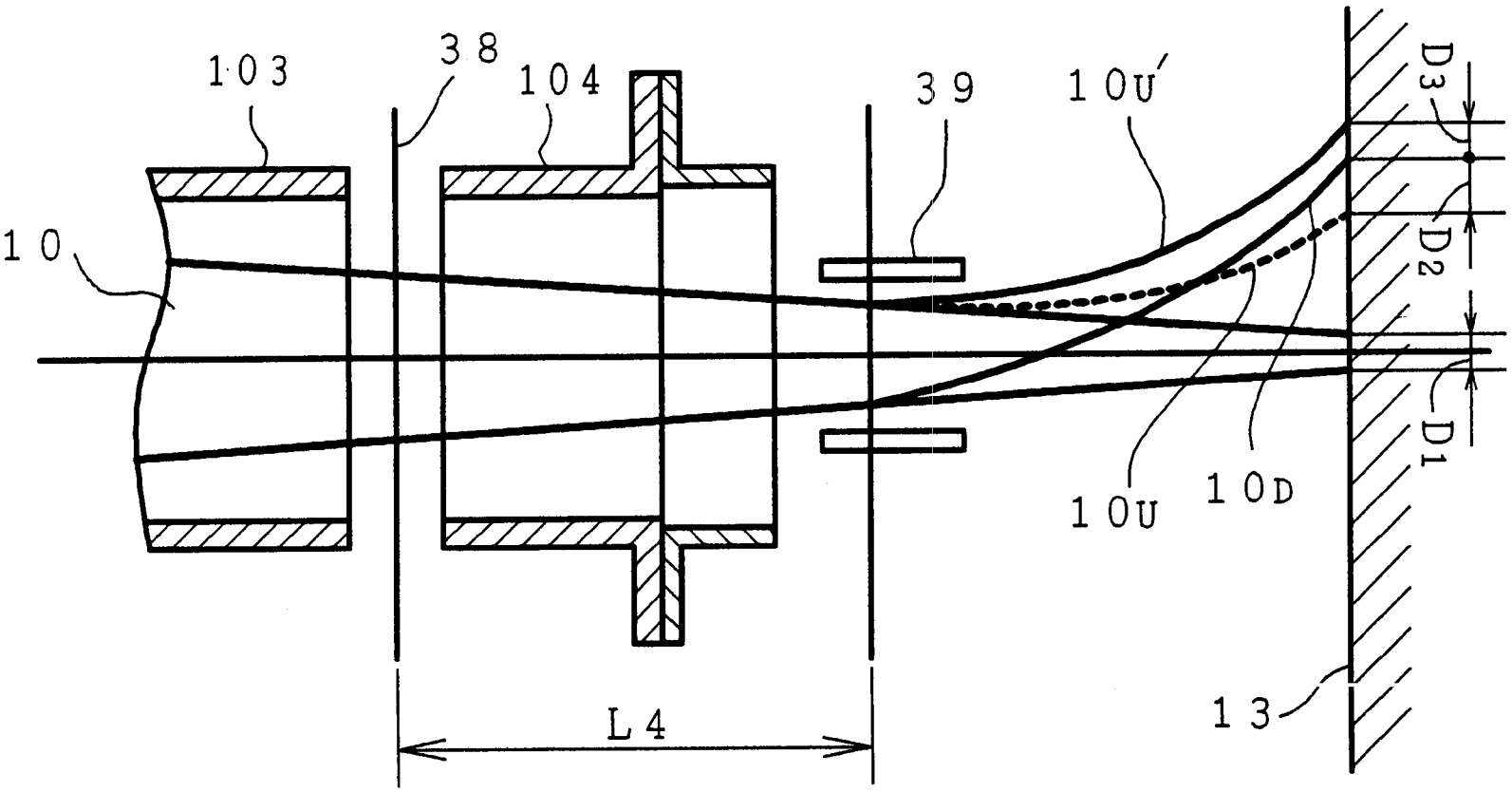
FIG. 6 is a schematic sectional view of an essential portion of the cathode ray tube of the present invention, illustrating an operation of the cathode ray tube.

FIG. 6 is a schematic sectional view illustrating the operation of the cathode ray tube of the present invention, particularly, illustrating the operation of the deflection defocusing correction pole pieces 39. The pole pieces 39 positioned in the magnetic field of the deflection yoke 11 shown in FIG. 5 form a locally modified non-uniform magnetic field for correcting deflection defocusing of the electron beam 10 deflected by the magnetic field of the deflection yoke 11 in synchronization with the deflection angle.

In this example, the electron beam 10 diverges by the locally modified non-uniform magnetic field. In FIG. 6, parts corresponding to those shown in FIG. 5 are indicated by the same characters.

Figure 7:
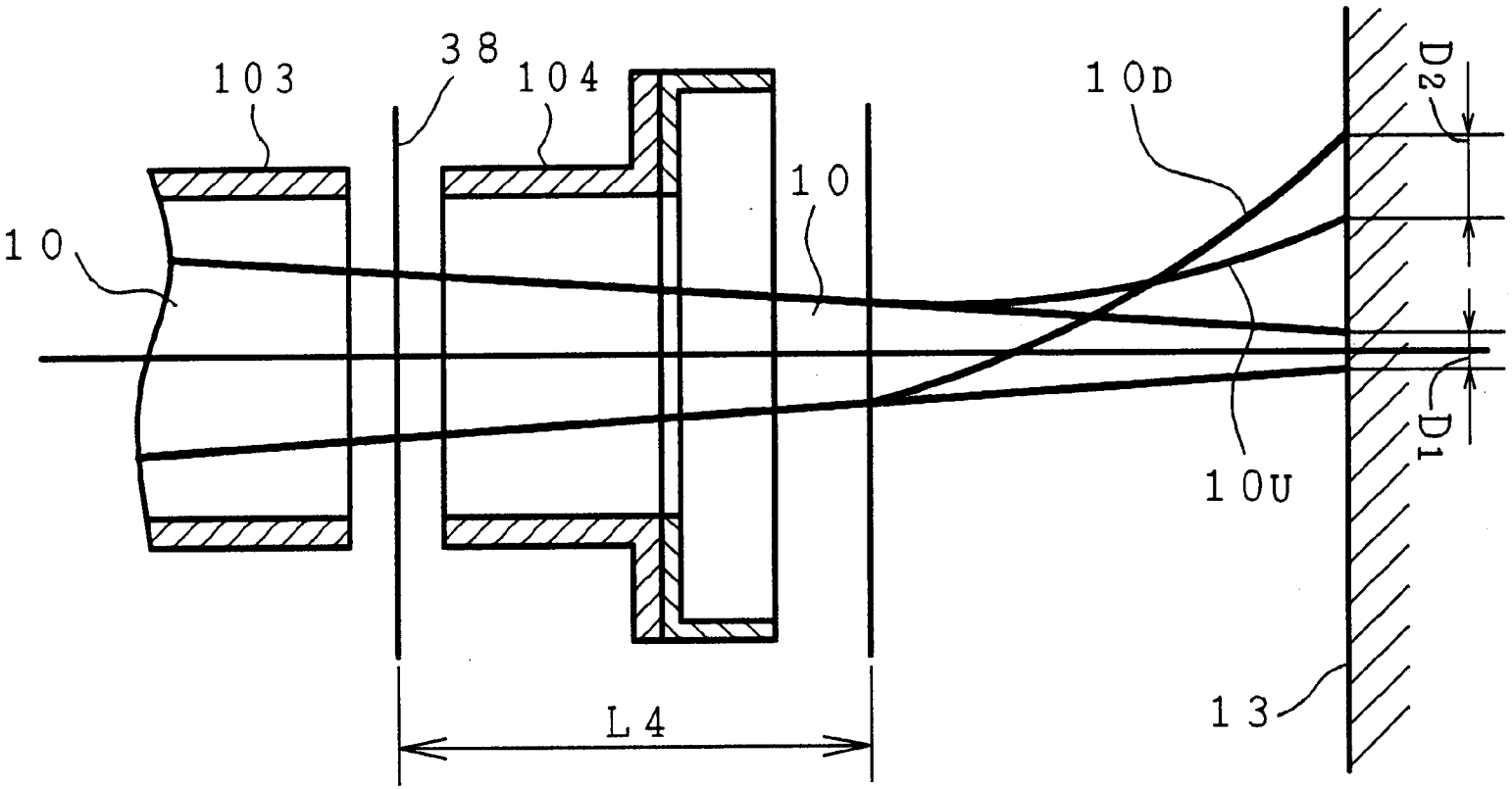
FIG. 7 is a schematic sectional view, similar to FIG. 6, of an essential portion of a cathode ray tube in which deflection defocusing correction pole pieces are not provided, illustrating the effect of the deflection defocusing correction pole pieces for forming a locally modified non-uniform magnetic field in the cathode ray tube of the present invention in comparison with a related art.

FIG. 7 is a schematic sectional view, similar to FIG. 6, of a cathode ray tube having no pole piece for illustrating the operation of the pole pieces of the present invention in comparison with the related art.

Referring to FIGS. 6 and 7, the electron beam 10 passes through the third grid electrode (G3) 103 of the electron gun focuses by a main lens 38 formed between the third grid electrode (G3) 103 and the fourth grid electrode (G4) 104. When being deflected by a deflection magnetic field formed by the deflection yoke 11, the electron beam 10 travels straight and forms a beam spot having a diameter of $D_1$ on a phosphor film 13.

Here, it will be qualitatively described how the trajectory of the electron beam 10 is changed by the presence (FIG. 6) or absence (FIG. 7) of the pole pieces 39 in the case where the electron beam 10 is deflected on the upper side of the phosphor film 13.

Referring to FIG. 7, the lowermost ray trajectory of the electron beam 10 travels as shown by reference numeral 10D because the pole pieces 39 are not provided. The uppermost ray trajectory of the electron beam 10 also travels as shown by reference numeral 10U because the pole pieces 39 are not provided and it crosses the lowermost ray trajectory 10D before reaching the phosphor film 13. As a result, a beam spot having a diameter $D_2$ shown in FIG. 7 is formed on the phosphor film 13.

On the contrary, as shown in FIG. 6, when the pole pieces 39 are provided, the uppermost ray trajectory of the electron beam 10 travels as shown by reference numeral 10U' by the effect of lines of magnetic force formed by the pole pieces 39. The lowermost ray trajectory of the electron beam 10 travels shown by reference numeral 10D because the deflection magnetic field in the trajectory portion is reduced by the magnetic path formed by the pole pieces 39, and thereby it reaches the phosphor film 13 without crossing the uppermost ray trajectory in front of the phosphor film 13.

As a result, a beam spot having a diameter $D_3$ smaller than the diameter $D_2$ is formed on the phosphor film 13. This is due to the fact that the locally modified non-uniform magnetic fields are formed as shown in FIGS. 1A and 1B.

The shape of the beam spot having the diameter $D_3$ on the phosphor film 13 can be suitably adjusted by the combination of the mounting positions of the pole pieces 39; the length of the pole piece 39 extending toward the phosphor film 13; the distribution of the deflection magnetic field; the diameter of the electron beam passing through the interval between the pole pieces 39; and the maximum deflection angle. A uniform resolution over the entire screen can be thus obtained by making smaller the difference between the diameter $D_3$ and the diameter $D_1$ of the beam spot at the screen center.

Figure 8A:
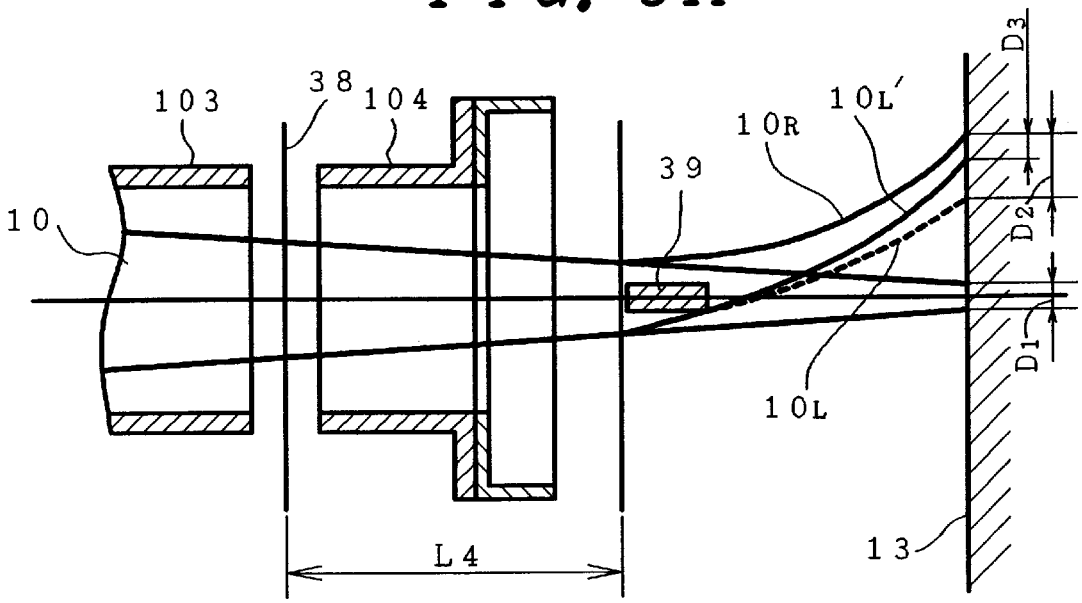
FIGS. 8A and 8B are respectively a sectional top view and a sectional side view, of an essential portion of the cathode ray tube of the present invention, illustrating another operation of the cathode ray tube.
Figure 8B:
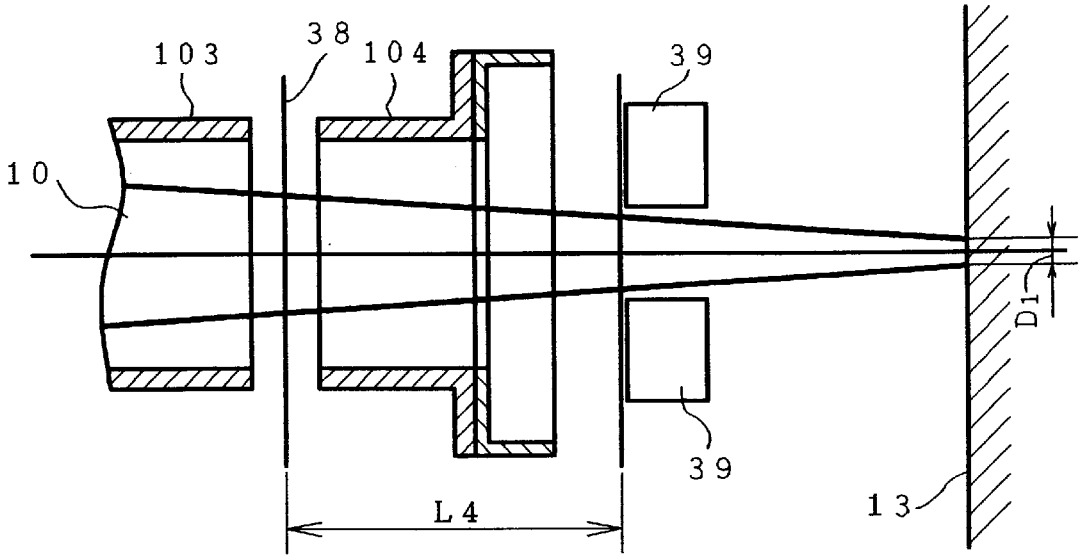

FIGS. 8A and 8B are schematic sectional views illustrating the operation of another embodiment of the cathode ray tube of the present invention, particularly, illustrating another operation of the deflection defocusing correction pole pieces 39, wherein FIG. 8A is a sectional top view and FIG. 8B is a sectional side view. The pole pieces 39 positioned in the magnetic field of the deflection yoke 11 shown in FIG. 5 form a locally modified non-uniform magnetic field for correcting deflection defocusing of the electron beam 10 deflected by the magnetic field of the deflection yoke 11 in synchronization with the deflection angle.

In this example, the electron beam 10 focuses by the above locally modified non-uniform magnetic field. In these figures, parts corresponding to those shown in FIG. 5 are indicated by the same characters.

Figure 9:
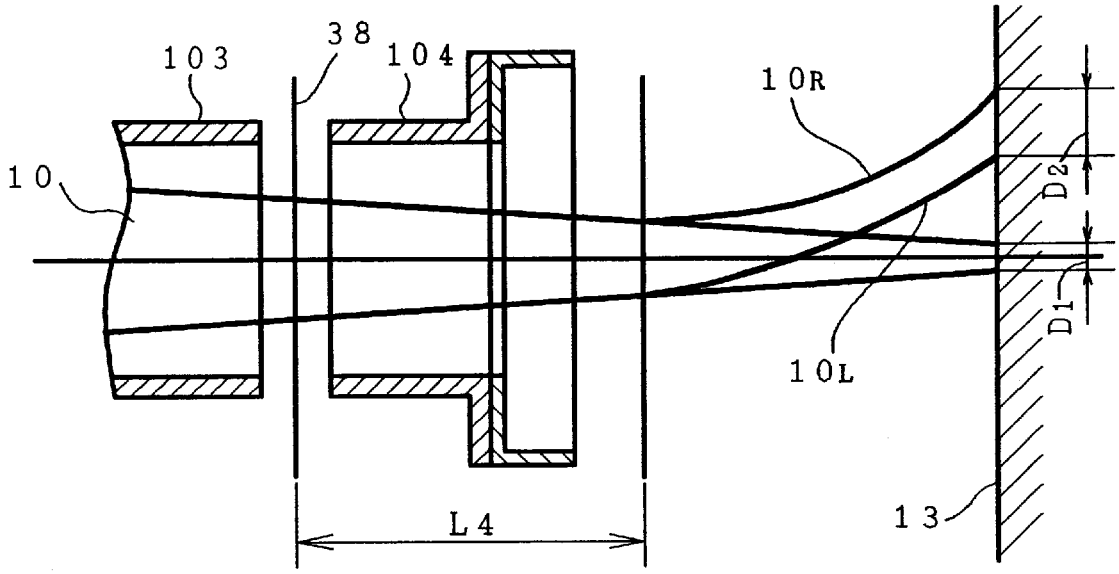
FIG. 9 is a schematic sectional view, similar to FIGS. 8A and 8B, of an essential portion of a cathode ray tube in which deflection defocusing correction pole pieces are not provided, illustrating the effect of the deflection defocusing correction pole pieces for forming a locally modified non-uniform magnetic field in the cathode ray tube of the present invention in comparison with a related art.

FIG. 9 is a schematic sectional view, similar to FIG. 8A, of a cathode ray tube having no pole piece for illustrating the operation of the pole pieces of the present invention in comparison with the related art.

Referring to FIGS. 8A, 8B and FIG. 9, the electron beam 10 passes through the third grid electrode (G3) 103 of the electron gun focuses by a main lens 38 formed between the third grid electrode (G3) 103 and the fourth grid electrode (G4) 104. When being not deflected by a deflection magnetic field formed by the deflection yoke 11, the electron beam 10 travels straight and forms a beam spot having a diameter of $D_1$ on the central portion of the phosphor film 13.

Here, it will be qualitatively described how the trajectory of the electron beam 10 is changed by the presence (FIGS. 8A and 8B) or the absence (FIG. 9) of the pole pieces 39 (see FIGS. 8A, 8B and FIG. 9) in the case where the electron beam 10 is deflected to the right-half side seen from the phosphor screen side.

Referring to FIG. 9, the rightmost trajectory of the electron beam 10 travels as shown by the reference numeral 10R because the pole pieces 39 are not provided; and the leftmost ray trajectory also travels as shown by the reference numeral 10L because the pole pieces 39 are not provided and it diverges on the phosphor film 13, to form a beam spot having a diameter $D_2$.

On the contrary, as shown in FIG. 8A, when the pole pieces 39 are provided, the leftmost ray trajectory of the electron beam travels as shown by the reference numeral 10L' by the effect of lines of magnetic force formed by the pole pieces 39.

The rightmost ray trajectory of the electron beam travels shown by the reference numeral 10R because the deflection magnetic field in the trajectory portion is reduced by the magnetic path formed by the pole pieces 39, and thereby it focuses on the phosphor film 13.

As a result, a beam spot having a diameter $D_3$ smaller than the diameter $D_2$ is formed on the phosphor film 13. This is due to the fact that the locally modified non-uniform magnetic field is formed as shown in FIGS. 2A and 2B.

The shape of the beam spot having the diameter $D_3$ on the phosphor film 13 can be suitably adjusted by the combination of the mounting positions of the pole pieces 39; the length of the pole piece 39 extending toward the phosphor film 13; the length of the pole piece 39 extending substantially in parallel toward the phosphor film 13; the distribution of the deflection magnetic field; the diameter of the electron beam passing through the interval between the pole pieces 39; and the maximum deflection angle. A uniform resolution over the entire screen can be thus obtained by making smaller the difference between the diameter $D_3$ and the diameter $D_1$ of the beam spot at the screen center.

As a result, the present invention can provide an inexpensive cathode ray tube enabling the focusing control synchronized with the deflection angle on the phosphor screen without dynamic focusing in synchronization with the deflection angle of an electron beam, leading to a uniform display over the entire screen. The detail conditions in the embodiments of the present invention are actually dependent on, for example, the structure of the cathode ray tube having a specified maximum deflection angle; the structure of a deflection magnetic field generating portion assembled in the cathode ray tube; the structure of the pole pieces for forming a locally modified non-uniform magnetic field; the structure of an electron gun other than the pole pieces; the drive condition of the cathode ray tube; and the application of the cathode ray tube.

To improve uniformity of resolution over the entire phosphor screen by forming in a deflection magnetic field a locally modified non-uniform magnetic field synchronized with the deflection magnetic field, the trajectory of an electron beam must be deflected to pass through the different magnetic field areas even in the locally modified non-uniform magnetic field. Accordingly, there presents a positional relationship between the locally modified non-uniform magnetic field and the deflection magnetic field.

Figure 10A:
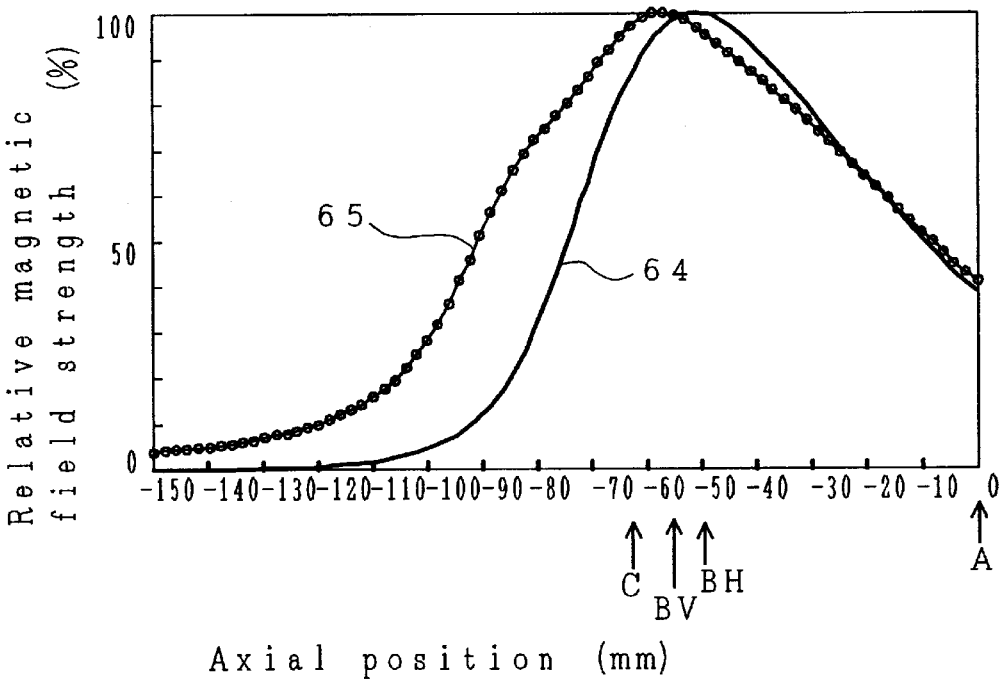
Figure 10B:
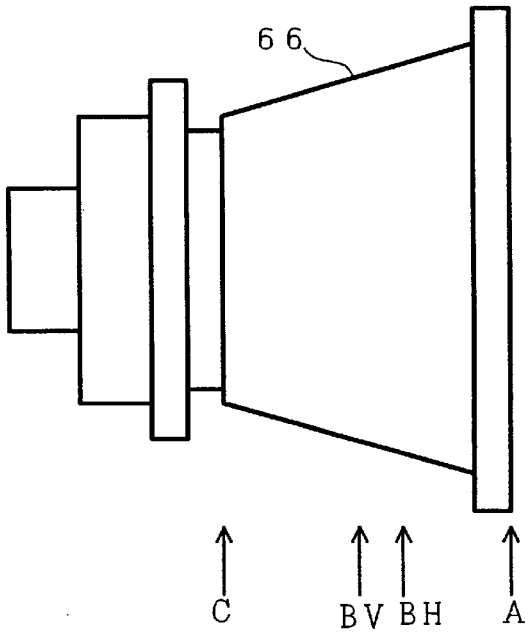

FIGS. 10A and 10B are a graph and a view illustrating a deflection magnetic field distribution, respectively; wherein FIG. 10A is a graph illustrating the deflection magnetic field distribution on the axis of the cathode ray tube having the deflection angle of 100° or more; and FIG. 10B is a view illustrating the positional relationship between the deflection magnetic field distribution shown in FIG. 10A and the deflection magnetic field generating mechanism.

The right in FIG. 10B is the side near the phosphor screen and the left in FIG. 10B is the side remote from the phosphor screen.

In FIGS. 10A and 10B, reference character A indicates a reference position for measurement of the magnetic field; BH is a position having the maximum value of the magnetic flux density 64 of the magnetic field for deflection in the scanning direction; BV is a position having the maximum value of the magnetic flux density of the magnetic field for deflection in the direction perpendicular to the scanning direction; and C is an end portion, on the side remote from the phosphor screen, of a magnetic material forming a core of a coil for forming the magnetic field.

In the case where a portion of the pole piece on the phosphor screen side has axial indention in the axial direction of the cathode ray tube, the distance is expressed by the longest portion.

Figure 11A:
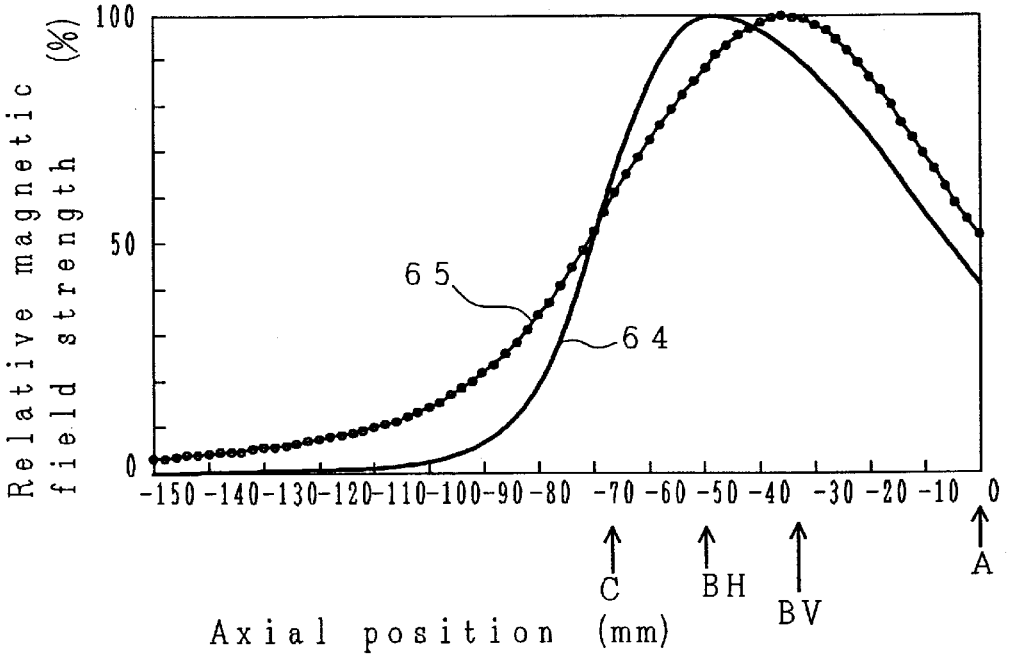
Figure 11B:
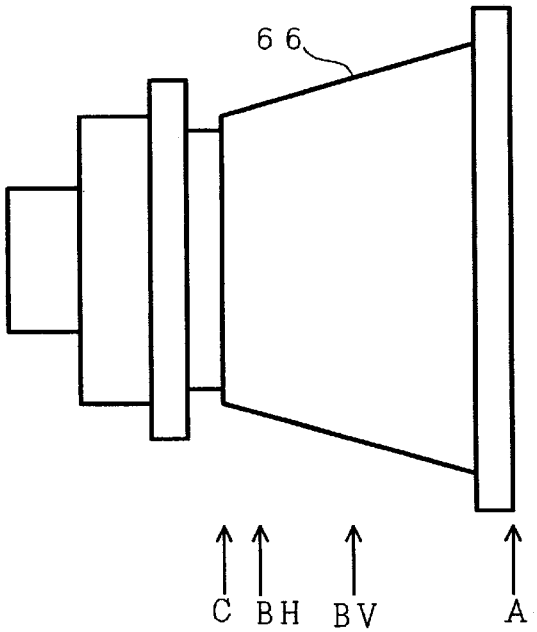

FIGS. 11A and 11B are a graph and a view illustrating a deflection magnetic field distribution, respectively; wherein FIG. 11A is a graph illustrating the deflection magnetic field distribution on the axis of the cathode ray tube having the deflection angle of 100° or less; and FIG. 11B is a view illustrating the positional relationship between the deflection magnetic field distribution shown in FIG. 11A and the deflection magnetic field generating mechanism.

The right in FIG. 11B is the side near the phosphor screen and the left in FIG. 11B is the side remote from the phosphor screen.

In FIGS. 11A and 11B, reference character A indicates a reference position for measurement of the magnetic field; BH is a position having the maximum value of the magnetic flux density 64 of the magnetic field for deflection in the scanning direction; BV is a position having the maximum value of the magnetic flux density of the magnetic field for deflection in the direction perpendicular to the scanning direction; and C is an end portion, on the side remote from the phosphor screen, of a magnetic material forming a core of a coil for forming the magnetic field.

FIG. 12 is a perspective view of the configuration of deflection defocusing correction pole pieces of the present invention, formed in a deflection magnetic field, for forming locally modified non-uniform magnetic fields synchronized with the deflection magnetic field. Each of the four pole pieces 39 shown in the figure is made of a soft magnetic plate. Surfaces E of the pole pieces 39 face a phosphor screen substantially in parallel thereto in such a manner that pole tips 39A of the adjacent pole pieces 39 are separated from each other by a distance D. An undeflected electron beam passes through each of centers Zc—Zc and Zs—Zs in the intervals of the pole tips 39A.

The pole pieces 39 were set in angle in such a manner that the six intervals D between the pole tips 39A were in parallel to the scanning line, and were mounted on the anodes of electron guns of a color cathode ray tube having a specification in which the outside diameter of a neck portion was 29 mm, the maximum deflection angle was 112°, and the phosphor screen size was 68 cm.

Such a cathode ray tube exhibited a desirable result in the condition that a deflection magnetic field shown in FIGS. 10A was applied, the surfaces E shown in FIG. 12 were set at the axial position of −96 mm, and the anode voltage 30 kV was applied.

In the case where the pole pieces are removed from the surfaces E in FIG. 12, the relationship B(mT)/√Eb(kV) between the magnetic flux density and the anode voltage is 0.0104 mT·(kV)$^{-1/2}$, which corresponds to about 40% of the maximum magnetic flux density. The positions where the surfaces E are set are separated from the remote core end portion of the coil for generating the deflection magnetic field by about 18 mm.

These conditions are dependent on, for example, the structure of the cathode ray tube having a specified maximum deflection angle; the structure of a deflection magnetic field generating portion assembled in the cathode ray tube; the pole pieces for forming locally modified non-uniform magnetic fields; the structure of an electron gun other than the pole pieces; the drive condition of the cathode ray tube; and the application of the cathode ray tube.

The pole pieces 39 shown in FIG. 12 for forming in a deflection magnetic field locally modified non-uniform magnetic fields in synchronization with the deflection magnetic field were also mounted on anodes of electron guns of a color cathode ray tube having a specification in which the outside diameter of a neck portion was 29 mm, the maximum deflection angle was 90°, and the phosphor screen size was 48 cm.

Such a cathode ray tube exhibited a desirable result in the condition that a deflection magnetic field shown in FIGS. 11A was applied, the surfaces E shown in FIG. 12 were set at the axial position of −58 mm, and the anode voltage 30 kV was applied.

In the case where the pole pieces are removed from the surfaces E in FIG. 12, the relationship $$B(\mathrm{mT})/\sqrt{Eb(\mathrm{kV})}$$

between the magnetic flux density B and the anode voltage Eb is 0.016 mT·(kV)$^{-1/2}$, which corresponds to about 78% of the maximum magnetic flux density. The positions where the surfaces E are set are separated from the remote core end portion of the coil for generating the deflection magnetic field by about 25 mm.

These conditions are dependent on, for example, the structure of the cathode ray tube having a specified maximum deflection angle; the structure of a deflection magnetic field generating portion assembled in the cathode ray tube; the pole pieces for forming locally modified non-uniform magnetic fields; the structure of an electron gun other than the pole pieces; the drive condition of the cathode ray tube; and the application of the cathode ray tube.

Figure 13A:
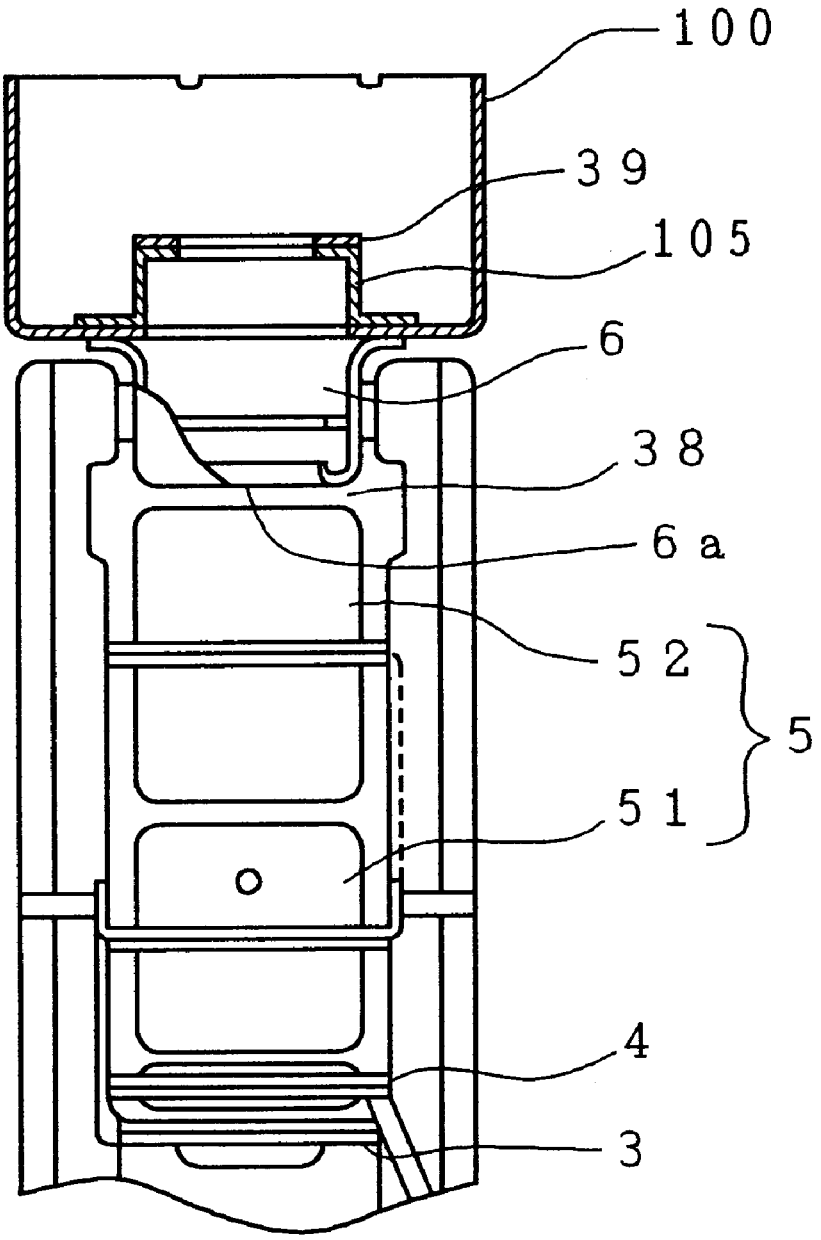
FIG. 13A is a sectional view of an essential portion of one example of an electron gun used for the cathode ray tube of the present invention.
Figure 13B:
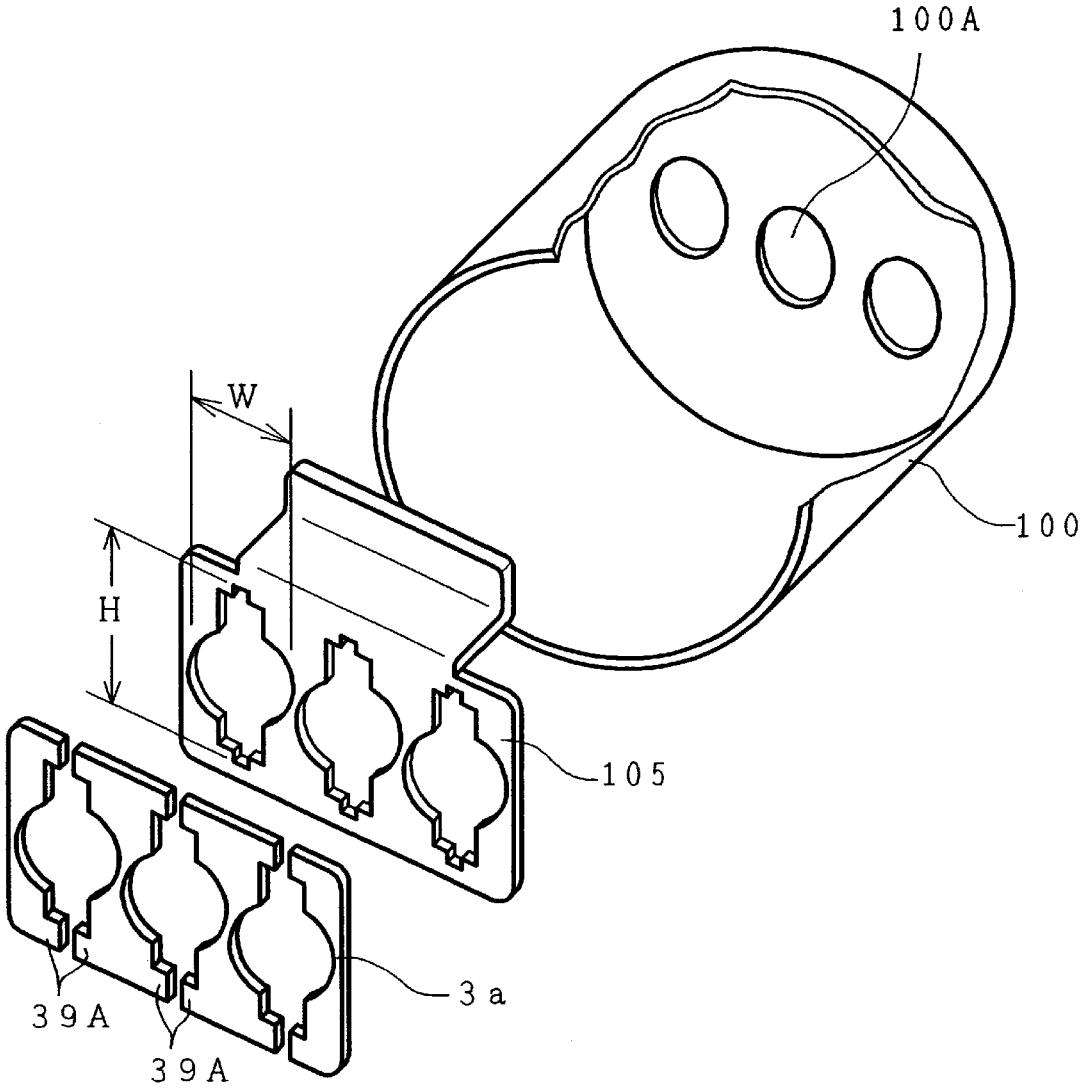
FIG. 13B is an exploded perspective view showing an assembly of pole pieces and a shield cup used for the cathode ray tube of the present invention.

FIG. 13A is a sectional view of an essential portion of one example of an electron gun used for a cathode ray tube of the present invention. Referring to this figure, an anode 6 forming a main lens 38 is disposed in the cathode ray tube on the side near a phosphor screen and a focusing electrode 5 is disposed on the side remote from the phosphor screen.

In FIG. 13A, deflection defocusing correction pole pieces 39 for forming in a deflection magnetic field a locally modified non-uniform magnetic field synchronized with the deflection magnetic field are located at positions shifted toward the phosphor screen from the end surface 6*a* of the anode 6 and the main lens 38 of the electron gun. Reference numeral 100 indicates a shield cup; and 105 is a pole piece support.

Figure 14:
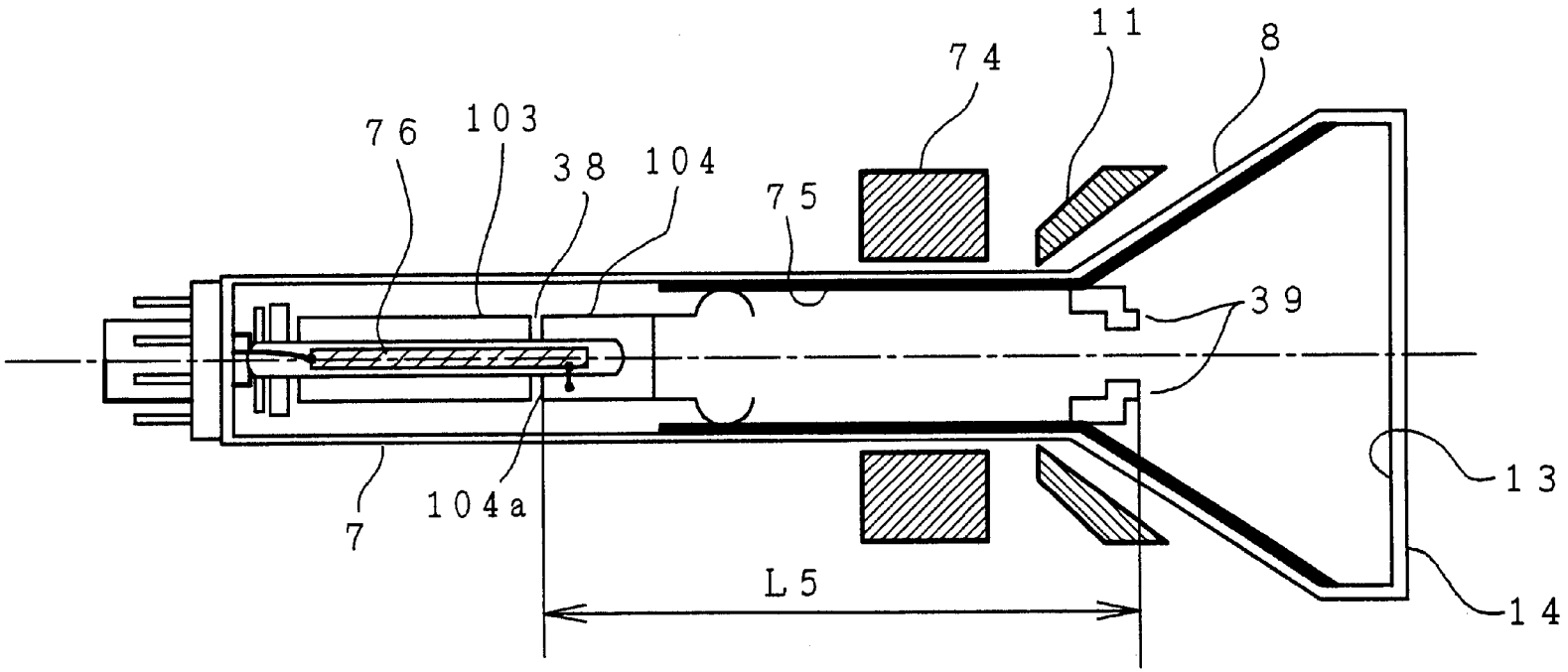
FIG. 14 is a schematic view illustrating one example of an electron gun used for the cathode ray tube of the present invention.

FIG. 14 is a schematic view illustrating one example of the configuration of an electron gun used for the cathode ray tube according to the present invention. In addition, the cathode ray tube is of a projection type having the maximum deflection angle less than 85°.

In FIG. 14, a magnetic focusing coil 74 is disposed outside a neck portion 7 at a position on the side of a phosphor screen 13 with respect to an anode 104. A distance L5 between a surface 104*a,* facing the main lens 38, of the anode 104 and the end portions, near the phosphor screen 13, of deflection defocusing correction magnetic pole pieces 39 for forming in a deflection magnetic field locally modified non-uniform magnetic fields synchronized with the deflection magnetic field is about 180 mm. The anode 104 is a cylinder in which the inside diameter of the surface 104*a* facing the main lens 38 is 30 mm.

In the configuration shown in FIG. 14, a potential of a phosphor film is divided by a resistive film 75 formed on the inner surface of the neck portion 7 and a resistor 76, to generate a voltage supplied to the anode 104. The detail conditions are dependent on, for example, the structure of the cathode ray tube having a specified maximum deflection angle; the structure of a deflection magnetic field generating portion assembled in the cathode ray tube; the deflection defocusing correction pole pieces; the structure of the electron gun other than the pole pieces; the operation condition of the cathode ray tube; and the application of the cathode ray tube.

Figure 15A:
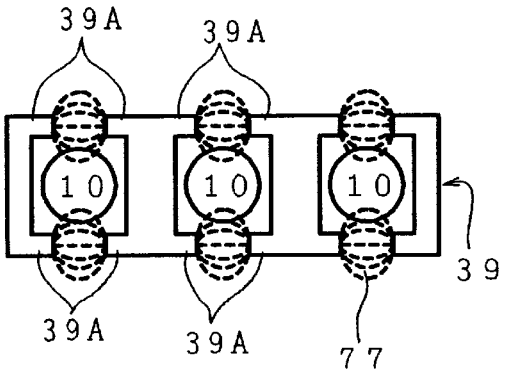
FIG. 15A and 15B are views illustrating in detail defocusing correction lines of magnetic force in the vertical and horizontal directions in configuration examples of deflection defocusing correction pole pieces used for a color cathode ray tube of the three in-line electron beam type of the present invention, respectively.
Figure 15B:
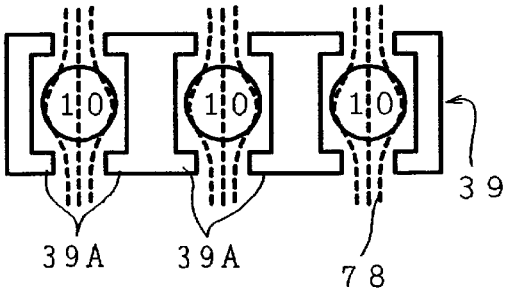

FIGS. 15A and 15B are views illustrating one structure of deflection defocusing correction pole pieces used for a three inline beam type color cathode ray tube of the present invention; wherein FIG. 15A is a view illustrating lines of magnetic force for defocusing correction in the vertical direction; and FIG. 15B is a view illustrating lines of magnetic force for defocusing correction in the horizontal direction.

In FIG. 15A, the pole pieces 39 are positioned on opposite sides, in the inline direction, of each electron beam 10 in such a manner that the opposed portions of each pole piece tip 39*a* of the pole piece 39 are positioned in the direction perpendicular to the inline direction of the electron beam 10 for convergence of a magnetic flux at the opposed portions.

In addition, reference numeral 77 in FIG. 15A indicates lines of magnetic force for deflecting the electron beam in the direction perpendicular to the inline direction. The formation of the pole pieces 39 made of a magnetic material for forming in a deflection magnetic field locally modified non-uniform magnetic fields synchronized with the deflection magnetic field, allows the number of lines 77 of magnetic force to be converged near and on opposite sides of a path of an undeflected electron beam 10 and hence to perform deflection defocusing correction.

In FIG. 15B, reference numeral 78 indicates lines of magnetic force for deflecting an electron beam 10 in the inline direction. The formation of the pole pieces 39 made of a magnetic material for forming in a deflection magnetic field, locally modified non-uniform magnetic fields synchronized with the deflection magnetic field allows the lines 78 of magnetic force to be converged near and on opposite sides of the path of the undeflected electron beam and hence to perform deflection defocusing correction.

Figure 13C:
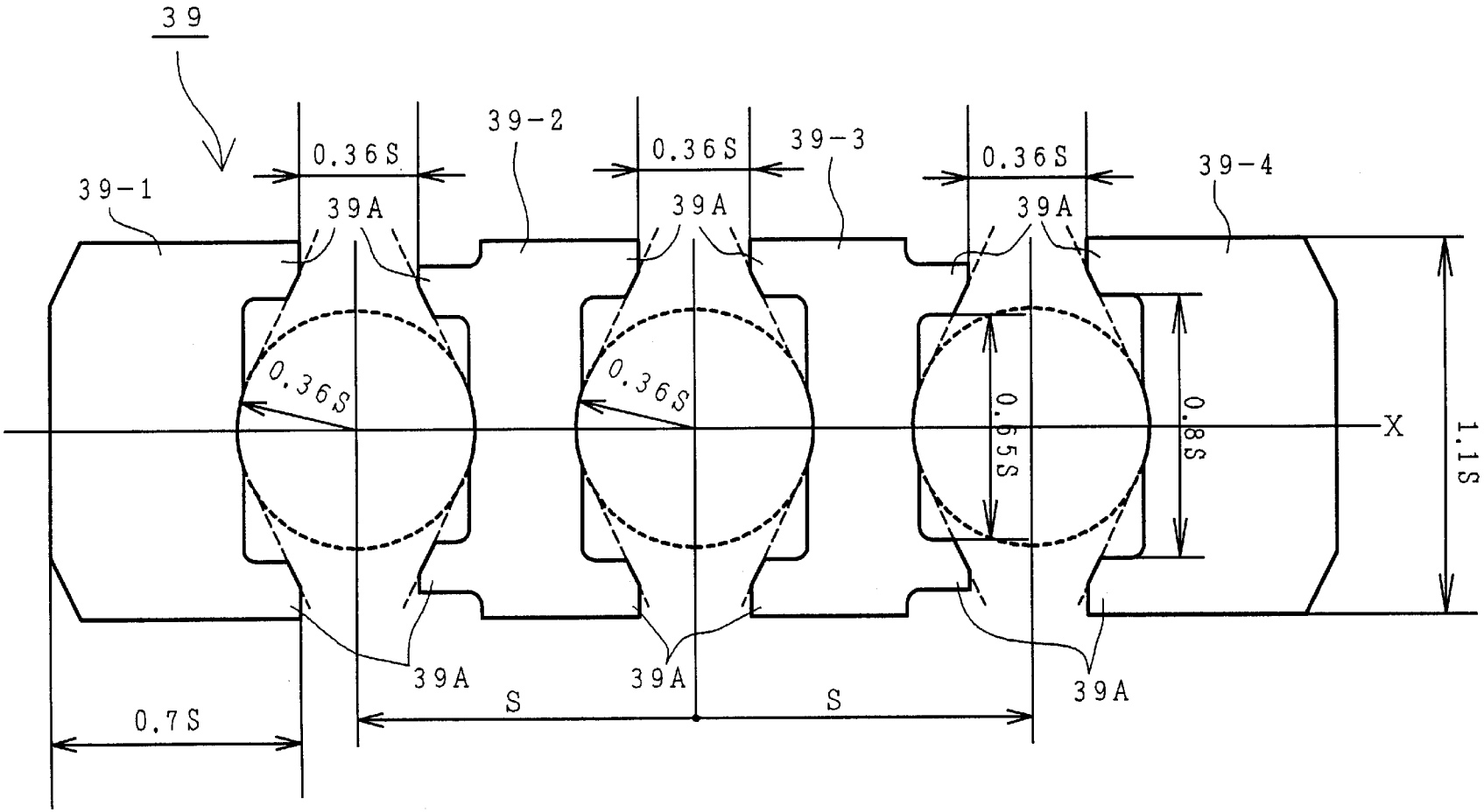
FIG. 13C is a front view showing the details of the pole pieces.

The pole pieces 39 shown in FIGS. 15A, 15B can be actually applied to a gun for the color cathode ray tube of the type having three inline electron beams shown in FIG. 13A. FIG. 13B is an exploded perspective view showing an assembling state of the pole pieces 39, a pole piece support 105 and a shield cup 100 of each electron gun of the cathode ray tube shown in FIG. 13A; and FIG. 13C is a front view showing the detail of the pole pieces 39. The features of the pole pieces are as follows.

(1) Four pole pieces 39-1, 39-2, 39-3 and 39-4 are arranged in the inline direction of three electron beams in such a manner that pole tips 39A of the adjacent pole pieces are disposed on opposite positions of a plane passing through a path of an undeflected electron beam and being perpendicular to the inline direction.

In FIG. 13C, reference character S indicates an interval between undeflected electron beams.

(2) Each of six opposed portions of the four pole pieces for three electron beams has an area formed in the same arcuate shape having the same radius near the inline axis. This arcuate shape is effective to decrease a vertical deflection magnetic field near the inline axis and to suitably increase the vertical deflection magnetic field with a position remote from the inline axis. Since the four pole pieces for three beams have the six central opposed areas formed in the same arcuate shape having the same radius, the corrections for the trajectories of the three electron beams near the inline axis (not requiring a large correction for trajectories so much) are substantially identical to each other, to thereby suppress a change in convergence; and further when mounted on the electron guns, a cylindrical mandrel can be used, to thereby improve the workability and mounting accuracy in assembly.

(3) A portion, remote from the inline axis, of the opposed surface of each pole piece is cutaway in the midway of the tangent line of the arcuate shape.

By cutting away the midway of the tangent line of the arcuate shape, it is possible to suppress an extreme gradient of a density distribution of the magnetic field for diverging the electron beam in the direction perpendicular to the inline direction. When an extreme change in density distribution of the magnetic field is present, the vertical deflection defocusing correction is made excessive on the upper and lower portion of the screen, so that the vertical diameter of the beam spot is increased, to thereby reduce the vertical resolution; and further the curvature of lines of magnetic force is increased so that the focusing action on the electron beam in the horizontal direction is made excessive, to thereby generate halos on the right and left of a beam spot. When a crosshatch pattern is displayed, halos are generated on the right and left of each vertical line, to thereby reduce the resolution.

(4) Intervals between the pole pieces are set to be identical to each other for three electron guns. By imparting similar magnetic fields to peripheries of the three electron guns, a change in convergence can be suppressed even when the positions of the pole pieces to the deflection magnetic field are varied.

(5) The pole tips 39A of the center pole pieces 39-2 and 39-3 are closer to the inline axis X—X than the pole tips 39A of the right and left outermost magnetic pieces 19-1 and 39-2. It is possible to reduce a difference in the influence of the deflection defocusing between a state where the side electron beam is deflected rightward and a state where it is deflected leftward, and to a balance of the deflection sensitivity between the rightward and leftward deflections. This is effective to suppress the change in convergence in the horizontal direction.

(6) Each of the right and left outermost pole pieces 39-1 and 39-4 is larger in the width in the X—X direction than each of the central pole pieces 39-2 and 39-3. This makes it possible to adjust the horizontal deflection sensitivity of the side electron beam to that of the center electron beam, and hence to suppress the change in convergence.

(7) The plate thickness of the pole piece is uniform. The pole piece can be formed by punching, resulting in the reduced cost.

Figure 16A:
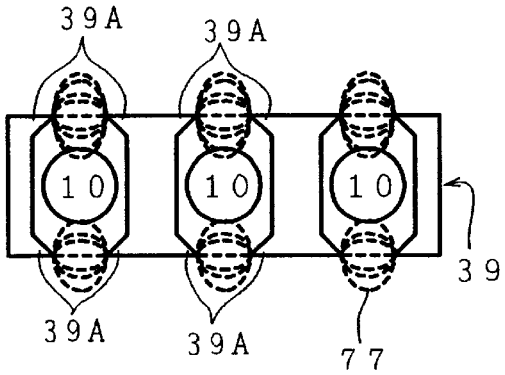
FIG. 16A and 16B are views illustrating in detail defocusing correction lines of magnetic force in the vertical and horizontal directions in another configuration examples of the deflection defocusing correction pole pieces used for the color cathode ray tube of the three in-line electron beam type of the present invention, respectively.
Figure 16B:
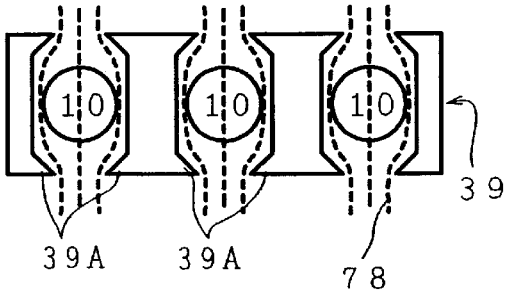

FIGS. 16A and 16B are views illustrating another structure of deflection defocusing correction pole pieces used for a three inline beam type color cathode ray tube of the present invention; wherein FIG. 16A is a view illustrating lines of magnetic force for defocusing correction in the vertical direction; and FIG. 16B is a view illustrating lines of magnetic force for defocusing correction in the horizontal direction.

In FIG. 16A, the pole pieces 39 are positioned on opposite sides, in the inline,direction, of each electron beam 10 in such a manner that the opposed portions of each pole tip 39*a* of the pole piece 39 are positioned in the direction perpendicular to the inline direction of the electron beam 10 for convergence of a magnetic flux at the opposed portions.

In addition, reference numeral 77 in FIG. 16A indicates lines of magnetic force for deflecting the electron beam in the direction perpendicular to the inline direction. The formation of the pole pieces 39 made of a magnetic material for forming in a deflection magnetic field locally modified non-uniform magnetic fields synchronized with the deflection magnetic field, allows the number of lines 77 of magnetic force to be converged near and on opposite sides of a path of an undeflected electron beam 10 and hence to perform deflection defocusing correction.

In FIG. 16B, the pole pieces 39 are positioned on opposite sides, in the inline direction, of each electron beam 10 in such a manner that the opposed portions of each pole tip 39*a* of the pole piece 39 are positioned in the inline direction of the electron beam 10 for convergence of a magnetic flux at the opposed portions.

In FIG. 16B, reference numeral 78 indicates lines of magnetic force for deflecting an electron beam 10 in the inline direction. The formation of the pole pieces 39 made of a magnetic material for forming in a deflection magnetic field locally modified non-uniform magnetic fields synchronized with the deflection magnetic field, allows the lines 78 of magnetic force to be converged near and on opposite sides of the path of the undeflected electron beam and hence to perform deflection defocusing correction.

This configuration in which portions near the electron beam, of the pole piece 39 are tapered, is suitable for the case where the lines 77 of magnetic force of the deflection magnetic field in the direction perpendicular to the inline direction are not required to be reduced near and on opposite sides of the path of the undeflected electron beam, as compared with the configuration shown in FIGS. 15A and 15B.

Figure 17A:
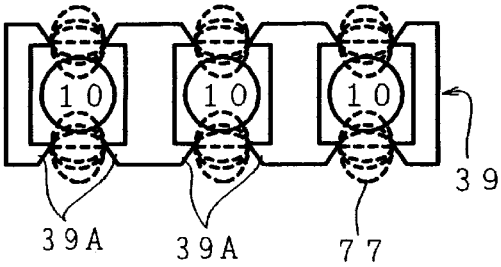
FIG. 17A and 17B are views illustrating in detail defocusing correction lines of magnetic force in the vertical and horizontal directions in further configuration examples of the deflection defocusing correction pole pieces used for the color cathode ray tube of the three in-line electron beam type of the present invention, respectively.
Figure 17B:
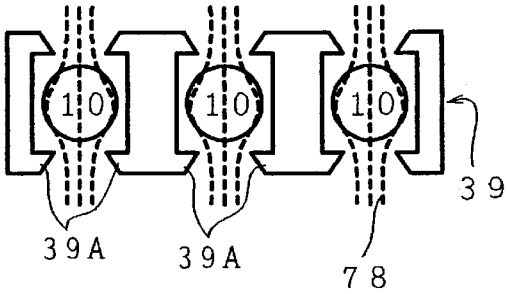

FIGS. 17A and 17B are views illustrating a further structure of deflection defocusing correction pole pieces used for a three inline beam type color cathode ray tube of the present invention; wherein FIG. 17A is a view illustrating lines of magnetic force for deflection defocusing correction in the vertical direction; and FIG. 17B is a view illustrating lines of magnetic force for defocusing correction in the horizontal direction.

In FIG. 17A, the pole pieces 39 are positioned on opposite sides, in the inline direction, of each electron beam 10 in such a manner that the opposed portions of each pole tip 39*a* of the pole piece 39 are positioned in the direction perpendicular to the inline direction of the electron beam 10 for convergence of a magnetic flux at the opposed portions.

In addition, reference numeral 77 in FIG. 17A indicates lines of magnetic force for deflecting the electron beam in the direction perpendicular to the inline direction. The formation of the pole pieces 39 made of a magnetic material for forming in a deflection magnetic field locally modified non-uniform magnetic fields synchronized with the deflection magnetic field, allows the number of lines 77 of magnetic force to be converged near and on opposite sides of a path of an undeflected electron beam 10 and hence to perform deflection defocusing correction.

In FIG. 17B, the pole pieces 39 are positioned on opposite sides, in the inline direction, of each electron beam 10 in such a manner that the opposed portions of each pole tip 39*a* of the pole piece 39 are positioned in the inline direction of the electron beam 10 for convergence of a magnetic flux at the opposed portions.

In FIG. 17B, reference numeral 78 indicates lines of magnetic force for deflecting an electron beam 10 in the inline direction. The formation of the pole pieces 39 made of a magnetic material for forming in a deflection magnetic field locally modified non-uniform magnetic fields synchronized with the deflection magnetic field, allows the lines 78 of magnetic force to be converged near and on opposite sides of the path of the undeflected electron beam and hence to perform deflection defocusing correction.

This configuration in which portions remote from the electron beam, of the pole piece 39 are tapered, is suitable for the case where the lines 77 of magnetic force of the deflection magnetic field in the direction perpendicular to the in-line direction are required to be increased near portions positioned on opposite sides of the path of the undeflected electron beam, as compared with the configuration shown in FIGS. 15A and 15B.

Figure 18:
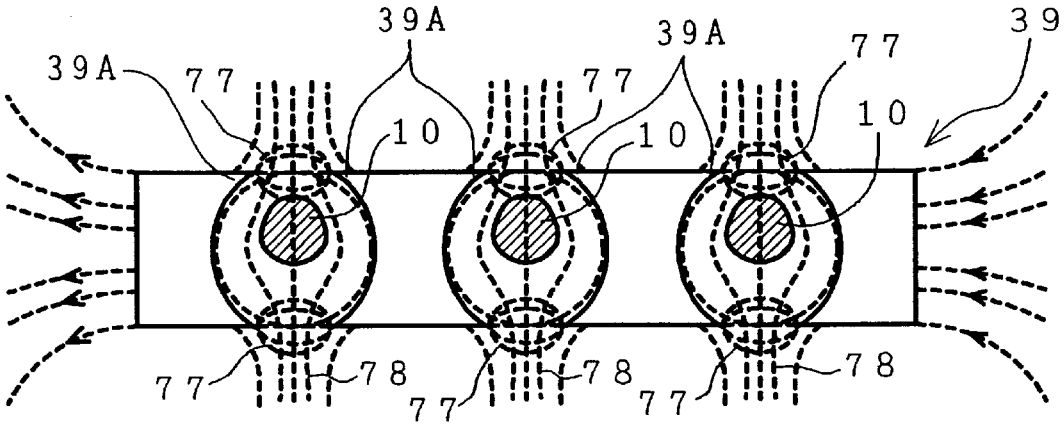
FIG. 18 is a view illustrating in detail a further configuration example of the deflection defocusing pole pieces used for the color cathode ray tube of the three in-line electron beam type of the present invention.

FIG. 18 is a view illustrating a further structure of deflection defocusing correction pole pieces used for a three inline beam type color cathode ray tube of the present invention.

In FIG. 18, the pole pieces 39 are positioned on opposite sides, in the inline direction, of each electron beam 10 in such a manner that the opposed portions of each pole tip 39*a* of the pole piece 39 are positioned in the direction perpendicular to the inline direction of the electron beam 10 for convergence of a magnetic flux at the opposed portions.

In addition, reference numeral 77 in FIG. 18 indicates lines of magnetic force for deflecting the electron beam in the direction perpendicular to the in-line direction. The formation of the pole pieces 39 made of a magnetic material for forming in a deflection magnetic field locally modified non-uniform magnetic fields synchronized with the deflection magnetic field, allows the number of lines 77 of magnetic force to be converged near and on opposite sides of a path of an undeflected electron beam 10 and hence to perform deflection defocusing correction.

Referring to FIG. 18, it is also possible to increase the lines 78 of magnetic force for deflecting the electron beam in the in-line direction near the path of the undeflected electron beams.

Figure 19:
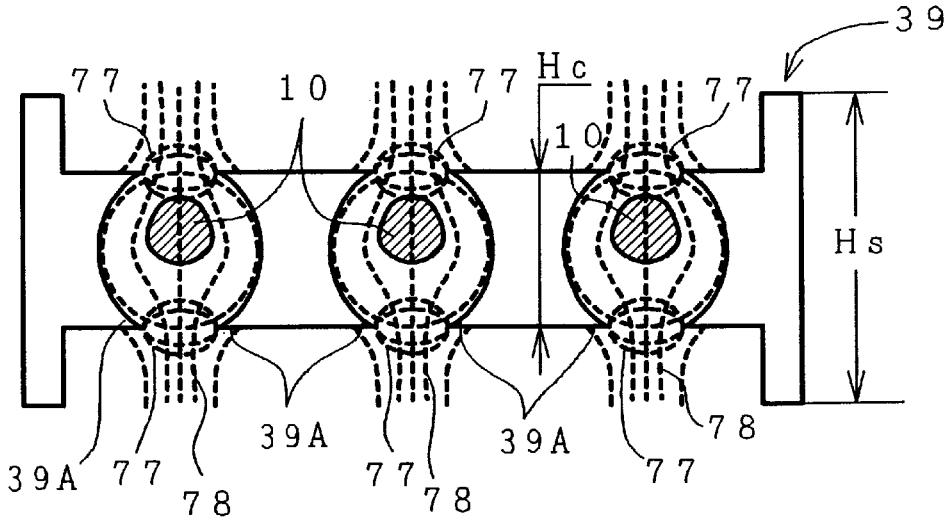
FIG. 19 is a view illustrating in detail a further configuration example of the deflection defocusing pole pieces used for the color cathode ray tube of the three in-line electron beam type of the present invention.

FIG. 19 is a view illustrating a further structure of deflection defocusing correction pole pieces used for a three inline beam type color cathode ray tube of the present invention.

In FIG. 19, the pole pieces 39 are positioned on opposite sides, in the in-line direction, of each electron beam 10 in such a manner that the opposed portions of each pole tip 39*a* of the pole piece 39 are positioned in the direction perpendicular to the inline direction of the electron beam 10 for convergence of a magnetic flux at the opposed portions.

In addition, reference numeral 77 in FIG. 19 indicates lines of magnetic force for deflecting the electron beam in the direction perpendicular to the inline direction. The formation of the pole pieces 39 made of a magnetic material for forming in a deflection magnetic field locally modified non-uniform magnetic fields synchronized with the deflection magnetic field, allows the number of lines 77 of magnetic force to be converged near and on opposite sides of a path of an undeflected electron beam 10 and hence to perform deflection defocusing correction.

The converged amount of the lines 77 of magnetic force can be increased by making larger the length Hs (in the direction perpendicular to the inline direction) of the end portion, on the side near the neck portion from each side electron beam, of the side pole piece than the length Hc of each of the central pole pieces.

Figure 20:
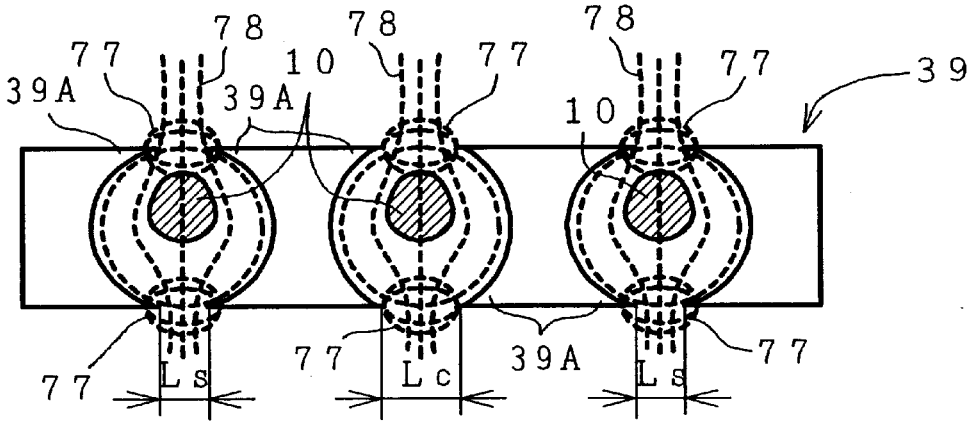
FIG. 20 is a view illustrating in detail a further configuration example of the deflection defocusing pole pieces used for the color cathode ray tube of the three in-line electron beam type of the present invention.

FIG. 20 is a view illustrating a further structure of deflection defocusing correction pole pieces used for a three inline beam type color cathode ray tube of the present invention.

In FIG. 20, the pole pieces 39 are positioned on opposite sides, in the in-line direction, of each electron beam 10 in such a manner that the opposed portions of each pole tip 39*a* of the pole piece 39 are positioned in the direction perpendicular to the inline direction of the electron beam 10 for convergence of a magnetic flux at the opposed portions.

In addition, reference numeral 77 in FIG. 20 indicates lines of magnetic force for deflecting the electron beam in the direction perpendicular to the inline direction. The formation of the pole pieces 39 made of a magnetic material for forming in a deflection magnetic field locally modified non-uniform magnetic fields synchronized with the deflection magnetic field allows the number of lines 77 of magnetic force to be converged near and on opposite sides of a path of an undeflected electron beam 10 and hence to perform deflection defocusing correction.

The intensity of the magnetic field for the center electron beam can be made different from the intensity of the magnetic field for each side electron beam by making an interval Ls between the pole piece tips 39A corresponding to each side electron beam different from an interval Lc between the pole piece tips 39A corresponding to the center electron beam.

Figure 21:
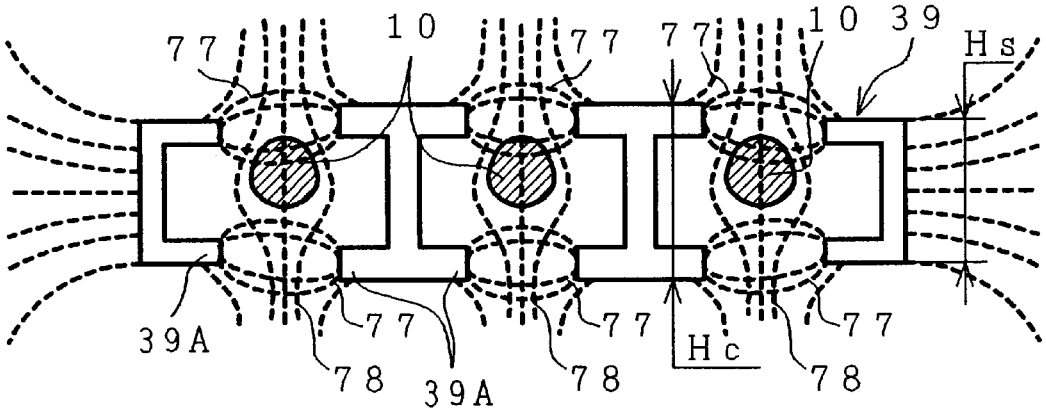
FIG. 21 is a view illustrating in detail a further configuration example of the deflection defocusing pole pieces used for the color cathode ray tube of the three in-line electron beam type of the present invention.

FIG. 21 is a view illustrating a further structure of deflection defocusing correction pole pieces used for a three inline beam type color cathode ray tube of the present invention.

In FIG. 21, the pole pieces 39 are positioned on opposite sides, in the inline direction, of each electron beam 10 in such a manner that the opposed portions of each pole tip 39*a* of the pole piece 39 are positioned in the direction perpendicular to the inline direction of the electron beam 10 for convergence of a magnetic flux at the opposed portions.

In addition, reference numeral 77 in FIG. 21 indicates lines of magnetic force for deflecting the electron beam in the direction perpendicular to the in-line direction. The formation of the pole pieces 39 made of a magnetic material for forming in a deflection magnetic field locally modified non-uniform magnetic fields synchronized with the deflection magnetic field, allows the number of lines 77 of magnetic force to be converged near and on opposite sides of a path of an undeflected electron beam 10 and hence to perform deflection defocusing correction.

The magnetic field for each side electron beam can have a variation in the in-line direction by making the length Hc (in the direction perpendicular to the in-line direction) of the portion, near the center electron beam, of the pole piece for the side electron beam longer than the length Hs of the wall, near the neck portion, of the pole piece for the side electron beam.

Figure 22:
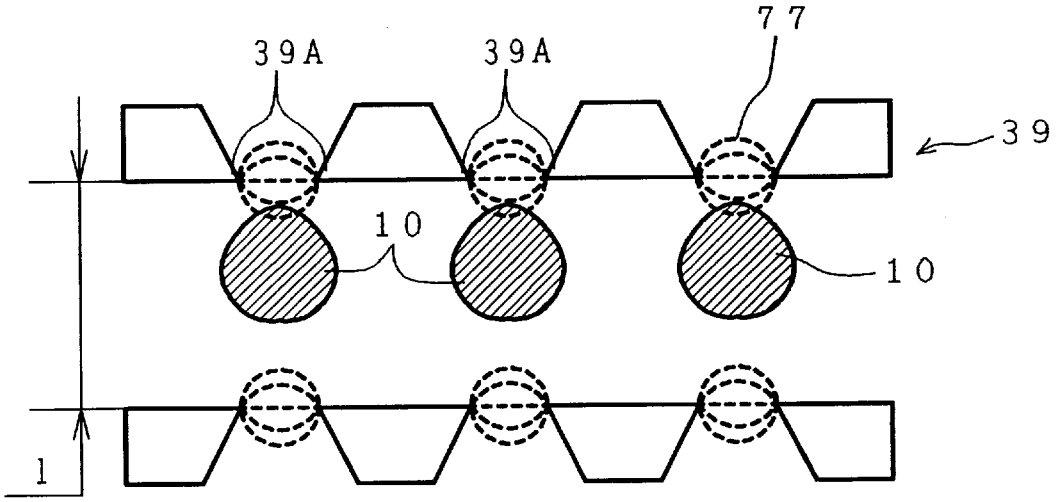
FIG. 22 is a view illustrating in detail a further configuration example of the deflection defocusing pole pieces used for the color cathode ray tube of the three in-line electron beam type of the present invention.

FIG. 22 is a view illustrating a further structure of deflection defocusing correction pole pieces used for a three in-line beam type color cathode ray tube of the present invention.

In FIG. 22, the pole pieces 39 are positioned on opposite sides, in the direction perpendicular to the inline direction, of each electron beam 10 in such a manner that the opposed portions of each pole piece tip 39*a* of the pole piece 39 are positioned in the direction perpendicular to the in-line direction of the electron beam 10 for convergence of a magnetic flux at the opposed portions.

In addition, reference numeral 77 in FIG. 22 indicates lines of magnetic force for deflecting the electron beam in the direction perpendicular to the in-line direction. The formation of the pole pieces 39 made of a magnetic material for forming in a deflection magnetic field locally modified non-uniform magnetic fields synchronized with the deflection magnetic field, allows the number of lines 77 of magnetic force to be converged near portions on opposite sides of a path of an undeflected electron beam 10 and hence to perform deflection defocusing correction.

In addition, reference numeral 77 in FIG. 22 indicates lines of magnetic force acting for deflecting the electron beam 10 in the direction perpendicular to the in-line direction. By the use of the deflection defocusing correction pole piece 39 made of a magnetic material for forming a non-uniform magnetic filed synchronized with the deflection magnetic field in the deflection magnetic field, it is possible to converge the lines 77 of magnetic force near and on opposite sides of the path of the undeflected electron beam 10, and hence to perform the deflection defocusing correction.

Figure 23:
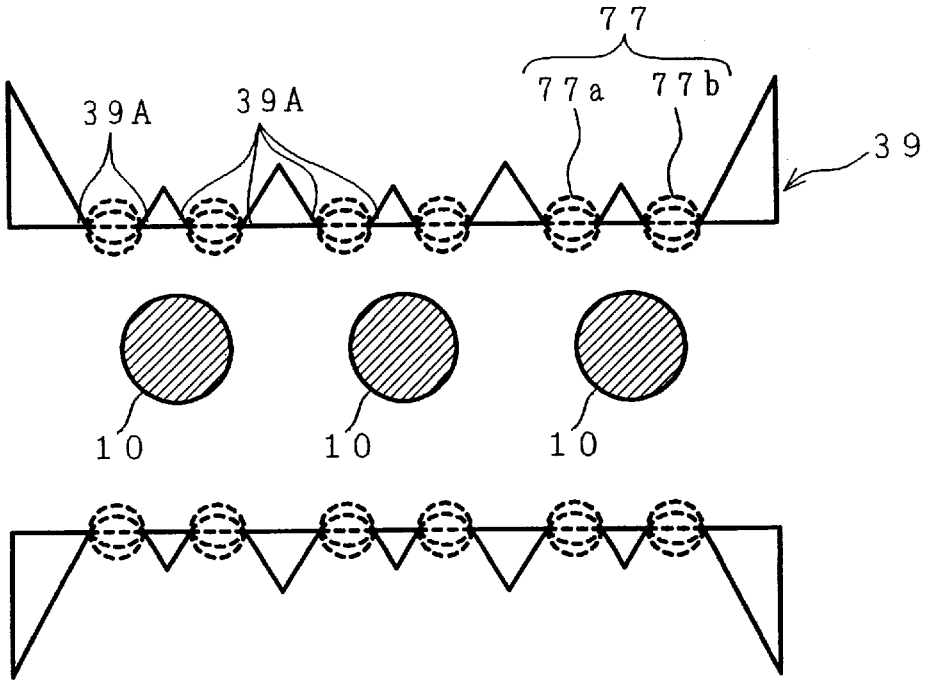
FIG. 23 is a view illustrating in detail a further configuration example of the deflection defocusing pole pieces used for the color cathode ray tube of the three in-line electron beam type of the present invention.

FIG. 23 is a view illustrating a further structure of deflection defocusing correction pole pieces used for a three inline beam type color cathode ray tube of the present invention.

Referring to FIG. 23, opposed portions of pole piece tips 39A of the deflection defocusing correction pole pieces 39 are disposed at two positions slightly spaced from and on opposite sides of a line passing through each undeflected electron beam 10 and perpendicular to the inline direction.

Locally modified non-uniform magnetic fields synchronized with a deflection magnetic field are formed in the deflection magnetic field in such a manner that lines 77*a* and 77*b* of magnetic force are formed at the two positions for deflecting the electron beam 10 in the direction perpendicular to the inline direction, so that the lines 77*a*, 77*b* of magnetic force are converged near and on opposite sides of the path of the undeflected electron beams 10 for correcting deflection defocusing at the portions.

This configuration is suitable for the case where the convergence of a magnetic field for deflection of the beam in the in-line direction is not required.

Figure 24A:
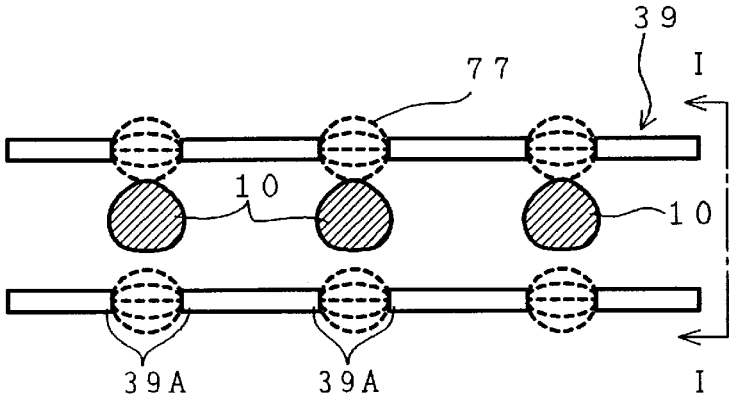
FIGS. 24A and 24B are respectively a front view and a side view illustrating in detail a further configuration example of the deflection defocusing pole pieces used for the color cathode ray tube of the three in-line electron beam type of the present invention.
Figure 24B:
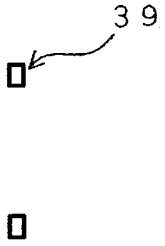

FIGS. 24A and 24B are views illustrating a further structure of deflection defocusing correction pole pieces used for a three inline beam type color cathode ray tube of the present invention; wherein FIG. 24A is a front view and FIG. 24B is a side view along the line I—I viewed in the direction of the arrows.

Referring to FIGS. 24A and 24B, opposed portions of the deflection defocusing correction pole pieces 39 made of a bar material formed in a rectangular shape in cross-section are disposed at positions perpendicular to the inline direction of each electron beam 10 for converging the magnetic flux therebetween.

In addition, reference numeral 77 in FIG. 24A indicates lines of magnetic force acting for deflecting the electron beam 10 in the direction perpendicular to the inline direction. By the use of the deflection defocusing correction magnetic pole piece 39 made of a magnetic material for forming a non-uniform magnetic filed synchronized with the deflection magnetic field in the deflection magnetic field, it is possible to converge the lines 77 of magnetic force near and on opposite sides of the path of the undeflected electron beam 10, and hence to perform the deflection defocusing correction.

Figure 25A:
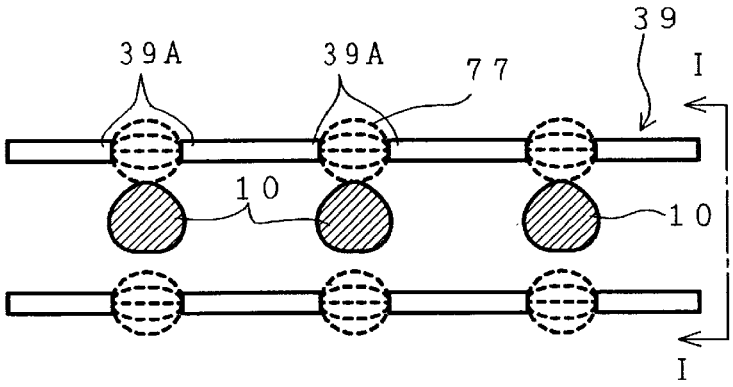
FIGS. 25A and 25B are respectively a front view and a side view illustrating in detail a further configuration example of the deflection defocusing pole pieces used for the color cathode ray tube of the three in-line electron beam type of the present invention.
Figure 25B:
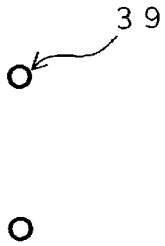

FIGS. 25A and 25B are views illustrating a further structure of deflection defocusing correction pole pieces used for a three inline beam type color cathode ray tube of the present invention; wherein FIG. 25A is a front view and FIG. 25B is a side view along the line I—I viewed in the direction of the arrows.

Referring to FIGS. 25A and 25B, opposed portions of the deflection defocusing correction pole pieces 39 made of a bar material formed in a circular shape in cross-section are disposed at positions perpendicular to the in-line direction of each electron beam 10 for converging the magnetic flux therebetween.

In addition, reference numeral 77 in FIG. 25A indicates lines of magnetic force acting for deflecting the electron beam 10 in the direction perpendicular to the in-line direction. By the use of the deflection defocusing correction magnetic pole piece 39 made of a magnetic material for forming a non-uniform magnetic filed synchronized with the deflection magnetic field in the deflection magnetic field, it is possible to converge the lines 77 of magnetic force near and on opposite sides of the path of the undeflected electron beam 10, and hence to perform the deflection defocusing correction.

This configuration is suitable for the case where convergence of the magnetic field for deflection of the electron beam in the in-line direction is not required.

Figure 26A:
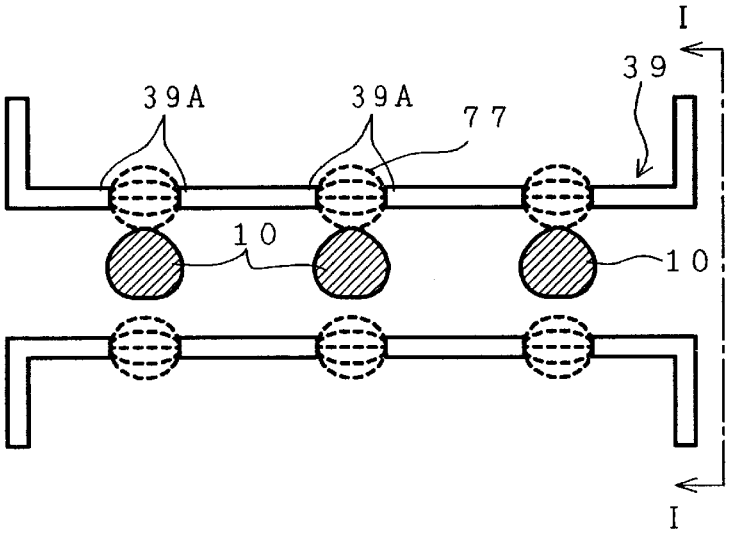
FIGS. 26A and 26B are respectively a front view and a side view illustrating in detail a further configuration example of the deflection defocusing pole pieces used for the color cathode ray tube of the three in-line electron beam type of the present invention.
Figure 26B:
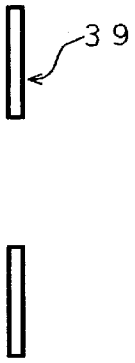

FIGS. 26A and 26B are views illustrating a further structure of deflection defocusing correction pole pieces used for a three in-line beam type color cathode ray tube of the present invention; wherein FIG. 26A is a front view and FIG. 26B is a side view along the line I—I viewed in the direction of the arrows.

Referring to FIGS. 26A and 26B, opposed portions of the deflection defocusing correction pole pieces 39 made of a bar material are disposed at positions perpendicular to the in-line direction of each electron beam 10 for converging the magnetic flux therebetween.

In addition, reference numeral 77 in FIG. 26A indicates lines of magnetic force acting for deflecting the electron beam 10 in the direction perpendicular to the inline direction. By the use of the deflection defocusing correction magnetic pole piece 39 made of a magnetic material for forming a non-uniform magnetic filed synchronized with the deflection magnetic field in the deflection magnetic field, it is possible to converge the lines 77 of magnetic force near and on opposite sides of the path of the undeflected electron beam 10, and hence to perform the deflection defocusing correction.

The convergence of the magnetic flux can be increased by extending the length (in the direction perpendicular to the inline direction) of a portion, on the side near the neck wall from each side electron beam, of the pole piece.

This configuration is suitable for the case where convergence of the magnetic field for deflection of the electron beam in the inline direction is not required.

Figure 27A:
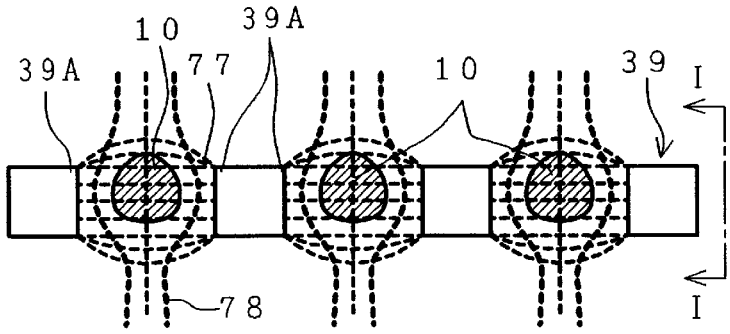
FIGS. 27A and 27B are respectively a front view and a side view illustrating in detail a further configuration example of the deflection defocusing pole pieces used for the color cathode ray tube of the three in-line electron beam type of the present invention.
Figure 27B:
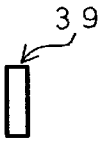

FIGS. 27A and 27B are views illustrating a further structure of deflection defocusing correction pole pieces used for a three in-line beam type color cathode ray tube of the present invention; wherein FIG. 27A is a front view and FIG. 27B is a side view along the line I—I viewed in the direction of the arrows.

Referring to FIGS. 27A and 27B, deflection defocusing correction pole pieces 39 made of a plate material are disposed on opposite sides of each electron beam 10 in the in-line direction for converging a magnetic flux on each electron beam 10.

Namely, by provision of the deflection defocusing correction pole pieces 39 made of a magnetic material for forming in a deflection magnetic field a non-uniform magnetic filed synchronized with the deflection magnetic field, it is possible to form the lines 77 of magnetic force deflecting the electron beam 10 in the direction perpendicular to the in-line direction and lines 78 of magnetic force deflecting the electron beam 10 in the inline direction near and on opposite sides of the path of the undeflected electron beam.

Figure 28A:
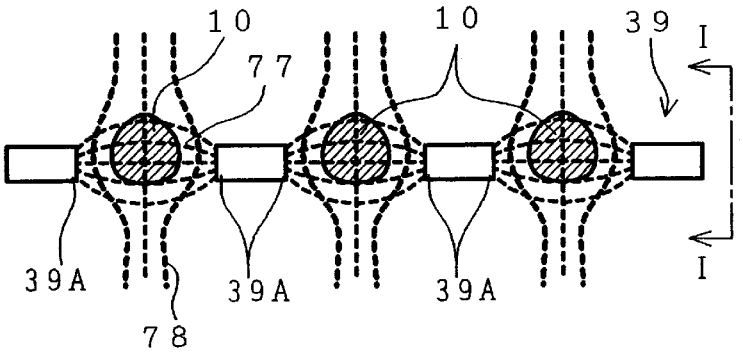
FIGS. 28A and 28B are respectively a front view and a side view illustrating in detail a further configuration example of the deflection defocusing pole pieces used for the color cathode ray tube of the three in-line electron beam type of the present invention.
Figure 28B:
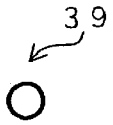

FIGS. 28A and 28B are views illustrating a further structure of deflection defocusing correction pole pieces used for a three in-line beam type color cathode ray tube of the present invention; wherein FIG. 28A is a front view and FIG. 28B is a side view along the line I—I viewed in the direction of the arrows.

Referring to FIGS. 28A and 28B, deflection defocusing correction pole pieces 39 made of a bar material formed in a circular shape in cross-section are disposed on opposite sides of each electron beam 10 in the in-line direction for converging a magnetic flux on each electron beam 10.

Namely, by provision of the deflection defocusing correction pole pieces 39 made of a magnetic material for forming in a deflection magnetic field a non-uniform magnetic filed synchronized with the deflection magnetic field, it is possible to form the lines 77 of magnetic force deflecting the electron beam 10 in the direction perpendicular to the in-line direction and lines 78 of magnetic force deflecting the electron beam 10 in the inline direction near and on opposite sides of the path of the undeflected electron beam.

Figure 29A:
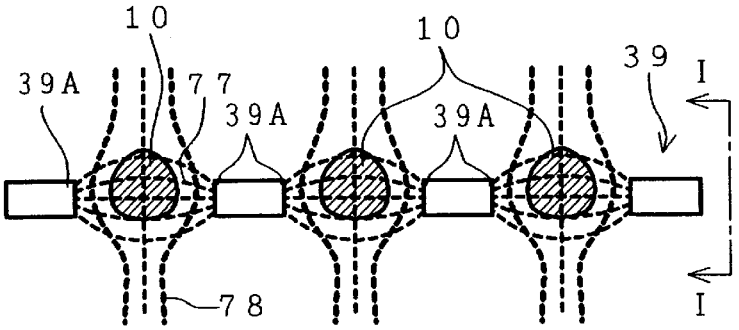
FIGS. 29A and 29B are respectively a front view and a side view illustrating in detail a further configuration example of the deflection defocusing pole pieces used for the color cathode ray tube of the three in-line electron beam type of the present invention.
Figure 29B:
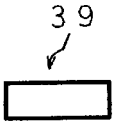

FIGS. 29A and 29B are views illustrating a further structure of deflection defocusing correction pole pieces used for a three in-line beam type color cathode ray tube of the present invention; wherein FIG. 29A is a front view and FIG. 29B is a side view along the line I—I viewed in the direction of the arrows.

Referring to FIGS. 29A and 29B, deflection defocusing correction pole pieces 39 made of a plate material longer along the axial direction of the cathode ray tube are disposed on opposite sides of each electron beam 10 in the inline direction for converging a magnetic flux on each electron beam 10.

Namely, by the use of the deflection defocusing correction magnetic pole piece 39 made of a magnetic material for forming a non-uniform magnetic field synchronized with the deflection magnetic field in the deflection magnetic field, it is possible to form lines 77 of magnetic force deflecting the electron beam 10 in the direction perpendicular to the inline direction and lines 78 of magnetic force deflecting the electron beam 10 in the inline direction near and on opposite sides of the trajectory of the undeflected electron beam.

Figure 30:
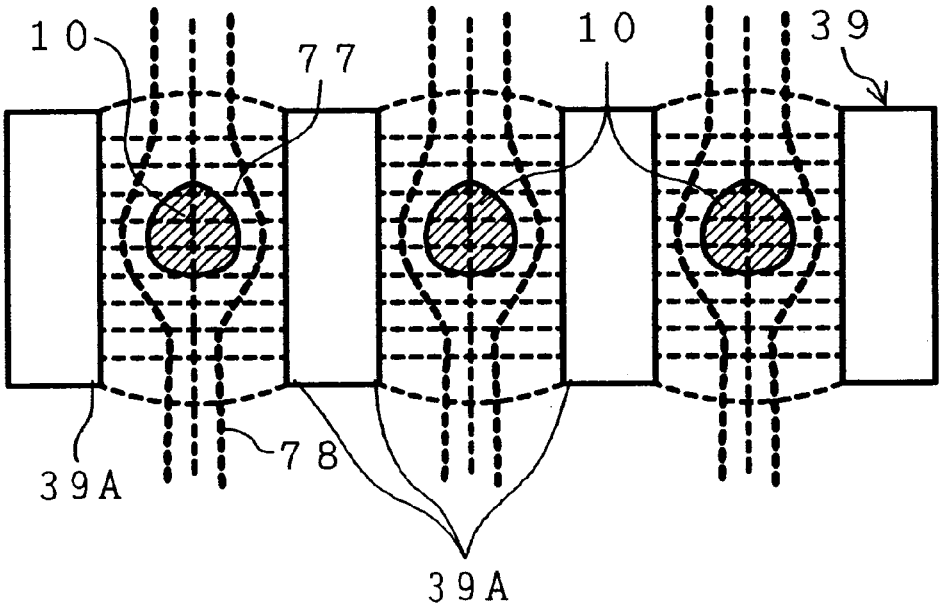
FIG. 30 is a view illustrating in detail a further configuration example of the deflection defocusing pole pieces used for the color cathode ray tube of the three in-line electron beam type of the present invention.

FIG. 30 is a view illustrating a further structure of deflection defocusing correction pole pieces used for a three inline beam type color cathode ray tube of the present invention.

Referring to FIG. 30, deflection defocusing correcting magnetic pole pieces 39 made of a plate material longer along the direction perpendicular to the inline direction are disposed on opposite sides of each electron beam 10 in the inline direction for converging a magnetic flux on each electron beam 10.

Namely, by provision of the deflection defocusing correction pole pieces 39 made of a magnetic material for forming in a deflection magnetic field a non-uniform magnetic field synchronized with the deflection magnetic field, and by homogeneously distributing lines 77 of magnetic force synchronized with the deflection magnetic field near and on opposite sides of the path of the undeflected electron beam 10, the deflection correction at the portion is corrected.

In addition, lines 78 of magnetic field deflect the electron beam 10 in the inline direction.

Figure 31:
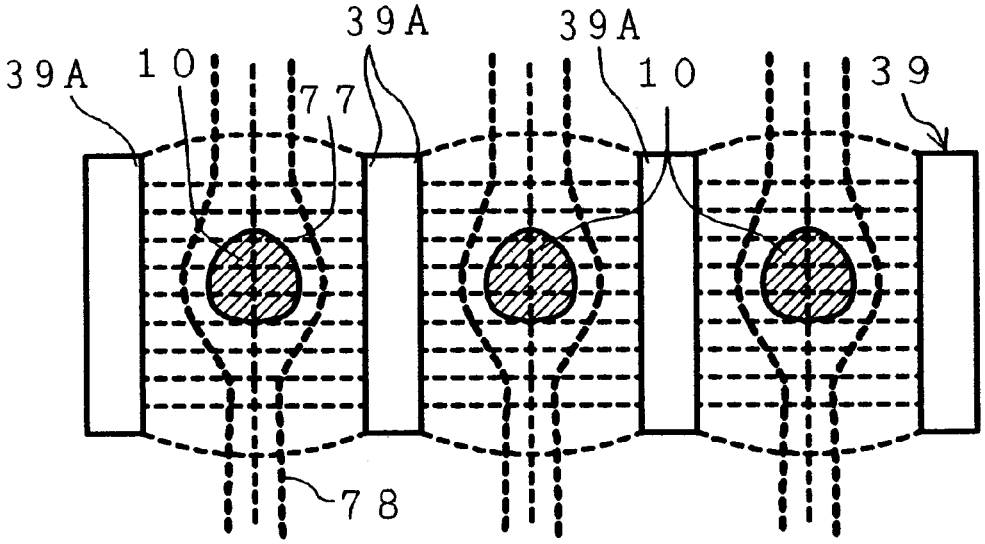
FIG. 31 is a view illustrating in detail a further configuration example of the deflection defocusing pole pieces used for the color cathode ray tube of the three in-line electron beam type of the present invention.

FIG. 31 is a view illustrating a further structure of deflection defocusing correction pole pieces used for a three inline beam type color cathode ray tube of the present invention.

Referring to FIG. 31, deflection defocusing correction c pole pieces 39 made of a narrow width plate material longer in the direction perpendicular to the inline direction are disposed on opposite sides of each electron beam 10 in the inline direction for converging a magnetic flux on each electron beam 10.

Namely, by provision of the deflection defocusing correction pole pieces 39 made of a magnetic material for forming in a deflection magnetic field a non-uniform magnetic filed synchronized with the deflection magnetic field, and by homogeneously distributing lines 77 of magnetic force synchronized with the deflection magnetic field near and on opposite sides of the path of the undeflected electron beam 10, the deflection correction at the portion is corrected.

In addition, lines 78 of magnetic field deflect the electron beam 10 in the inline direction.

Figure 32:
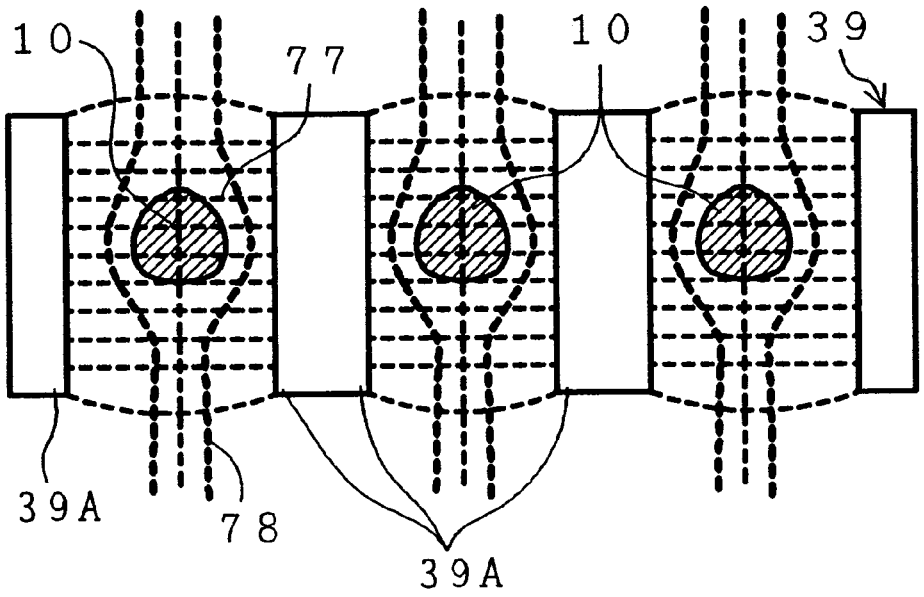
FIG. 32 is a view illustrating in detail a further configuration example of the deflection defocusing pole pieces used for the color cathode ray tube of the three in-line electron beam type of the present invention.

FIG. 32 is a view illustrating a further structure of deflection defocusing correction pole pieces used for a three inline beam type color cathode ray tube of the present invention.

Referring to FIG. 32, deflection defocusing correction pole pieces 39 made of a plate material longer in the direction perpendicular to the inline direction are disposed on opposite sides of each electron beam 10 in the inline direction, and the width of the pole piece positioned on each side of the center electron beam is larger than the width of the pole piece positioned near the neck wall from each side electron beam, so that a magnetic flux is converged on each electron beam 10.

Namely, by provision of the deflection defocusing correction pole pieces 39 made of a magnetic material for forming in a deflection magnetic field a non-uniform magnetic filed synchronized with the deflection magnetic field, and by homogeneously distributing lines 77 of magnetic force particularly acting on the center electron beam and synchronized with the deflection magnetic field near and on opposite sides of the path of the undeflected electron beam 10, the deflection correction at the portion is corrected.

In addition, lines 78 of magnetic field deflect the electron beam 10 in the in-line direction.

The width relationship of the four pole pieces 39 may be reversed for obtaining a more homogeneous distribution of the lines 77 of magnetic force particularly acting on each side electron beam.

Figure 33:
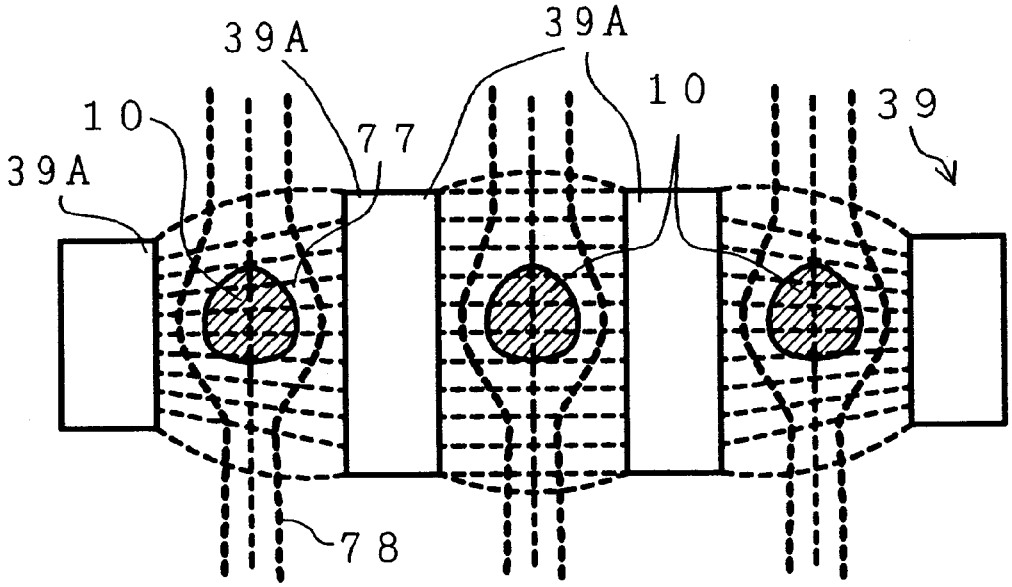
FIG. 33 is a view illustrating in detail a further configuration example of the deflection defocusing pole pieces used for the color cathode ray tube of the three in-line electron beam type of the present invention.

FIG. 33 is a view illustrating a further structure of deflection defocusing correction pole pieces used for a three inline beam type color cathode ray tube of the present invention.

Referring to FIG. 33, deflection defocusing correction pole pieces 39 made of a plate material longer in the direction perpendicular to the in-line direction are disposed on opposite sides of each electron beam 10 in the inline direction, for converging a magnetic flux on each electron beam 10.

Reference numeral 77 indicates lines of magnetic force deflecting the electron beam 10 in the direction perpendicular to the in-line direction; and 78 is lines of magnetic force deflecting the electron beam 10 in the inline direction.

The length of the pole piece on each side of the center electron beam is made longer than the length of the pole piece positioned on the neck wall side from each side electron beam. This makes it possible to make homogeneous the lines 77 of magnetic force acting on the central electron beam, and to make dense and homogeneous the lines 77 of magnetic force, on the neck wall side, acting on each side electron beam.

The length relationship of the four pole pieces 39 may be reversed for obtaining a more homogeneous distribution of the lines 77 of magnetic force particularly acting on each side electron beam.

Figure 34:
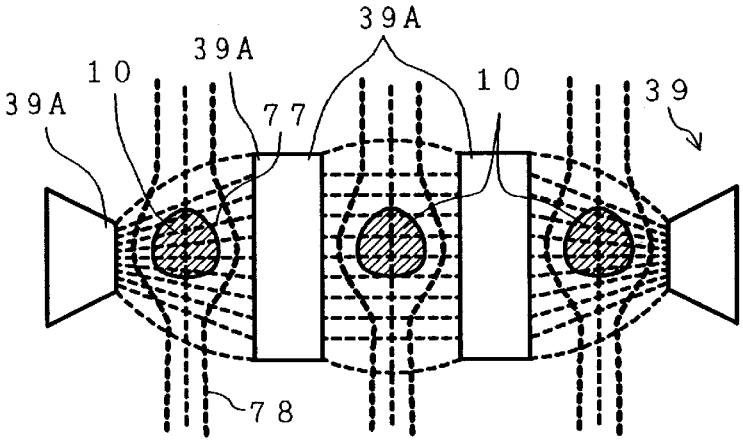
FIG. 34 is a view illustrating in detail a further configuration example of the deflection defocusing pole pieces used for the color cathode ray tube of the three in-line electron beam type of the present invention.

FIG. 34 is a view illustrating a further structure of deflection defocusing correction pole pieces used for a three inline beam type color cathode ray tube of the present invention.

Referring to FIG. 34, deflection defocusing correction pole pieces 39 made of a plate material longer in the direction perpendicular to the inline direction are disposed on opposite sides of each electron beam 10 in the inline direction, for converging a magnetic flux on each electron beam 10.

Reference numeral 77 indicates lines of magnetic force deflecting the electron beam 10 in the direction perpendicular to the inline direction; and 78 is lines of magnetic force deflecting the electron beam 10 in the inline direction.

The length of the pole piece on each side of the center electron beam is made longer than the length of the pole piece positioned on the neck wall side from each side electron beam, and the length of a portion, on the electron beam side, of the pole piece positioned on the neck wall side from each side electron beam is shortened.

With this configuration, it is possible to obtain a more dense and nonhomogeneous distribution of the lines 77 of magnetic force, on the neck wall side, acting on each side electron beam, as compared with the configuration shown in FIG. 33.

The shape relationship of the four magnetic pole pieces 39 may be reversed for obtaining a magnetic field distribution different from that described above.

Figure 35A:
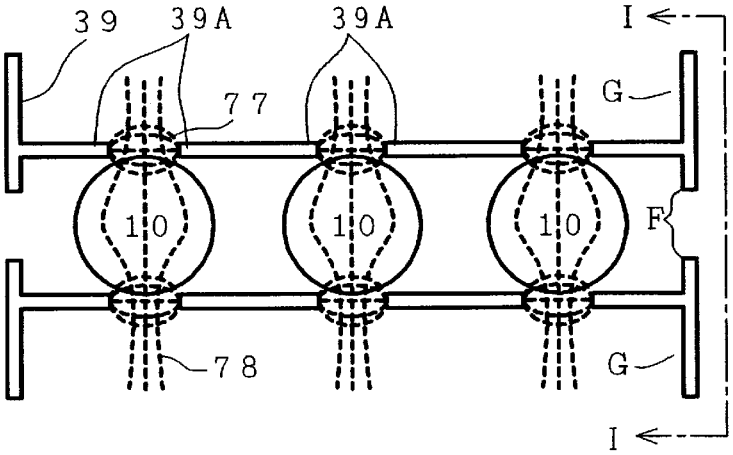
FIGS. 35A and 35B are respectively a front view and a side view illustrating in detail a further configuration example of the deflection defocusing pole pieces used for the color cathode ray tube of the three in-line electron beam type of the present invention.
Figure 35B:
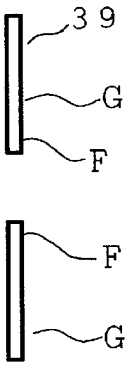

FIGS. 35A and 35B are views illustrating a further structure of deflection defocusing correction pole pieces used for a three inline beam type color cathode ray tube of the present invention.

FIG. 35A is a front view and FIG. 35B is a side view along the line I—I viewed in the direction of the arrows.

Referring to FIGS. 35A and 35B, opposed portions of pole piece tips 39A of deflection defocusing correction pole pieces 39 made of a bar material longer in the direction perpendicular to the inline direction are disposed in the direction perpendicular to the inline direction of each electron beam 10 for converging a magnetic flux for deflection of the electron beam in the direction perpendicular to the inline direction.

Reference numeral 77 indicates lines of magnetic force deflecting the electron beam 10 in the direction perpendicular to the inline direction; and 78 is lines of magnetic force deflecting the electron beam 10 in the inline direction.

The pole piece positioned on the neck wall side from each side electron beam has a portion F extending toward the the beam inline plane along the direction perpendicular to the inline direction, and a portion G extending in the reversed direction from the portion F.

With this configuration, the portion F can increase the magnetic flux density, near the neck wall, of the magnetic field acting on each side of the beam in the for deflection of the electron beam magnetic field deflected in the in-line direction; and the portion G can increase the deflection defocusing correction magnetic field in the direction perpendicular to the inline direction.

Figure 36:
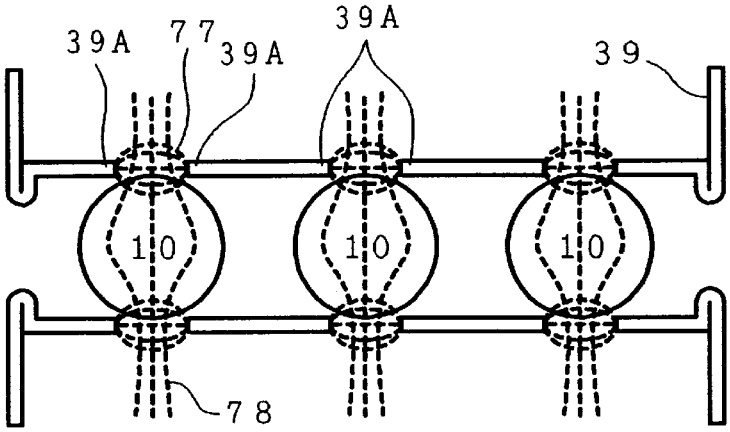
FIG. 36 is a view illustrating in detail a further configuration example of the deflection defocusing pole pieces used for the color cathode ray tube of the three in-line electron beam type of the present invention.

FIGS. 36 is a view illustrating a further structure of deflection defocusing correction pole pieces used for a three inline beam type color cathode ray tube of the present invention. In this configuration, the pole piece on the neck wall side of the structure in FIGS. 35A and 35B is made of a bent bar material. The effect of this configuration is the same as that shown in FIGS. 35A and 35B.

Figure 37A:
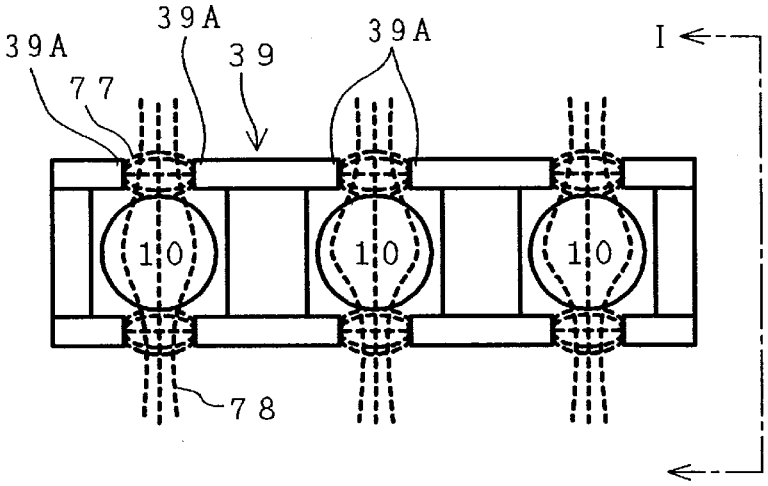
FIGS. 37A and 37B are respectively a front view and a side view illustrating in detail a further configuration example of the deflection defocusing pole pieces used for the color cathode ray tube of the three inline electron beam type of the present invention.
Figure 37B:
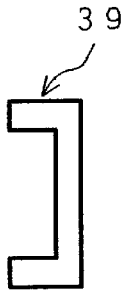

FIGS. 37A and 37B are views illustrating a further structure of deflection defocusing correction pole pieces used for a three in-line beam type color cathode ray tube of the present invention; wherein FIG. 37A is a front view and FIG. 37B is a side view along the line I—I viewed in the direction of the arrows.

Referring to FIGS. 37A and 37B, deflection defocusing correction pole pieces 39 are positioned on opposite sides of each electron beam 10 in the in-line direction, and the opposed portions of the pole piece tips 39A are disposed in the direction perpendicular to the in-line direction of the electron beam 10 and project at the end portions in the axial direction of the cathode ray tube.

Reference numeral 77 indicates lines of magnetic force deflecting the electron beam 10 in the direction perpendicular to the in-line direction; and 78 is lines of magnetic force deflecting the electron beam 10 in the inline direction.

By provision of the pole pieces 39 having such a configuration for forming in a deflection magnetic field a locally modified non-uniform magnetic field synchronized with the deflection magnetic field, it is possible to extend the range of the locally modified non-uniform magnetic field in the axial direction of the cathode ray tube, and hence to improve the correction sensitivity of the deflection defocusing.

Figure 38:
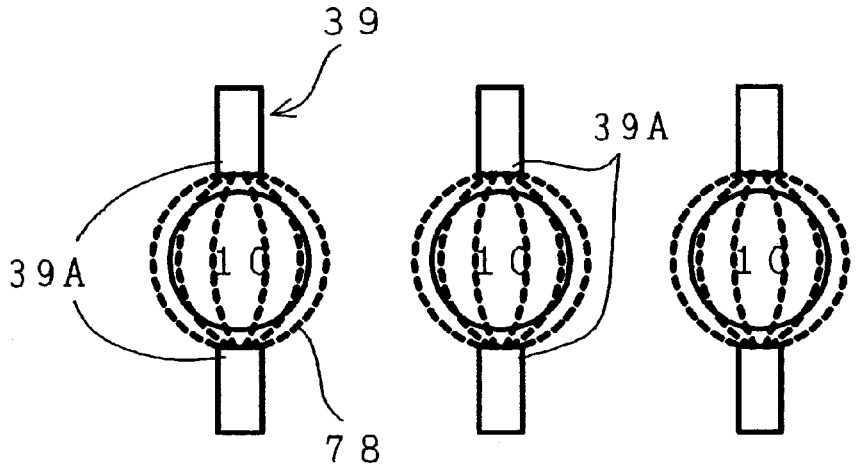
FIG. 38 is a view illustrating in detail a further configuration example of the deflection defocusing pole pieces used for the color cathode ray tube of the three in-line electron beam type of the present invention.

FIG. 38 is a view illustrating a further structure of deflection defocusing correction pole pieces used for a three in-line beam type color cathode ray tube of the present invention, and particularly illustrating lines of magnetic force for defocusing correction by horizontal deflection.

Referring to FIG. 38, opposed portions of pole piece tips 39A of magnetic pole pieces 39 are disposed in the direction perpendicular to the inline direction of each electron beam 10 for converging a magnetic flux between the opposed portions, thereby correcting deflection defocusing.

Figure 39:
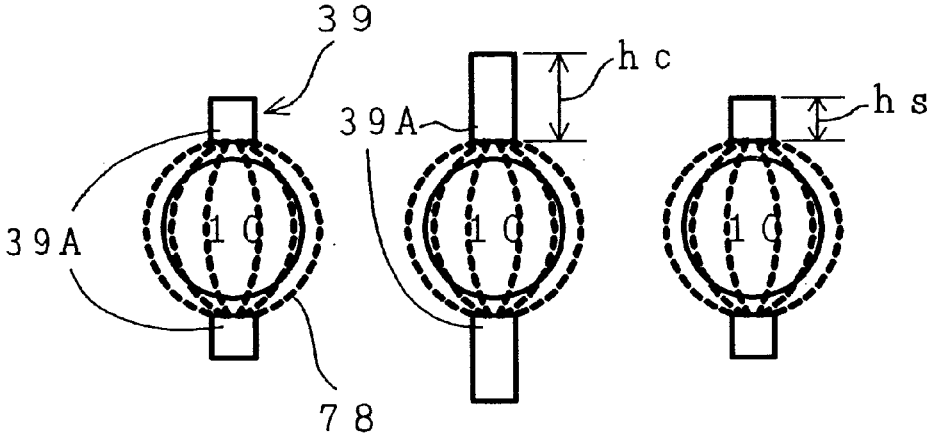
FIG. 39 is a view illustrating in detail a further configuration example of the deflection defocusing pole pieces used for the color cathode ray tube of the three in-line electron beam type of the present invention.

FIG. 39 is a view illustrating a further structure of deflection defocusing correction pole pieces used for a three in-line beam type color cathode ray tube of the present invention, and particularly illustrating lines of magnetic force for defocusing correction by horizontal deflection.

Referring to FIG. 39, opposed portions of pole piece tips 39A of pole pieces 39 are disposed in the direction perpendicular to the in-line direction of each electron beam 10 for converging a magnetic flux between the opposed portions, thereby correcting deflection defocusing.

When the center electron gun is different from each side electron gun in the amount of deflection defocusing, the converged amount of the magnetic flux is changed by specifying the length of the pole piece in the direction perpendicular to the inline direction at a value required for the electron gun, thereby suitably controlling the correction amount in each electron gun.

Figure 40:
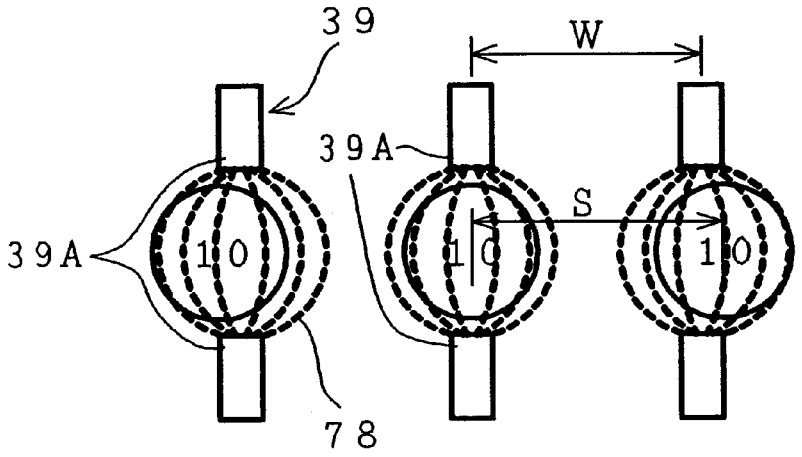
FIG. 40 is a view illustrating in detail a further configuration example of the deflection defocusing pole pieces used for the color cathode ray tube of the three in-line electron beam type of the present invention.

FIG. 40 is a view illustrating a further structure of deflection defocusing correction pole pieces used for a three in-line beam type color cathode ray tube of the present invention, and particularly illustrating lines of magnetic force for defocusing correction by horizontal deflection.

Referring to FIG. 40, opposed portions of pole piece tips 39A of pole pieces 39 are disposed in the direction perpendicular to the in-line direction of each electron beam 10 for converging a magnetic flux between the opposed portions, thereby correcting deflection defocusing.

When a horizontal diverging state of an electron beam of an each side electron gun differs between on the center electron gun side and on the opposed side, the diverging state can be suitably controlled by changing each distance between the electron guns and each distance W between the pole pieces 39.

Figure 41:
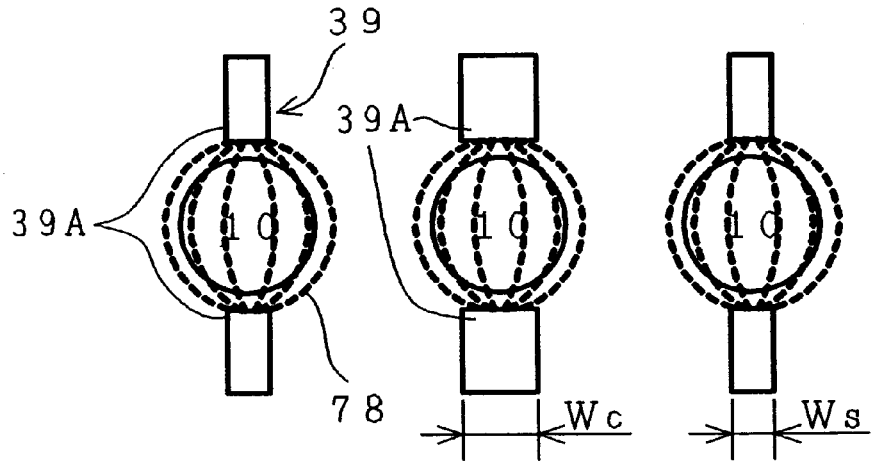
FIG. 41 is a view illustrating in detail a further configuration example of the deflection defocusing pole pieces used for the color cathode ray tube of the three in-line electron beam type of the present invention.

FIG. 41 is a view illustrating a further structure of deflection defocusing correction pole pieces used for a three inline beam type color cathode ray tube of the present invention, and particularly illustrating lines of magnetic force for defocusing correction by horizontal deflection.

Referring to FIG. 41, opposed portions of pole piece tips 39A of pole pieces 39 are disposed in the direction perpendicular to the in-line direction of each electron beam 10 for converging a magnetic flux between the opposed portions, thereby correcting deflection defocusing.

When horizontal diverging states of an electron beam of side electron guns are different from each other, the diverging state can be suitably controlled by changing the length of the pole piece for each electron gun in the inline direction.

Figure 42:
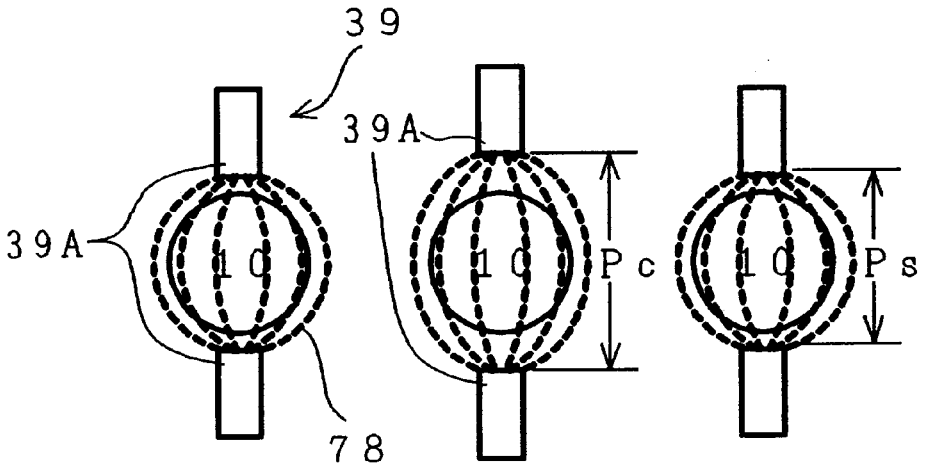
FIG. 42 is a view illustrating in detail a further configuration example of the deflection defocusing pole pieces used for the color cathode ray tube of the three in-line electron beam type of the present invention.

FIG. 42 is a view illustrating a further structure of deflection defocusing correction pole pieces used for a three inline beam type color cathode ray tube of the present invention, and particularly illustrating lines of magnetic force for defocusing correction by horizontal deflection.

Referring to FIG. 42, opposed portions of pole piece tips 39A of pole pieces 39 are disposed in the direction perpendicular to the in-line direction of each electron beam 10 for converging a magnetic flux between the opposed portions, thereby correcting deflection defocusing.

When a horizontal diverging state of an electron beam differs between an each side electron gun and the center electron gun, the diverging state can be suitably adjusted by changing the lengths Pc and Ps of the opposed portions of the pole piece tips 39A corresponding to each electron gun.

Figure 43:
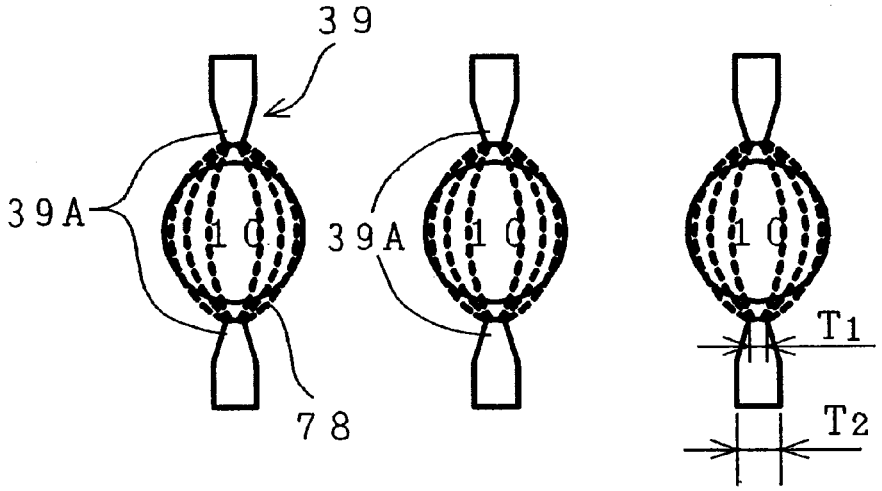
FIG. 43 is a view illustrating in detail a further configuration example of the deflection defocusing pole pieces used for the color cathode ray tube of the three in-line electron beam type of the present invention.

FIG. 43 is a view illustrating a further structure of deflection defocusing correction pole pieces used for a three in-line beam type color cathode ray tube of the present invention, and particularly illustrating lines of magnetic force for defocusing correction by horizontal deflection.

Referring to FIG. 43, opposed portions of pole piece tips 39A of pole pieces 39 are disposed in the direction perpendicular to the in-line direction of each electron beam 10 for converging a magnetic flux between the opposed portions, thereby correcting deflection defocusing.

The convergence state of a magnetic flux can be suitably controlled by changing the length of the pole piece 39 in the in-line direction between on the opposed portion side of the pole piece tip 39A and on the side remote from the opposed portion side.

Figure 44A:
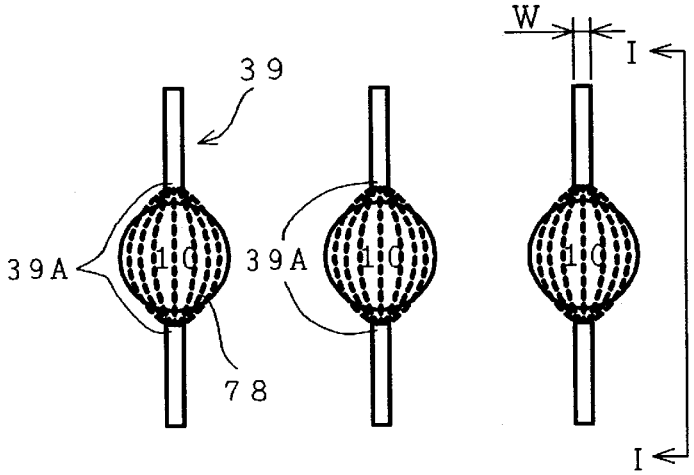
FIGS. 44A and 44B are respectively a front view and a side view illustrating in detail a further configuration example of the deflection defocusing pole pieces used for the color cathode ray tube of the three in-line electron beam type of the present invention.
Figure 44B:
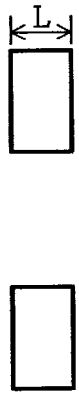

FIG. 44A is a front view and FIG. 44B is a side view along the line I—I viewed in the direction of the arrows.

FIGS. 44A and 44B are views illustrating a further structure of deflection defocusing correction pole pieces used for a three inline beam type color cathode ray tube of the present invention, and particularly illustrating lines of magnetic force for defocusing correction by horizontal deflection.

Referring to FIGS. 44A and 44B, opposed portions of pole piece tips 39A of pole pieces 39 are disposed in the direction perpendicular to the inline direction of each electron beam 10 for converging a magnetic flux between the opposed portions, thereby correcting deflection defocusing.

The correction amount in the horizontal direction can be increased while suppressing the effect on the vertical deflection magnetic field by shortening the length of the magnetic pole piece in the inline direction and extending the length L of the pole piece in the axial direction for forming, near the center of the electron beam, a magnetic field in which the density is high and is longer in length acting on the electron beam.

FIG. 45A and 45B, 46A and 46B, and 47A and 47B are views each illustrating a further structure of deflection defocusing correction pole pieces used for a three inline beam type color cathode ray tube of the present invention, and particularly illustrating lines of magnetic force for defocusing correction by horizontal deflection.

Figure 45A:
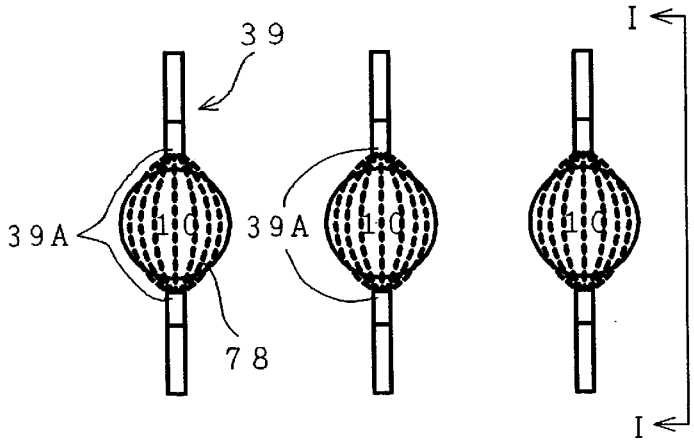
FIGS. 45A and 45B are respectively a front view and a side view illustrating in detail a further configuration example of the deflection defocusing pole pieces used for the color cathode ray tube of the three in-line electron beam type of the present invention.
Figure 45B:
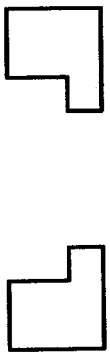
Figure 46A:
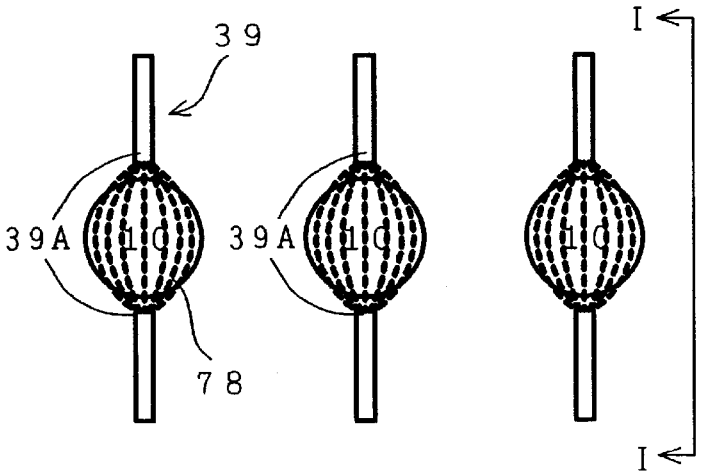
FIGS. 46A and 46B are respectively a front view and a side view illustrating in detail a further configuration example of the deflection defocusing pole pieces used for the color cathode ray tube of the three in-line electron beam type of the present invention.
Figure 46B:
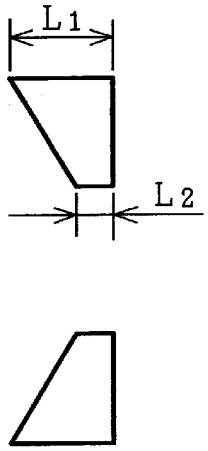
Figure 47A:
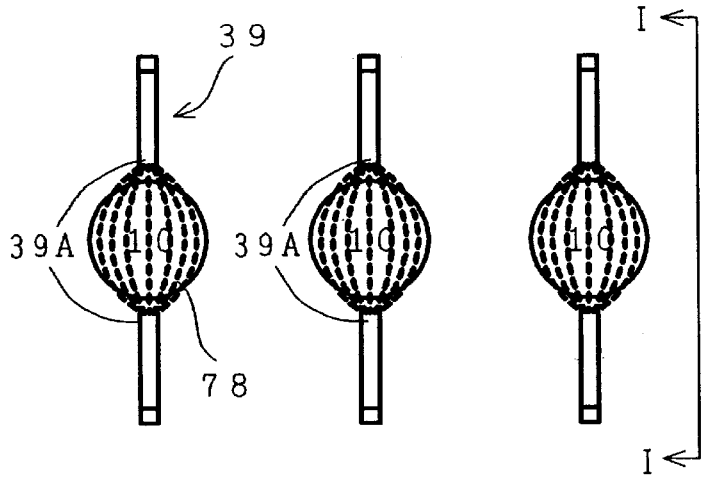
FIGS. 47A and 47B are respectively a front view and a side view illustrating in detail a further configuration example of the deflection defocusing pole pieces used for the color cathode ray tube of the three in-line electron beam type of the present invention.
Figure 47B:
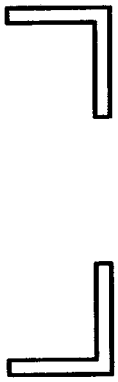

FIGS. 45A, 46A and 47A are front views and FIGS. 45B, 46B abd 47B are side views along the line I—I viewed in the direction of the arrows, respectively.

Referring to these figures, opposed portions of pole piece tips 39A of pole pieces 39 are disposed in the direction perpendicular to the inline direction of each electron beam 10 for converging a magnetic flux between the opposed portions, thereby correcting deflection defocusing.

The correction amount in the horizontal direction can be increased while suppressing the effect on the vertical deflection magnetic field by shortening the length of the pole piece in the in-line direction and, extending the length of the pole piece in the axial direction longer at the portion remote from the beam inline plane than at the portion near the beam inline plane for forming a high magnetic field near the center of the electron beam.

Figure 48A:
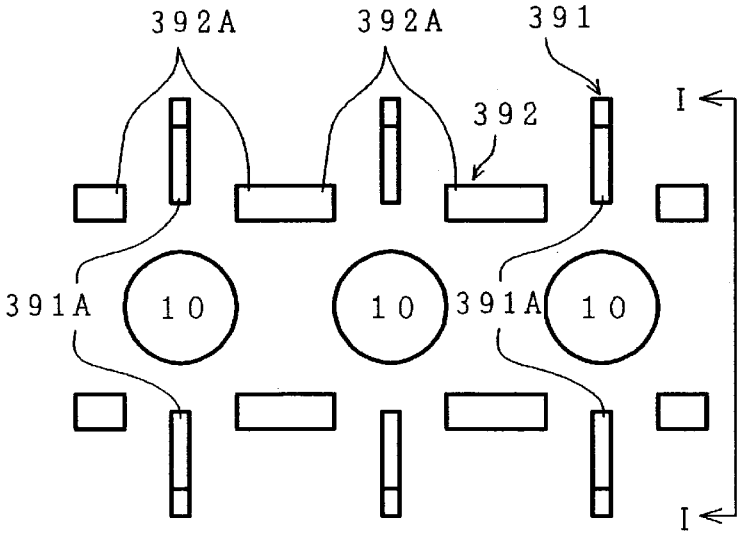
FIGS. 48A and 48B are respectively a front view and a side view illustrating in detail a further configuration example of the deflection defocusing pole pieces used for the color cathode ray tube of the three in-line electron beam type of the present invention.
Figure 48B:
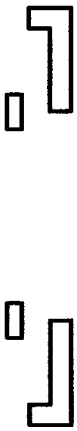

FIG. 48A and 48B are views illustrating a further structure of deflection defocusing correction pole pieces used for a three inline beam type color cathode ray tube of the present invention, and particularly illustrating lines of magnetic force for defocusing correction by vertical deflection and horizontal deflection.

FIG. 48A is a front view and FIG. 48B is a side view along the line I—I viewed in the direction of the arrows.

Referring to these figures, opposed portions of pole piece tips 391A of pole pieces 391 are disposed in the direction perpendicular to the inline direction of each electron beam 10 for converging a magnetic flux between the opposed portions, thereby correcting deflection defocusing.

The correction amount in the horizontal direction can be increased while suppressing the effect on the vertical deflection magnetic field by shortening the length of the pole piece in the inline direction and, extending the length of the pole piece in the axial direction longer at the portion remote from the beam inline plane than at the portion near the beam inline plane for forming a high magnetic field near the center of the electron beam.

Each interval between the opposed portions of the pole piece tips 391A of the pole pieces 391 is also disposed in the direction perpendicular to the in-line direction of each electron beam 10, to converge a magnetic flux between the opposed portions of the pole tip 391A, thereby further correcting the deflection defocusing in the vertical direction.

The correction amount in the vertical direction can be increased while suppressing the effect on the horizontal deflection magnetic field by shortening the length of the pole piece 39 in the direction perpendicular to the inline direction.

Moreover, the axial positions of the pole pieces corresponding to each deflection magnetic field are made different from each other for further reducing the mutual effect of the horizontal and vertical deflection magnetic fields.

FIGS. 84A, 84B to 89A and 89B, each shows a combination example of pole pieces 39 having various shapes and a pole piece support 105. In these examples, it is desirable to satisfy the relationship of H>W.

Figure 49A:
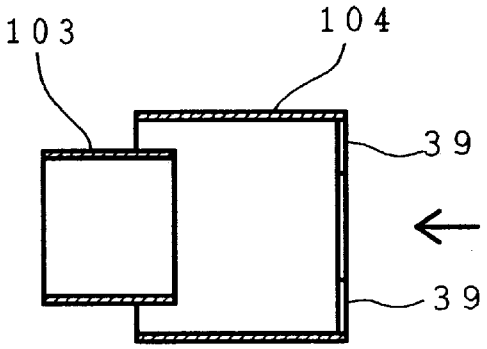
FIGS. 49A to 49C are respectively a sectional view, a front view and a perspective view of a main lens portion of a configuration example of a single electron beam type electron gun for a cathode ray tube to which the present invention is applied.
Figure 49B:
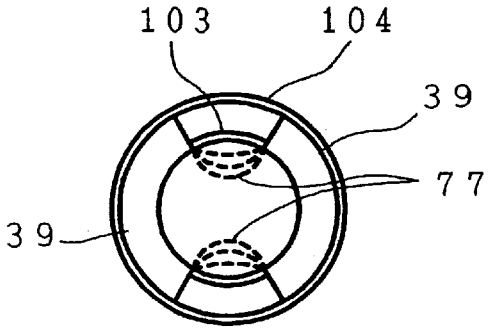
Figure 49C:
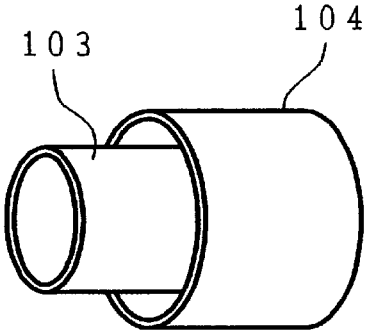

FIGS. 49A to 49C are views illustrating a main lens portion of a single beam type electron gun of a cathode ray tube to which the present invention is applied, wherein FIG. 49A is a sectional view, FIG. 49B is a front view seen from the direction of the arrow of FIG. 49A, and FIG. 49C is a perspective view.

Referring to these figures, the diameter of an anode 104 is formed to be larger than that of a focus electrode 103. Such an electrode structure allows the aperture of the main lens to be increased. This increases the diameter of an electron beam passing through the main lens, to make small the diameter of a beam spot at the central portion of the screen of the cathode ray tube, resulting in high resolution.

When the diameter of an electron beam when passing through the main lens is increased, an effect of deflection defocusing due to a change in the distance between the main lens and the phosphor screen with deflection is increased, as a result of which the improvement in resolution at the screen center and the reduction in the deflection defocusing are incompatible with each other.

According to the present invention, the deflection defocusing correction pole pieces 39 are disposed to form a magnetic field for diverging an electron beam in accordance with a deflection amount. In these figures, a magnetic field for diverging an electron beam in the vertical direction is formed in accordance with the magnetic field deflecting the electron beam in the vertical direction.

Figure 50A:
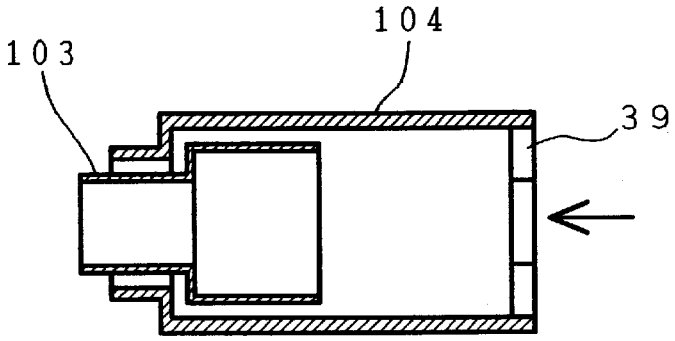
FIGS. 50A to 50C are respectively a sectional view, a front view and a perspective view of a main lens portion of another configuration example of the single electron beam type electron gun for a cathode ray tube to which the present invention is applied.
Figure 50B:
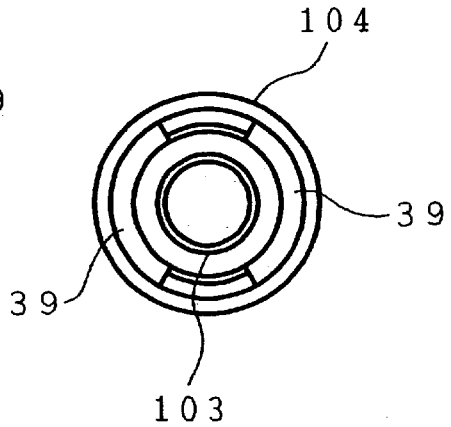
Figure 50C:
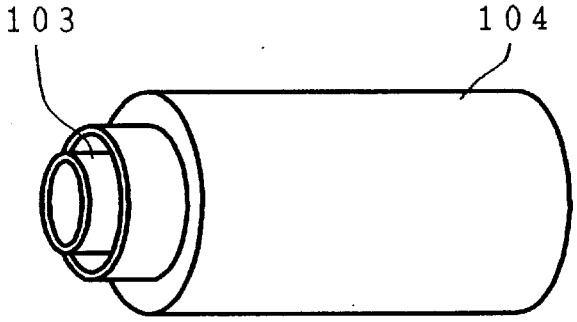

FIGS. 50A to 50C are views illustrating another main lens portion of a single beam type electron gun of a cathode ray tube to which the present invention is applied, wherein FIG. 50A is a sectional view, FIG. 50B is a front view seen in the direction of the arrow of FIG. 50A, and FIG. 50C is a perspective view.

The basic operation of this configuration is the same as that shown in FIGS. 49A to 49C except for the structure of electrodes forming the main lens.

Figure 51:
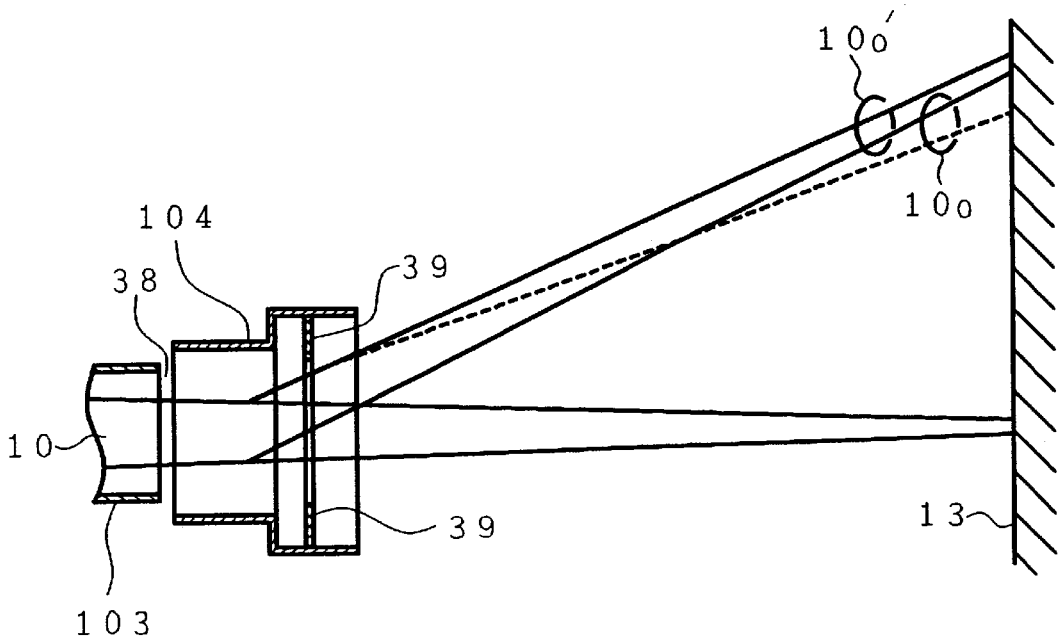
FIG. 51 is a view of an electron gun essential portion illustrating the trajectory of an electron beam in the case where the diameter of an anode electrode is larger than that of a focus electrode among the electrodes forming the main lens shown in FIGS. 49A to 49C and FIGS. 50A to 50C.

FIGS. 51 and 52 are views illustrating the essential portion of an electron gun and the trajectory of an electron beam in the case where the diameter of an anode 104 forming the main lens is larger than a focus electrode 103 as shown in FIGS. 49A to 49C and FIGS. 50A to 50C.

In these figures, focusing for the central portion of the screen is optimized with no deflection magnetic field. The deflected electron beam is focussed in front of the screen as shown by the reference numeral $\mathbf{10}_0$ in the case where the deflection defocusing correction pole pieces are not provided.

On the contrary, the electron beam is optimally focused on the screen as shown by the reference numeral $\mathbf{10}_0'$ in the case where the pole pieces 39 are provided.

Figure 53:
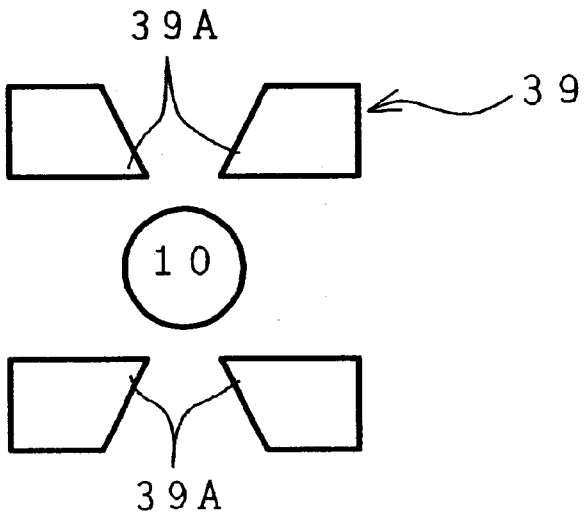
FIGS. 53 is a view showing an essential portion of a further configuration example in which the present invention is applied to a single electron beam type electron gun for a cathode ray tube.

FIG. 53 is a view illustrating another configuration example of a single beam type electron gun of a cathode ray tube to which the present invention is applied, wherein four deflection defocusing correction pole pieces 39 are used. Each interval between the pole pieces 39 is narrow in the horizontal direction.

With this configuration, it is possible to correct the deflection defocusing of an electron beam 10 deflected in the vertical direction.

Figure 54:
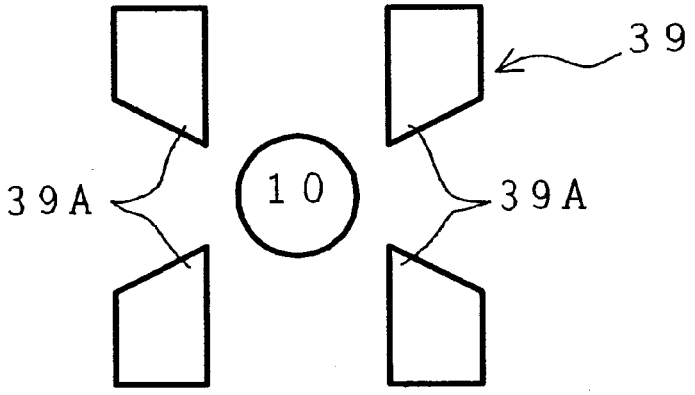
FIGS. 54 is a view showing an essential portion of a further configuration example in which the present invention is applied to a single electron beam type electron gun for a cathode ray tube.

FIG. 54 is a a view illustrating a further configuration example of a single beam type electron gun of a cathode ray tube to which the present invention is applied, wherein four deflection defocusing correction pole pieces 39 are used. Each interval between the pole pieces 39 is narrow in the vertical direction.

With this configuration, it is possible to correct the deflection defocusing of an electron beam 10 deflected in the horizontal direction. This configuration is suitable for a projection type cathode ray tube.

The poles pieces shown in FIGS. 53 and 54 may be combined and adapted for horizontal and vertical magnetic field distributions.

Figure 55:
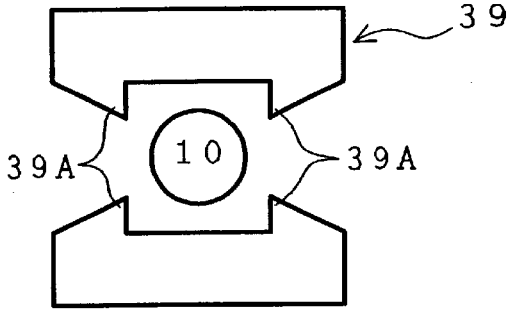
FIGS. 55 is a view showing an essential portion of a further configuration example in which the present invention is applied to a single electron beam type electron gun for a cathode ray tube.

FIG. 55 is a view illustrating a further configuration example of a single beam type electron gun of a cathode ray tube to which the present invention is applied, wherein two deflection defocusing correction pole pieces 39 are used. Each interval between of the pole pieces 39 is narrow in the vertical direction, and the deflection defocusing of an electron beam 10 deflected in the horizontal direction can be corrected. Moreover, since the length of the pole piece is longer in the horizontal direction, a magnetic flux in the horizontal direction can be converged in a large amount as compared with the configuration shown in FIG. 54.

Figure 56:
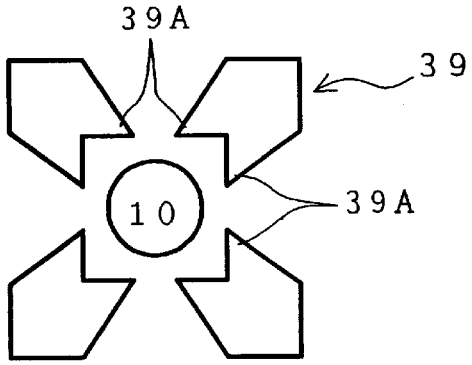
FIGS. 56 is a view showing an essential portion of a further configuration example in which the present invention is applied to a single electron beam type electron gun for a cathode ray tube.

FIG. 56 is a view illustrating a further configuration example of a single beam type electron gun of a cathode ray tube to which the present invention is applied. In this example, four deflection defocusing correction pole pieces 39 are used, and the deflection defocusing of an electron beam deflected in vertical and horizontal directions is corrected.

Figure 57:
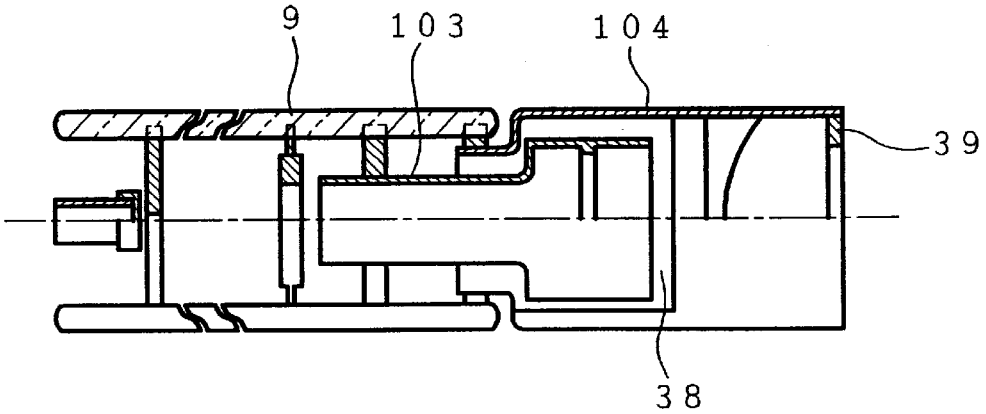
FIG. 57 is a partial sectional view of a three in-line beam type electron gun for a cathode ray tube to which the present invention is applied.

FIG. 57 is a partial sectional view of an electron gun for a cathode ray tube of the type having inline three electron beams to which the present invention is applied.

Figure 58:
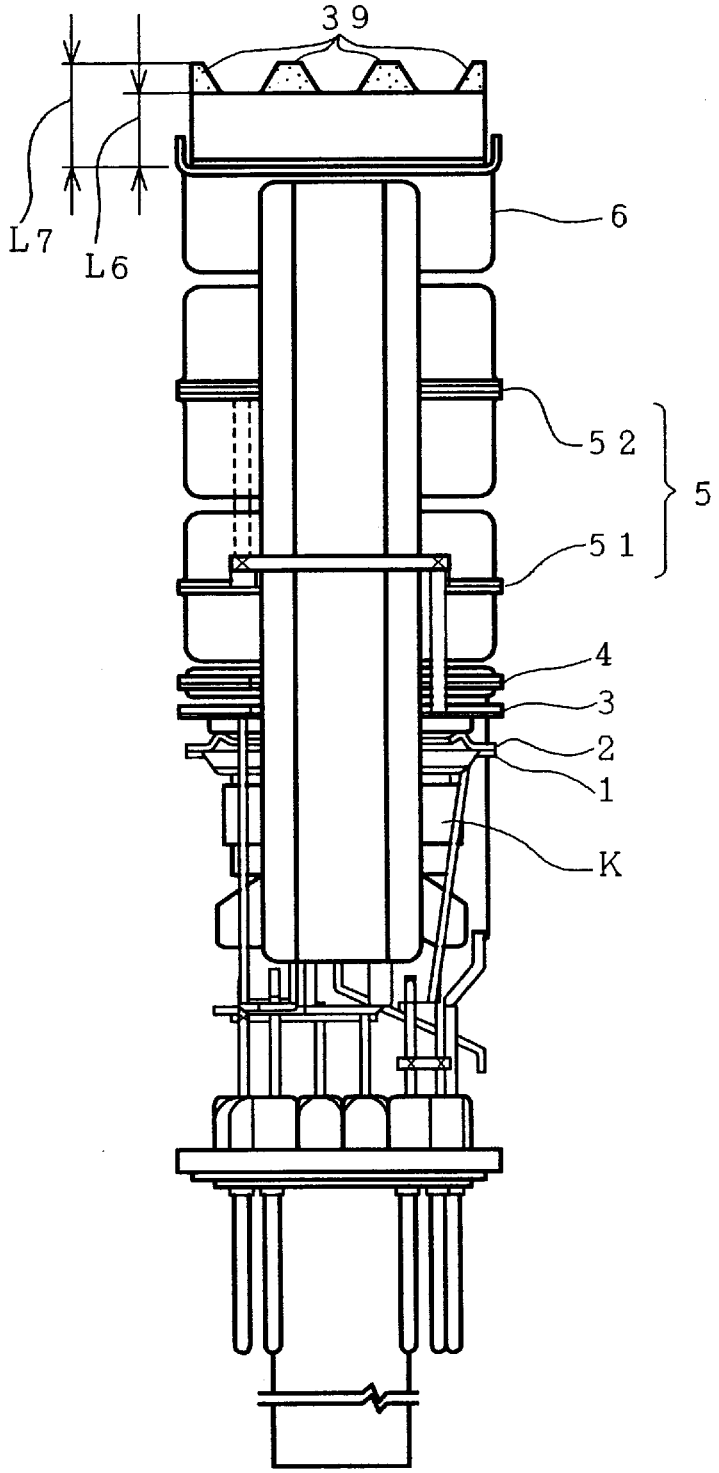
FIG. 58 is a view showing the entire appearance of another three in-line beam type electron gun for a cathode ray tube to which the present invention is applied.

FIG. 58 is a view showing the entire appearance of another electron gun for a cathode ray tube of the type having inline three electron beams to which the present invention is applied.

The partial cross-section of a further electron gun for a cathode ray tube of the type having inline three electron beams to which the present invention is applied is shown in FIG. 13.

Figure 59:
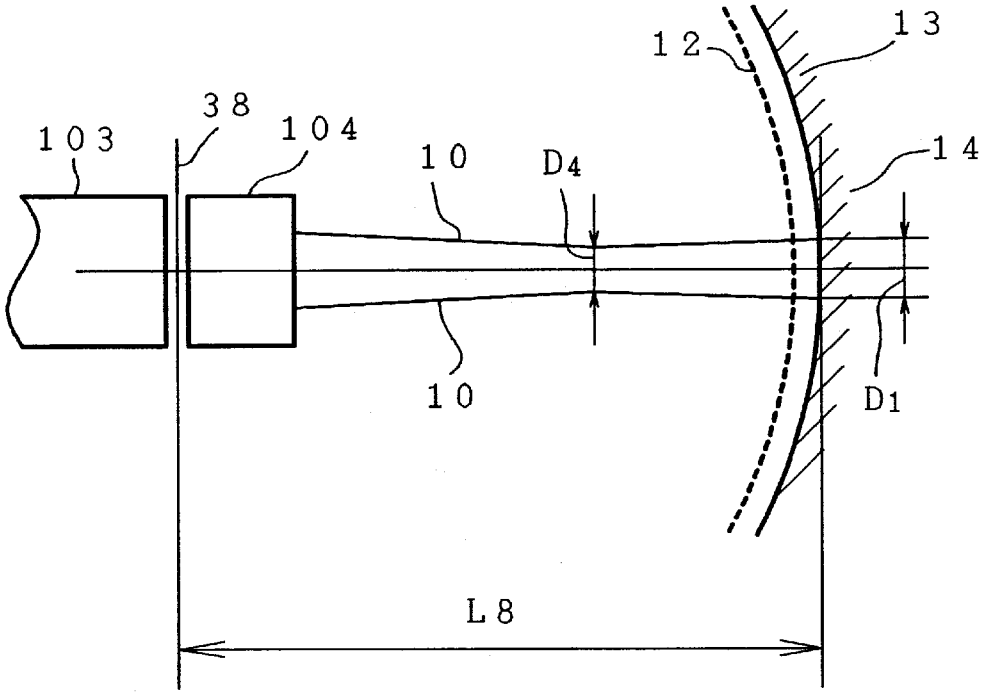
FIG. 59 is a view illustrating how a space-charge repulsion exerts an effect on an electron beam between a main lens and a phosphor screen.

FIG. 59 shows the effect of space-charge repulsion on an electron beam between a main lens and a phosphor screen. Reference numeral L8 indicates a distance between the main lens 38 and the phosphor screen 13.

In FIG. 59, as the electron beam 10 is sufficiently remote from an anode 4 (fourth grid electrode), the space around the electron beams 10 becomes at an anode potential, and the electric field is negligible. In such a state, rays of the electron beam 10 having traveled under a focusing action by the main lens are increasingly changed in trajectory by the space-charge repulsion and focused into the minimum diameter $D_4$ before reaching the phosphor film 13. After that, the electron beam 10 is increased in size as nearing the phosphor film 13 and produces a spot of the diameter $D_1$ at the phosphor film 13.

Figure 60:
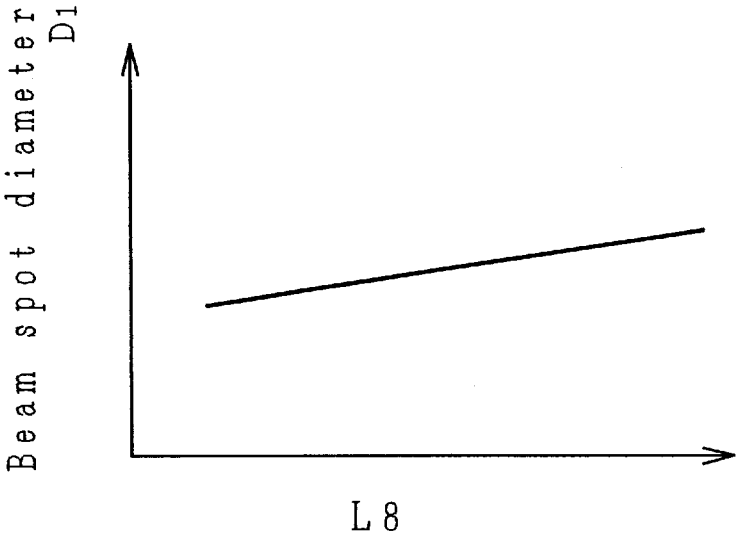
FIG. 60 is a view illustrating a relationship between a distance from a main lens to a phosphor screen and a diameter of an electron beam spot on the phosphor screen.

FIG. 60 is a view illustrating a relationship between a distance between the main lens and phosphor film and an electron beam spot on the phosphor film. The above space-charge repulsion is dependent on the distance $L_8$ between the main lens 38 and the phosphor film 13 in the case where the cathode ray tube is driven in the same condition. Namely, the beam spot diameter $D_1$ is increased linearly with the distance $L_8$.

For a cathode ray tube used for a color TV receiver set, when the maximum deflection angle is kept constant, the distance $L_8$ between the main lens 38 and the phosphor film 13 is increased as the screen size of the cathode ray tube is increased. Accordingly, when the screen size of the cathode ray tube is increased, the spot diameter $D_1$ of the electron beam on the phosphor film 13 is increased, as a result of which the resolution is not increased so mush by increasing the screen size.

Figure 61:
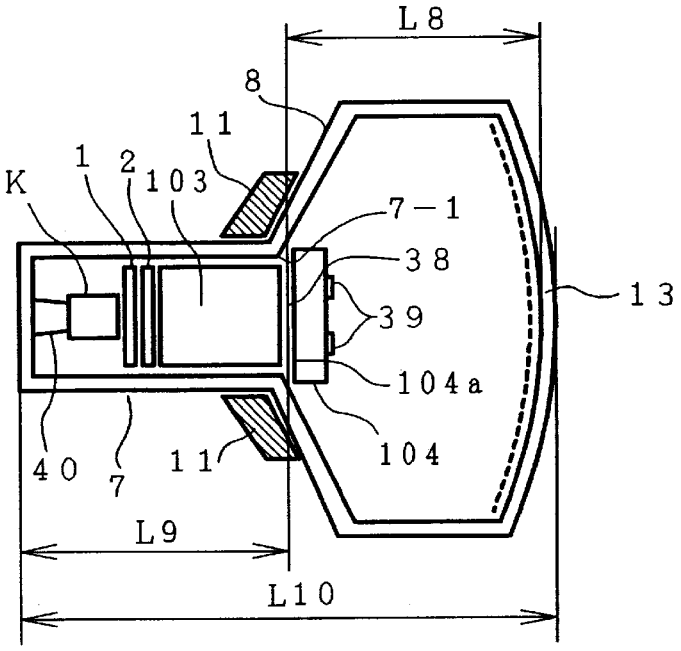
FIG. 61 is a schematic sectional view illustrating a dimensional example in the first embodiment of the cathode ray tube of the present invention.
Figure 62:
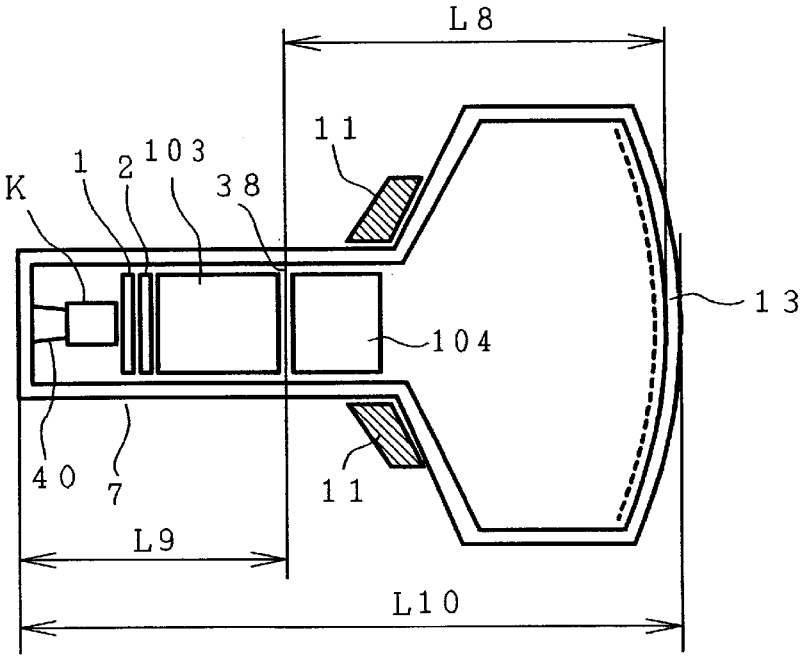
FIG. 62 (PRIOR ART)
FIG. 62 is a schematic sectional view illustrating a dimensional example in a conventional CRT.

FIG. 61 is a schematic sectional view illustrating the dimensions of a first embodiment of a cathode ray tube of the present invention, and FIG. 62 is a schematic sectional view illustrating dimensions of a related art cathode ray tube for comparison with the first embodiment of the cathode ray tube.

The cathode ray tubes shown in FIGS. 61 and 62 use electron guns which are identical to each other in the specification. Accordingly, each of the cathode ray tube has the same distance $L_9$ between a stem portion serving as the bottom of the cathode ray tube and a main lens 38.

In the cathode ray tune shown in FIG. 62, however, the main lens 38 must be separated from a deflection magnetic field formed by a deflection yoke 11 for preventing the electron beam passing through the main lens 38 from being disturbed, and thereby the electron gun is disposed at a position set back toward the neck portion 7 from the deflection yoke 11. As a result, the distance $L_8$ between the main lens 38 and the phosphor screen 13 cannot be made shorter than than the distance between the deflection yoke 11 and the phosphor screen 13.

The diameter of the main lens has been made larger for improving resolution at the screen center of a cathode ray tube. The effect of the enlargement of the diameter of the main lens exhibits an increase in the diameter of an electron beam passing through the main lens 38. As the diameter of an electron beam passing through the main lens 38 is increased, the disturbance by the deflection magnetic field is increased, so that the main lens having a large diameter must be further separated from the deflection magnetic field.

On the contrary, in the configuration of the present invention shown in FIG. 61, deflection defocusing correction pole pieces 39 for forming in a deflection magnetic field locally modified non-uniform magnetic fields synchronized with a deflection magnetic field are configured by allowing for the fact that an electron beam passing through the main lens 38 is disturbed by the deflection magnetic field, so that the distance $L_8$ can be made shorter than the distance between the deflection yoke 11 and the phosphor screen 13.

Accordingly, in the cathode ray tube of the present invention, the distance between the main lens and the phosphor screen can be made shorter than that of the related art cathode ray tube, with a result that even when the screen size of the cathode ray tube is increased, the effect of the space-charge repulsion can be reduced in combination with compatibility of a large-diameter main lens, to decrease the spot diameter of an electron beam on the phosphor screen, resulting in increased resolution.

In this way, the total length $L_{10}$ of the related art cathode ray tube is difficult to be shortened because the length of the electron gun is difficult to be shortened while suppressing a degradation in the focusing characteristic; however, in one embodiment of the present invention, since the distance between the main lens 38 and the phosphor screen 13 is shortened, the total length $L_{10}$ of the cathode ray tube can be significantly reduced without changing a portion from the cathode of the electron gun to the main lens.

According to one embodiment of the present invention, deflection defocusing correction pole pieces shown in FIG. 12 for forming locally modified non-uniform magnetic fields synchronized with a deflection magnetic field are provided in the deflection magnetic field in such a manner as to be attached to an anode 6 of the electron gun as shown in FIG. 13. This configuration is applied to a color cathode ray tube of the type having three in-line beams (outside diameter of neck portion: 29 mm; maximum deflection angle: 112°; diagonal measurement of the phosphor screen: 68 cm).

The cathode ray tube is combined with a deflection magnetic field shown in FIG. 10A, and the surfaces E of the magnetic pole pieces 39 on the phosphor screen side are set at an axial position of −96 mm. The cathode ray tube is driven by an anode voltage of 30 kV. A preferable result is obtained by the drive of the above cathode ray tube.

The value obtained by dividing the magnetic flux density B(mT) at the above portion by the root of the anode voltage Eb(kV) is 0.0104 $mT\cdot(kV)^{-1/2}$. This is about 40% of the maximum magnetic flux density.

Moreover, the portion where the surface E of the pole piece 39 is positioned is separated about 18 m from an end, on the side remote from the phosphor screen side, of a core of a coil for generating the deflection magnetic field toward the cathode side. In addition, when the axial position of the midplane 38 of the main lens is set at a position of −100 mm or more in FIG. 10A, the disturbance of the electron beam due to the deflection magnetic field is observed, to thus reduce resolution on the peripheral portion of the phosphor screen.

According to another embodiment, the deflection defocusing correction pole pieces 39 shown in FIG. 55 for forming locally modified non-uniform magnetic fields in the deflection magnetic field are attached on an anode electrode of an electron gun as shown in FIG. 14.

Such a cathode ray tube is of a projection type having the maximum deflection angle of 75°, which uses a magnetic focus coil 74 in addition to an electrostatic lens serving as a main lens of the electron gun. In the configuration shown in FIG. 14, the anode voltage of the electron gun is obtained by dividing a phosphor voltage by a resistive film 75 formed on the inner wall of the neck portion 7 and a resistor 76 provided in the cathode ray tube.

The distance between a surface 4*a,* facing the main lens side, of the anode 4 of the electron gun and the end, on the phosphor screen side, of the pole piece 39 is 180 mm.

In the configuration shown in FIG. 61, the provision of the deflection defocusing pole pieces 39 for forming locally modified non-uniform magnetic fields in the deflection magnetic field, enables the main lens 38 to be moved toward the phosphor screen 13 with little effect of the deflection magnetic field, so that the surface 104*a,* facing to the main lens, of the anode 4 can be moved toward the phosphor screen beyond the end 7-1 of the neck portion 7 on the phosphor screen side.

An electron gun of a cathode ray tube has a high voltage applied across an interelectrode spacing and generates a high electric field. A high level design technique and a quality control in manufacture are thus required for obtaining stable breakdown voltage characteristic. The highest electric field is formed near the main lens 38. The electric field near the main lens 38 is also affected by charge buildup on the inner wall of the neck portion and by micro-dust remaining in the cathode ray tube and adhering on the electrodes of the electron gun. This embodiment can avoid such inconveniences because the main lens 38 does not face the neck portion 7.

Moreover, the degradation in the breakdown voltage due to scraping off of a graphite film on the inner wall of the neck portion 7 can be prevented by shifting the power supply point to the anode 4 from the inner wall of the neck portion 7 to the inner wall of the funnel portion 8.

In general, in a color TV receiver set and a terminal display system of a computer, the depth of a cabinet is dependent on the total length $L_{10}$ of a cathode ray tube. In particular, the recent color TV reliever set has a tendency that the screen size is increased to the extent that the depth of the cabinet is not negligible when disposed in a home. When the color TV receiver set is arranged side by side with other furniture, only a difference in depth of several tens mm sometimes becomes inconvenient. As a result, the shortening of the depth of the cabinet is significantly effective in terms of space factor and ease of use.

According to the embodiments of the present invention, there can be provided a color TV receiver set and a terminal display system of a computer in which the depth of a cabinet can be significantly shortened as compared with the related art cabinet without harming the focus characteristics by shortening the total length of the cathode ray tube.

In general, a color TV receiver set, a finished cathode ray tube, and parts for a cathode ray tube such as a funnel are significantly larger in volume than an electronic part such as a semiconductor element, and consequently, a transportation cost per unit number becomes high. In particular, when a transportation path is longer such as for overseas, this is not negligible. According to the embodiment of the present invention, since a color TV receiver set in which the total length of a cathode ray tube is shortened and the depth of a cabinet is also shortened can be provided, the transportation cost can be saved.

FIGS. 63A to 63D are views illustrating the comparison in dimension between the image display system of the present invention and a related art image display system.

Figure 63A:
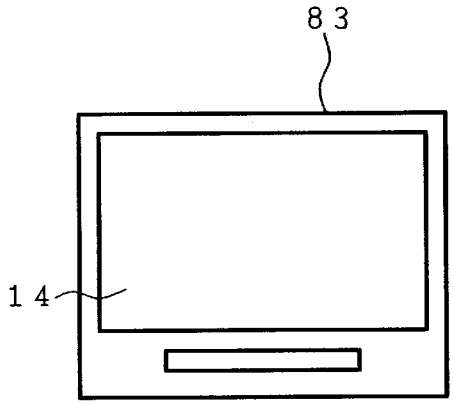
FIGS. 63A and 63B are a front view and a side view of an image display system of the present invention, respectively.
Figure 63B:
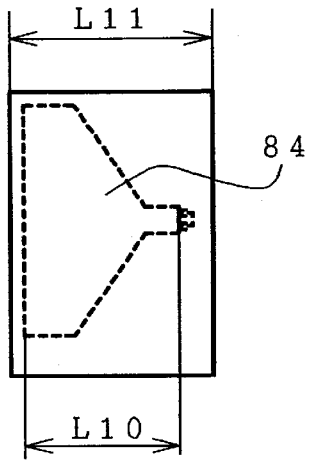

FIGS. 63A and 63B shows the image display system using a cathode ray tube of the present invention; wherein FIGS. 63A is a front view and FIG. 63B is a side view. As seen from these figures, the depth of the image display system can be shortened because the total length $L_{10}$ of the cathode ray tube can be shortened.

Figure 63C:
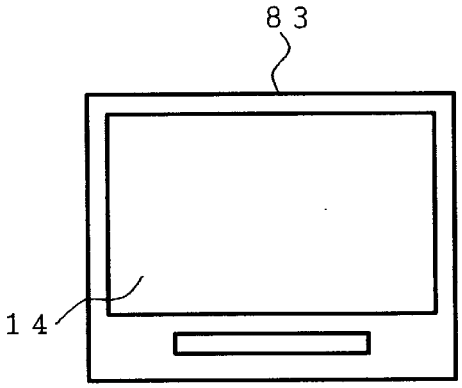
FIGS. 63C and 63D are a front view and a side view of a related art image display system, respectively.
Figure 63D:
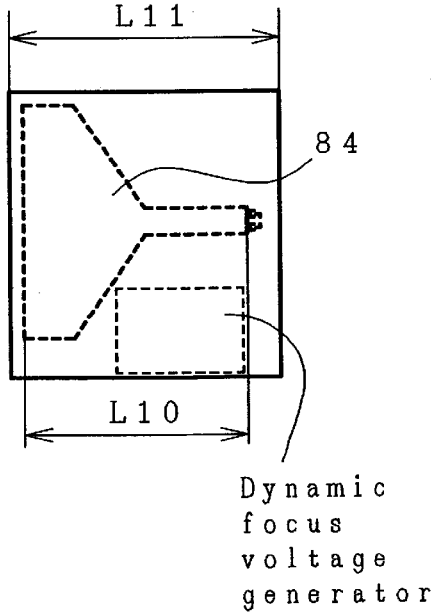

On the contrary, FIGS. 63C and 63D show the image display using a related art cathode ray tube; wherein FIG. 63C is a front view, and FIG. 63D is a side view. As seen from these figures, the depth of the image display system cannot be shortened because the total length of the cathode ray tube cannot be shortened.

As described above, the present invention provides a method of correcting deflection defocusing in a cathode ray tube which is capable of improving focus characteristics and obtaining desirable resolution over the entire screen and over the entire electron beam current region, particularly, without dynamic focusing, and which is also capable of reducing moire in a small-current region; a cathode ray tube employing the method; and an image display system including the cathode ray tube.

The present invention also provides a method of correcting deflection defocusing of a cathode ray tube which is capable of improving the focus characteristics and shortening the total length of a cathode ray tube; a cathode ray tube employing the method; and an image display system including the cathode ray tube.

What is claimed is:

1. A method of correcting deflection defocusing in a cathode ray tube including an electron gun comprising a cathode and a plurality of electrodes, an electron beam deflection device and a phosphor screen, said method including placement of pole pieces of magnetic material in a deflection magnetic field produced by said electron beam deflection device and thereby establishing a non-uniform magnetic field by modifying said deflection magnetic field locally in a path of an electron beam and correcting deflection defocusing of said electron beam corresponding to an amount of deflection of said electron beam, and said pole pieces being (i) disposed within 50 mm from a magnetic core of said electron beam deflection device toward said cathode of said electron gun, (ii) supported by a cup-shaped electrode having at least one electron beam hole in a bottom thereof on a cathode side thereof, and (iii) spaced from said at least one electron beam hole toward said phosphor screen.

2. A method of correcting deflection defocusing in a cathode ray tube including an electron gun comprising a cathode and a plurality of electrodes, an electron beam deflection device and a phosphor screen, said method including placement of pole pieces of magnetic material substantially symmetrically with respect to and on opposite sides of a path of an undeflected electron beam, in a deflection magnetic field produced by said electron beam deflection device and thereby establishing at least one non-uniform magnetic field by modifying said deflection magnetic field locally in a path of an electron beam and correcting deflection defocusing of said electron beam corresponding to an amount of deflection of said electron beam, and said pole pieces being (i) disposed within 50 mm from a magnetic core of said electron beam deflection device toward said cathode of said electron gun, (ii) supported by a cup-shaped electrode having at least one electron beam hole in a bottom thereof on a cathode side thereof, and (iii) spaced from said at least one electron beam hole toward said phosphor screen.

3. A method of correcting deflection defocusing in a cathode ray tube according to claim 4, wherein said at least one non-uniform magnetic field has a diverging action on said electron beam.

4. A method of correcting deflection defocusing in a cathode ray tube according to claim 2, wherein said at least one non-uniform magnetic field has a diverging action on said electron beam and thereby correcting deflection defocusing corresponding to at least one of deflections in a direction of scanning said electron beam and in a direction perpendicular to said direction of scanning said electron beam in amount.

5. A method of correcting deflection defocusing in a cathode ray tube according to claim 2, wherein:

said pole pieces comprise a plurality of members of magnetic material horizontally oriented with a gap therebetween above and below a path of an undeflected electron beam in a deflection magnetic field produced by said electron beam deflection device, said pole pieces are disposed within 50 mm from a magnetic core of said electron beam deflection device toward said cathode of said electron gun, and each of said gaps is in a region in the vicinity of a plane including said path of said undeflected electron beam and perpendicular to a direction of a horizontal deflection of an electron beam.

6. A cathode ray tube according to claim 5, wherein each of said plurality of members of magnetic material is magnetically connected to one of said plurality of members of magnetic material facing thereto across said path of said undeflected electron beam, by means of a member of magnetic material.

7. A method of correcting deflection defocusing in a cathode ray tube including an electron gun comprising a cathode and a plurality of electrodes, an electron beam deflection device and a phosphor screen, said method including placement of pole pieces of magnetic material substantially symmetrically with respect to and on opposite sides of a path of an undeflected electron beam, in a deflection magnetic field produced by said electron beam deflection device and thereby establishing a non-uniform magnetic field substantially centered about a central path of an undeflected electron beam by modifying said deflection magnetic field locally and correcting deflection defocusing of said electron beam corresponding to an amount of deflection of said electron beam, and said pole pieces being (i) disposed within 50 mm from a magnetic core of said electron beam deflection device toward said cathode of said electron gun, (ii) supported by a cup-shaped electrode having at least one electron beam hole in a bottom thereof on a cathode side thereof, and (iii) spaced from said at least one electron beam hole toward said phosphor screen.

8. A method of correcting deflection defocusing in a cathode ray tube according to claim 7, wherein said non-uniform magnetic field has a focusing effect on said electron beam.

9. A method of correcting deflection defocusing in a cathode ray tube according to claim 7, wherein said non-uniform magnetic field has a focusing effect on said electron beam and thereby correcting deflection defocusing corresponding to at least one of deflections in a direction of scanning said electron beam and in a direction perpendicular to said direction of scanning said electron beam in amount.

10. A method of correcting deflection defocusing in a cathode ray tube according to claim 7, wherein:

said pole pieces comprise a pair of vertically extending members of magnetic material above and below a path of an undeflected electron beam in a region in the vicinity of a plane including said path of said undeflected electron beam and perpendicular to a direction of a horizontal deflection of an electron beam, in a deflection magnetic field produced by said electron beam deflection device, and said pair of vertically extending members of magnetic material is disposed within 50 mm from a magnetic core of said electron beam deflection device toward said cathode of said electron gun.

11. A method of correcting deflection defocusing in a cathode ray tube including an electron gun comprising a cathode and a plurality of electrodes and generating three in-line electron beams, an electron beam deflection device and a phosphor screen, said method including placement of pole pieces of magnetic material in a deflection magnetic field produced by said electron beam deflection device and thereby establishing at least one non-uniform magnetic field on each side in a direction perpendicular to said in-line direction, of a central path of each of said three electron beams at zero deflection, said pole pieces being (i) disposed within 50 mm from a magnetic core of said electron beam deflection device toward said cathode of said electron gun, (ii) supported by a cup-shaped electrode having at least one electron beam hole in a bottom thereof on a cathode side thereof, and (iii) spaced from said at least one electron beam hole toward said phosphor screen, and said at least one non-uniform magnetic field having a diverging effect on said three electron beams corresponding to an amount of deflection of said three electron beams.

12. A method of correcting deflection defocusing in a cathode ray tube according to claim 11, wherein:

said pole pieces comprise a plurality of members of magnetic material horizontally oriented with a gap therebetween above and below each path of said three electron beams at zero deflection in a deflection magnetic field produced by said electron beam deflection device, said pole pieces are disposed within 50 mm from a magnetic core of said electron beam deflection device toward said cathode of said electron gun, and each of said gaps is in a region in the vicinity of a plane including each path of said three electron beams at zero deflection and perpendicular to a direction of a horizontal deflection of said three electron beams.

13. A method according to claim 12, wherein each of said plurality of members of magnetic material is magnetically connected to one of said plurality of members of magnetic material facing thereto across each path of said three electron beams at zero deflection, by means of a member of magnetic material.

14. A method of correcting deflection defocusing in a cathode ray tube including an electron gun comprising a cathode and a plurality of electrodes and generating three in-line electron beams, an electron beam deflection device and a phosphor screen, said method including placement of pole pieces of magnetic material in a deflection magnetic field produced by said electron beam deflection device and thereby establishing at least one first non-uniform magnetic field on each side in a direction perpendicular to said in-line direction, of a central path of each of said three electron beams at zero deflection, said at least one first non-uniform magnetic field having a diverging effect on said three electron beams corresponding to an amount of deflection of said three electron beams, and establishing at least one second non-uniform magnetic field centered about a central path of each of said three electron beams at zero deflection, said at least one second non-uniform magnetic field having a focusing effect on said three electron beams corresponding to an amount of deflection of said three electron beams, and said pole pieces being (i) disposed within 50 mm from a magnetic core of said electron beam deflection device toward said cathode of said electron gun, (ii) supported by a cup-shaped electrode having at least one electron beam hole in a bottom thereof on a cathode side thereof, and (iii) spaced from said at least one electron beam hole toward said phosphor screen.

15. A method of correcting deflection defocusing in a cathode ray tube according to claim 14, wherein:

said pole pieces comprise a pair of vertically extending members of magnetic material above and below a path of said three electron beams at zero deflection in each region in the vicinity of each plane including each path of said three electron beams at zero deflection and perpendicular to a direction of a horizontal deflection of said three electron beams, in a deflection magnetic field produced by said electron beam deflection device, and said pair of vertically extending members of magnetic material is disposed within 50 mm from a magnetic core of said electron beam deflection device toward said cathode of said electron gun.

16. A method of correcting deflection defocusing in a cathode ray tube according to one of claims 1–4, 7–9, 11, or 14, wherein said pole pieces are made of soft magnetic material.

17. A method of correcting deflection defocusing in a cathode ray tube according to one of claims 1–4, 7–9, 11 or 14, wherein said pole pieces are made of soft magnetic material having relative magnetic permeability of not less than 50 at room temperature.

18. A cathode ray tube including an electron gun comprising a cathode and a plurality of electrodes and generating an electron beam and a phosphor screen for use with an electron beam deflection device, said cathode ray tube including pole pieces of magnetic material in a deflection magnetic field produced by said electron beam deflection device for establishing at least one non-uniform magnetic field on each side of a central path of said electron beam at zero deflection for correcting deflection defocusing corresponding to deflection of said electron beam, and said pole pieces being (i) disposed within 50 mm from an end of a magnetic core on a cathode side thereof of said electron beam deflection device toward said cathode of said electron gun, (ii) supported by a cup-shaped electrode having at least one electron beam hole in a bottom thereof on a cathode side thereof, and (iii) spaced from said at least one electron beam hole toward said phosphor screen.

19. A cathode ray tube according to claim 18, wherein said pole pieces are disposed in a region having a magnetic flux density B satisfying a relationship below, $$B/(\text{a square root of } Eb) \geqq 0.02$$

where Eb is an anode voltage of said electron gun in kilovolts, and

B is a magnetic flux density in mT.

20. A cathode ray tube according to claim 18, wherein a maximum of a distribution of said at least one non-uniform magnetic field is not less than 5% of a maximum of a distribution of said deflection magnetic field.

21. A cathode ray tube according to claim 18, wherein said pole pieces are disposed in a region having a magnetic flux density B satisfying a relationship below, $$B/(\text{a square root of } Eb) \geqq 0.001$$

where Eb is an anode voltage of said electron gun in kilovolts, and

B is a magnetic flux density in mT.

22. A cathode ray tube according to claim 18, wherein a gap between pole tips of said pole pieces is disposed not less than 10% of a diameter of an aperture in an anode on a side facing a main lens of said electron gun, said diameter being measured in a direction perpendicular to a scanning direction of said electron beam.

23. A cathode ray tube according to claim 16, wherein a distance between centers of distributions of said at least one non-uniform magnetic field on each side of a central path of said electron beam at zero deflection is not less than 10% of a diameter of an aperture in an anode on a side facing a main lens of said electron gun, and said diameter being measured in a direction perpendicular to a scanning direction of said electron beam.

24. A cathode ray tube according to claim 18, wherein:

said pole pieces comprise a plurality of members of magnetic material horizontally oriented with a gap therebetween disposed above and below a path of an undeflected electron beam in a deflection magnetic field produced by said electron beam deflection device, said pole pieces are disposed within 50 mm from a magnetic core of said electron beam deflection device toward said cathode of said electron gun, and each of said gaps is in a region in the vicinity of a plane including said path of said undeflected electron beam and perpendicular to a direction of a horizontal deflection of an electron beam.

25. A cathode ray tube according to claim 24, wherein each of said plurality of members of magnetic material is magnetically connected to one of said plurality of members of magnetic material facing thereto across said path of said undeflected electron beam, by means of a member of magnetic material.

26. A cathode ray tube according to claim 18, wherein said pole pieces are disposed in a region having a magnetic flux density not less than 5% of a maximum of a distribution of said deflection magnetic field.

27. A cathode ray tube including an electron gun comprising a plurality of electrodes and generating three in-line electron beams and a phosphor screen for use with an electron beam deflection device, said cathode ray tube including pole pieces of magnetic material in a deflection magnetic field produced by said electron beam deflection device for establishing at least one non-uniform magnetic field on each side of a central path of said electron beam at zero deflection for correcting deflection defocusing corresponding to deflection of said electron beam, an aperture in a cathode-side bottom of a cup-shaped electrode of said electron gun mounting said pole pieces thereon being common to said three electron beams.

28. A cathode ray tube including an electron gun comprising a cathode and a plurality of electrodes and generating an electron beam and a phosphor screen for use with an electron beam deflection device, said cathode ray tube including pole pieces of magnetic material in a deflection magnetic field produced by said electron beam deflection device for establishing at least a non-uniform magnetic field having a distribution centered about a central path of said electron beam at zero deflection for correcting deflection defocusing corresponding to deflection of said electron beam, said pole pieces of magnetic material being (i) disposed within 50 mm from an end of a magnetic core of said electron beam on a cathode side thereof toward said cathode, (ii) supported by a cup-shaped electrode having at least one electron beam hole in a bottom thereof on a cathode side thereof, and (iii) spaced from said at least one electron beam hole toward said phosphor screen.

29. A cathode ray tube according to claim 26, wherein said pole pieces of magnetic are disposed in a region having a magnetic flux density B satisfying a relationship below, $$B/(\text{a square root of } Eb) \geqq 0.003$$

where Eb is an anode voltage of said electron gun in kilovolts, and

B is a magnetic flux density in mT.

30. A cathode ray tube according to claim 28, wherein a maximum of said at least one non-uniform magnetic field established by said pole pieces of magnetic material is not less than 1% of a maximum of a distribution of said deflection magnetic field.

31. A cathode ray tube according to claim 28, wherein a maximum value B of a distribution of said at least a non-uniform magnetic field satisfies a relationship below, $$B/(\text{a square root of } Eb) \geqq 0.005$$

where Eb is an anode voltage of said electron gun in kilovolts, and

B is a magnetic flux density in mT.

32. A cathode ray tube according to claim 28, wherein a gap between pole tips of adjacent ones of said pole pieces of magnetic material is disposed not less than 10% of a diameter of an aperture in an anode on a side facing a main lens of said electron gun, and said diameter being measured in a direction perpendicular to a scanning direction of said electron beam.

33. A cathode ray tube according to claim 28, wherein said pole pieces of magnetic material are disposed in a region having a magnetic flux density not less than 0.05% of a maximum of a distribution of said magnetic deflection field.

34. A cathode ray tube including an electron gun comprising a cathode and a plurality of electrodes and generating an electron beam and a phosphor screen for use with an electron beam deflection device, said cathode ray tube including pole pieces of magnetic material in a deflection magnetic field produced by said electron beam deflection device for establishing at least one non-uniform magnetic field having a distribution centered about a central path of said electron beam at zero deflection for correcting deflection defocusing corresponding to deflection of said electron beam, an aperture in a cathode-side bottom of a cup-shaped electrode of said electron gun mounting said pole pieces thereon being common to said three electron beams.

35. A cathode ray tube including an electron gun comprising a cathode and a plurality of electrodes and generating three in-line electron beams, an electron beam deflection device and a phosphor screen, said cathode ray tube including pole pieces of magnetic material in a deflection magnetic field produced by said electron beam deflection device and thereby establishing at least one non-uniform magnetic field on each of sides of a central path of each of said three electron beams at zero deflection, a maximum value of a side-electron-beam related distribution of said at least one non-uniform magnetic field being different from a maximum value of a center-electron-beam related distribution of said at least one non-uniform magnetic field, and said pole pieces being (i) disposed within 50 mm from an end of a magnetic core on a cathode side thereof of said electron beam deflection device toward said cathode, (ii) supported by a cup-shaped electrode having at least one electron beam hole in a bottom thereof on a cathode side thereof, and (iii) spaced from said at least one electron beam hole toward said phosphor screen.

36. A cathode ray tube according to claim 35, wherein a side-electron-beam related distribution of said at least one non-uniform magnetic field is asymmetrical with respect to a path of a side electron beam at zero deflection of said three electron beams.

37. A cathode ray tube according to one of claims 18 to 23, 27 to 32 or 34 to 36, wherein said pole pieces of magnetic material are made of soft magnetic material.

38. A cathode ray tube according to one of claims 18 to 23, 27 to 32 or 34 to 36, wherein said pole pieces of magnetic material are made of soft magnetic material having a relative magnetic permeability not less than 50 at room temperature.

39. An image display system employing a cathode ray tube according to one of claims 18 to 23, 27 to 32 or 34 to 36.

* * * * *